US011975876B2

(12) United States Patent
Berkley et al.

(10) Patent No.: US 11,975,876 B2
(45) Date of Patent: May 7, 2024

(54) BAG PACKING MACHINE

(71) Applicant: Tension International, Inc., Kansas City, MO (US)

(72) Inventors: William S. Berkley, Kansas City, MO (US); Robert Terzini, Corinth, TX (US); Anthony R. Barone, Fort Collins, CO (US)

(73) Assignee: Tension International, Inc., Kansas City, MO (US)

( * ) Notice: Subject to any disclaimer, the term of this patent is extended or adjusted under 35 U.S.C. 154(b) by 0 days.

(21) Appl. No.: 17/658,381

(22) Filed: Apr. 7, 2022

(65) Prior Publication Data

US 2022/0324600 A1 Oct. 13, 2022

Related U.S. Application Data

(60) Provisional application No. 63/171,687, filed on Apr. 7, 2021.

(51) Int. Cl.

| | |
|---|---|
| ***B65B 1/06*** | (2006.01) |
| ***B65B 43/14*** | (2006.01) |
| ***B65B 43/16*** | (2006.01) |
| ***B65B 43/30*** | (2006.01) |
| ***B65B 43/44*** | (2006.01) |
| ***B65B 51/14*** | (2006.01) |
| ***B65B 65/00*** | (2006.01) |

(52) U.S. Cl.

CPC ..... *B65B 43/16* (2013.01); *B65B 1/06* (2013.01); *B65B 51/146* (2013.01); *B65B 65/003* (2013.01)

(58) Field of Classification Search

CPC ..... B65B 1/06; B65B 43/14; B65B 43/30; B65B 43/44; B65B 51/146

USPC ..... 53/284.7; 221/197, 198

See application file for complete search history.

(56) References Cited

U.S. PATENT DOCUMENTS

| | | | | | |
|---|---|---|---|---|---|
| 3,915,338 | A | * | 10/1975 | Kronseder | B65C 9/10 156/DIG. 29 |
| 3,961,461 | A | * | 6/1976 | Ruf | B65B 43/34 53/384.1 |
| 4,045,940 | A | * | 9/1977 | White | B65B 43/56 53/500 |
| 4,108,300 | A | * | 8/1978 | Hayase | B65G 37/005 198/470.1 |
| 5,265,402 | A | * | 11/1993 | Lerner | B65B 57/06 53/375.2 |

(Continued)

*Primary Examiner* — Thanh K Truong
*Assistant Examiner* — Patrick B Fry
(74) *Attorney, Agent, or Firm* — AVEK IP, LLC; Kent R. Erickson

(57) ABSTRACT

A poly bubble bag filling machine, seal head, bag magazine, and a carton are described. The filling machine includes the bag magazine which is configured to hold and advance a plurality of pre-formed poly bubble bags as they are retrieved for filling. The carton provides simple handling and replacement of bags in the magazine and enables operation of the magazine while the carton is in place. A bag-transfer carriage transfers bags from the magazine to the seal head. The seal head includes suction bars configured to enable application and retention of a sufficient suction force to sides of the bag to open and retain the bag during filling. Sealing bars are positioned near the suction bars and are operable to seal the bag closed via application of heat.

18 Claims, 43 Drawing Sheets

(56) References Cited

U.S. PATENT DOCUMENTS

| | | | | |
|---|---|---|---|---|
| 6,357,210 | B1 * | 3/2002 | Wetter | B65B 63/02 53/436 |
| 8,038,017 | B2 * | 10/2011 | Close | A47F 1/126 206/774 |
| 8,646,621 | B2 * | 2/2014 | Zacherle | B65D 5/16 206/774 |
| 9,689,601 | B2 * | 6/2017 | Hsu | F25C 5/20 |
| 9,697,669 | B2 | 7/2017 | Terzini | |
| 10,668,630 | B2 * | 6/2020 | Robinson | B65B 35/56 |
| 11,247,829 | B2 * | 2/2022 | O'Dowd | B65D 33/001 |
| 11,396,447 | B1 * | 7/2022 | Mortimer | B65B 29/02 |
| 2018/0257803 | A1 * | 9/2018 | Jauch | B65B 61/20 |
| 2019/0276216 | A1 * | 9/2019 | O'Dowd | B31D 5/0073 |

* cited by examiner

BAG PACKING MACHINE

CROSS-REFERENCE TO RELATED APPLICATIONS

This application claims the benefit of U.S. Provisional Patent Application No. 63/171,687, filed Apr. 7, 2021, the disclosure of which is hereby incorporated herein in its entirety by reference.

BACKGROUND

Modern packaging operations for placing products in sales-ready packaging or for placing packaged products into mail-ready packaging often employ polyethylene bags or bags formed from similar sheet materials (hereinafter referred to as poly bags). One or more products and any associated items are placed into the poly bags which are then sealed and transferred on to further handling, packaging, or mailing. Labels, such as mailing labels or other product literature may be printed directly on the poly bags or disposed thereon via a label applicator system.

The poly bags generally comprise two layers of polyethylene sheet that are sealed together along three edges to form a pocket with a fourth edge that is left unsealed to allow for filling. The fourth edge is sealable after filling in a manner similar to that of the other three edges such as via application of heat to melt or fuse the layers together or by application of a glue or adhesive among other methods. The poly bags may be provided for filling in a variety of forms. The bags may be pre-formed in a continuous, perforated roll, pre-formed and arranged in a stacked form, or formed in-process from a roll of raw polyethylene (or similar material) web.

As industries move toward a greater reliance on mail order items, a trend toward use of poly bubble bags that provide greater protection of the contents therein can be seen. Like poly bags, poly bubble bags may comprise a polyethylene or similar web or sheet material formed into a pocket with three sealed edges and a fourth edge that is left open for filling and that is sealable following filling. Unlike poly bags which comprise a single-ply polyethylene sheet, poly bubble bags are formed from a web of bubble sheet. The bubble sheet comprises two or more layers of polyethylene (or similar material) that are bonded together across the width and/or length of the web to from a plurality of air pockets. The air pockets are filled with air or other gas to form bubbles or cushions. The additional thickness and stiffness of the bubble sheet over that of single-ply polyethylene sheet and the additional surface irregularities produced by the bubbles present complications for material handling and bag filling operations that are not readily compensated by available technologies.

SUMMARY

A high-level overview of various aspects of exemplary embodiments is provided here to introduce a selection of concepts that are further described in the Detailed-Description section below. This summary is not intended to identify key features or essential features of embodiments, nor is it intended to be used in isolation to determine the scope of the described subject matter. In brief, this disclosure describes a poly bubble-bag filling machine with a poly bubble-bag seal head and a carton for replenishing a supply of poly-bubble bags in the bag-filling machine. The bag-filling machine includes a poly bubble-bag magazine, a bag-transfer carriage, a product-induction conveyor, a filling chute, a labeling device, and the seal head. The magazine retains a plurality of preformed poly bubble-bags in a horizontally disposed stack and presents the bags to the bag-transfer carriage. A carton configured to aid replenishment of bags into the magazine is configured to contain a stack of preformed poly bubble bags for bulk loading into the magazine.

The bag-transfer carriage picks a bag from an end of the magazine and transfers the bag to a filling position beneath the filling chute where the bag is handed off to the seal head.

The product conveyor may comprise any product transport apparatus including conveyor belts, linear synchronous motors or actuators that may employ a magnetic induction system, robotics, or the like that can transport the products to be bagged to the filling chute. The product transport apparatus may also include a pusher or other transfer apparatus configured to move the products from the product conveyor into the chute.

The filling chute directs the products from the product transport apparatus into a poly bubble-bag positioned therebelow via gravity. The filling chute may include a variety of sensors configured to identify and confirm/cross-reference an identity of the products, presence of the products at the mouth of the chute and/or within the chute, and/or presence of a poly bubble bag beneath the chute.

The labeling device is configured to apply identifying information on each of the poly bubble bags. The information may be printed directly onto the bags or onto a label that is applied to the bag. Such information may include, for example, identifying indicia for the product or products disposed in the bag, customer information, or the like.

The bag seal head is configured to receive a poly bubble bag from the bag-transfer carriage, open and hold the bag for filling, and close and seal the bag following filling. The seal head includes a pair of opposed suction bars and a pair of opposed seal bars. The suction bars include a foam pad applied to a working face thereof. The foam pad includes apertures that align with manifold openings in the suction bar to allow application of a vacuum or suction force therethrough. The foam pad sufficiently seals against the poly bubble bag to enable provision of a sufficient suction force for holding the poly bubble bag during filling.

The suction bars are moveable toward one another to contact side faces of a poly bubble bag held therebetween by the bag-transfer carriage. A vacuum is applied across the suction bars to engage the poly bubble-bag via suction. The suction bars are withdrawn to open the bag for filling without need for additional mechanical gripping or opening means such as fingers or other appendages that might be inserted into the opening of the bag. Following filling, the suction bars are again actuated toward one another to close the bag. The seal bars are also similarly actuated to bring a sealing element into operable contact with the bag. The sealing element applies heat to the bag sufficient to bond the opposing sides of the bag together and seal the bag. The vacuum is released and the suction bars and seal bars are withdrawn to allow the sealed bag to fall onto a conveyor or container of a takeaway system positioned therebelow.

The actuation of the suction bars may include a spring biased element configured to detect and/or protect objects positioned between the suction bars and to avoid application of a force between the suction bars that might injure an operator or a product trapped therebetween.

The seal bars may be disposed beneath and recessed further apart than the suction bars when in a withdrawn position to aid in reducing or preventing contact between the poly bubble bag or an operator and the sealing elements which may be maintained at a high temperature.

The filling machine may further include an insert preparation apparatus. The insert preparation apparatus may include one or more printers configured to print, obtain, or otherwise prepare documents to be included in the poly bubble bags along with the products. The documents may be printed, folded, and inserted into the bags along with the products while the bags are held open by the bag seal head.

DESCRIPTION OF THE DRAWINGS

Illustrative embodiments are described in detail below with reference to the attached drawing figures, and wherein.

DETAILED DESCRIPTION

The subject matter of select exemplary embodiments is described with specificity herein to meet statutory requirements. But the description itself is not intended to necessarily limit the scope of embodiments. Rather, the subject matter might be embodied in other ways to include different components, steps, or combinations thereof similar to the ones described in this document, in conjunction with other present or future technologies. Terms should not be interpreted as implying any particular order among or between various steps herein disclosed unless and except when the order of individual steps is explicitly described. The terms "about" or "approximately" or "substantially" as used herein denote deviations from the exact value by +/−10%, preferably by +/−5% and/or deviations in the form of changes that are insignificant to the function.

Figure 1:
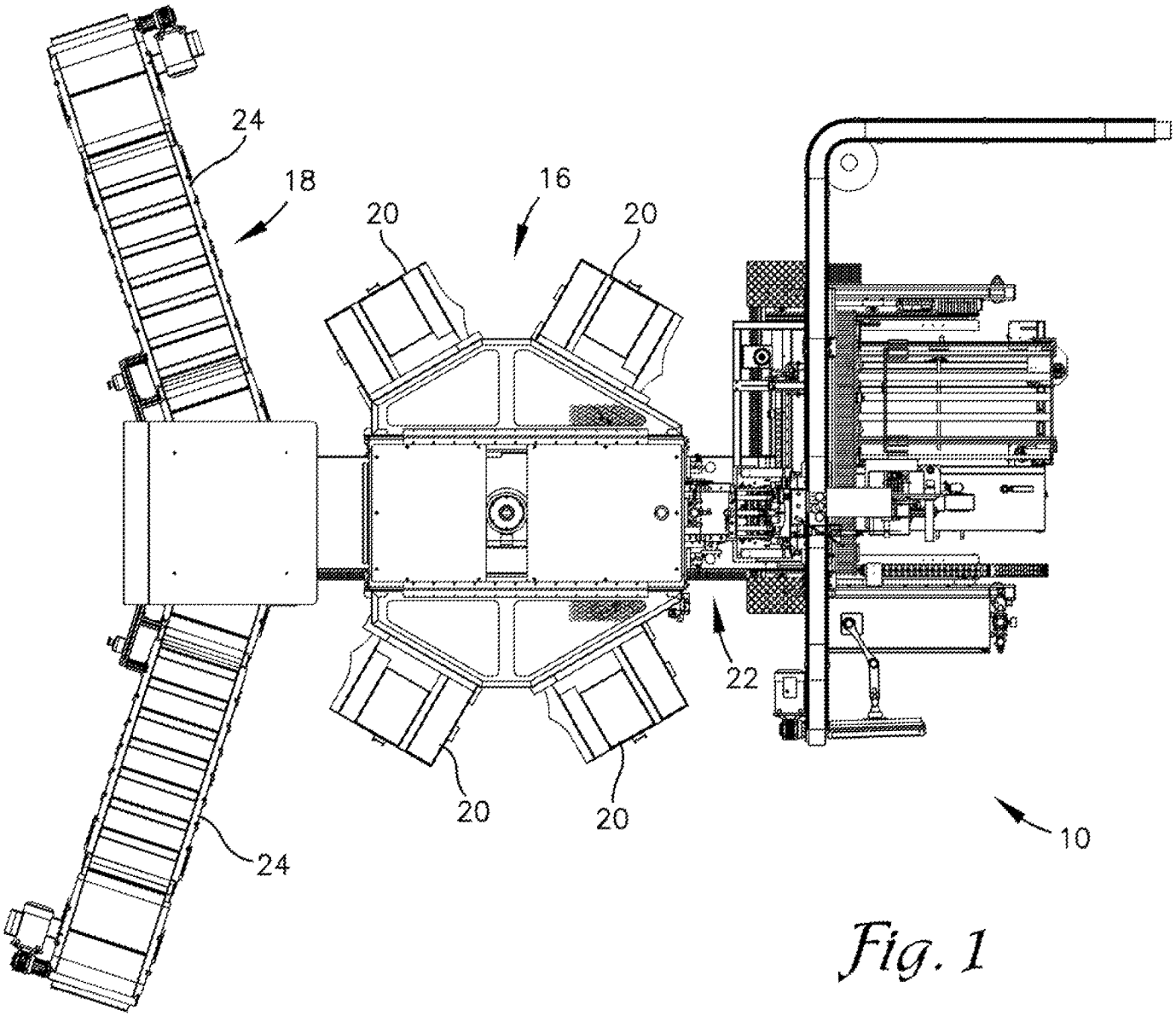
FIG. 1 is top plan view of a poly bubble-bag filling machine with an integrated document-printing apparatus and a takeaway conveyance system depicted in accordance with an exemplary embodiment.
Figure 2:
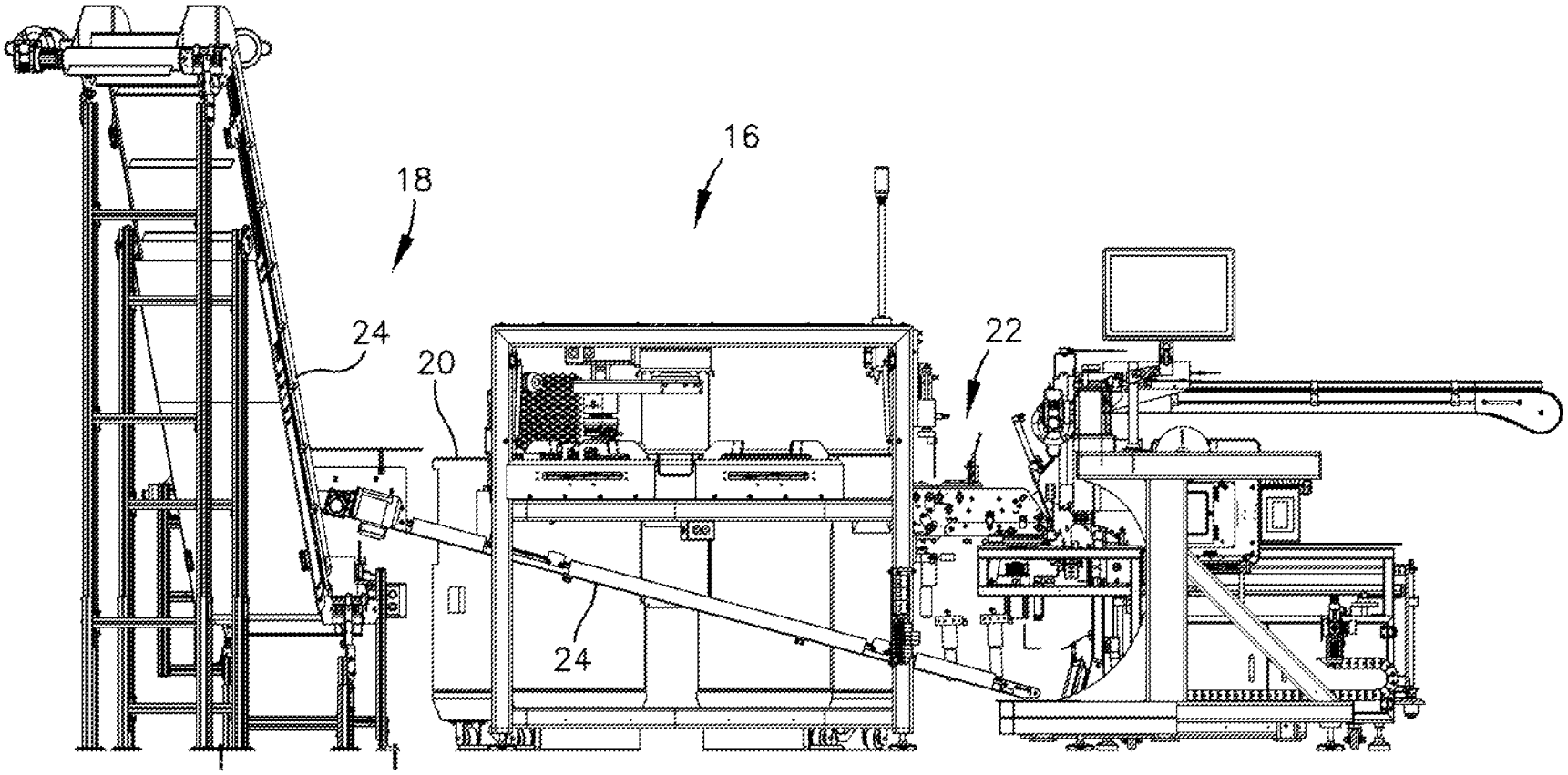
FIG. 2 is a side elevational view of the poly bubble-bag filling machine of FIG. 1 with several side panels removed to reveal a portion of the takeaway conveyance system housed within and beneath the document-printing apparatus depicted in accordance with an exemplary embodiment.
Figure 3:
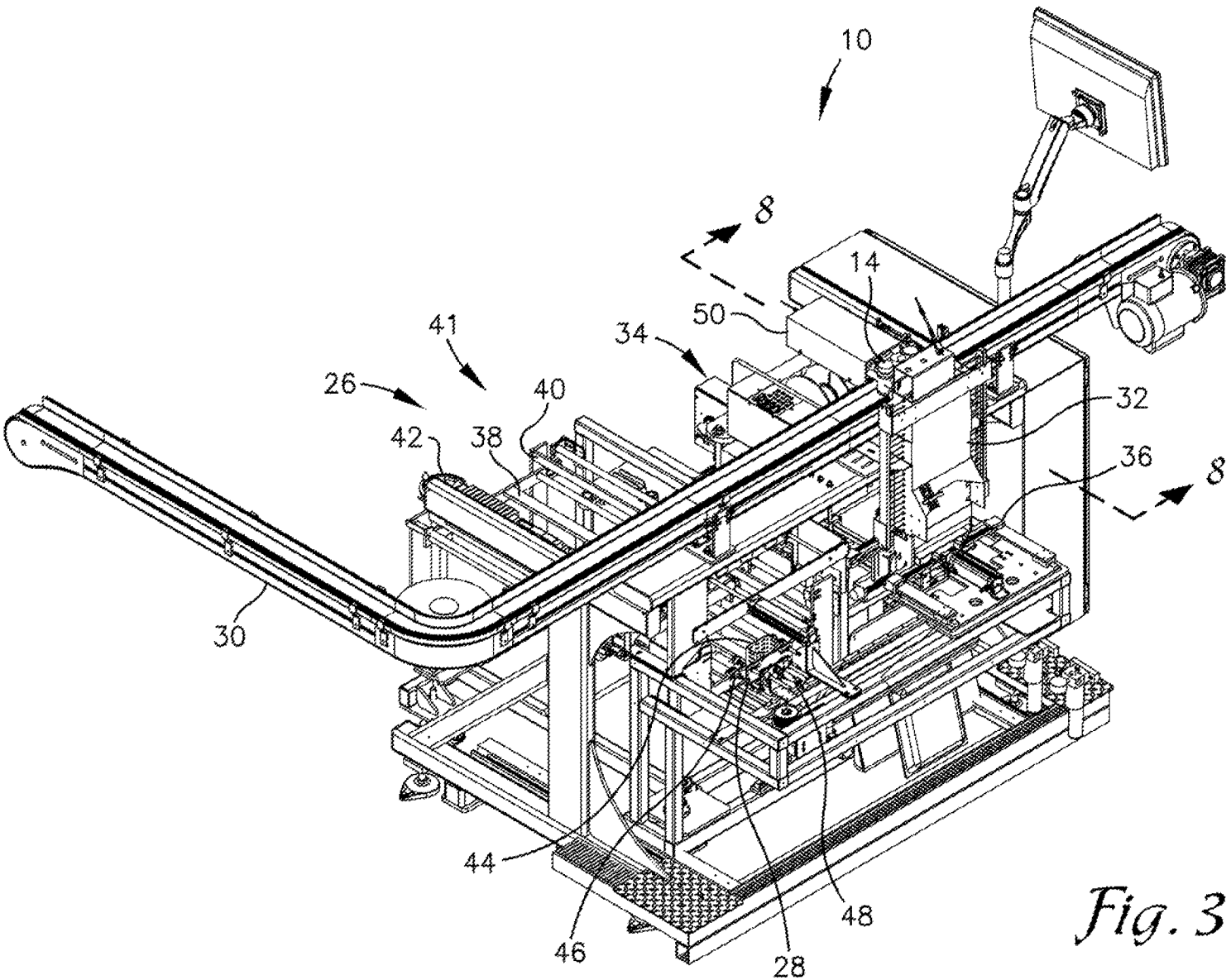
FIG. 3 is a perspective view of the poly bubble-bag filling machine of FIG. 1 with the document printing apparatus and the takeaway conveyance system removed depicted in accordance with an exemplary embodiment.

With reference to FIGS. 1-8, a poly bubble-bag filling machine 10 is described in accordance with an exemplary embodiment. The filling machine 10 is configured to receive a supply of pre-formed poly bubble-bags 12 (FIG. 10) and a supply of products 14 to be disposed in the bags 12, verify and place the products 14 into the bags 12, seal the bags 12, and pass the bags 12 on for further processing. As depicted in FIGS. 1 and 2, the poly bubble-bag filling machine 10 may include an insert-preparation unit 16 that prepares and/or inserts documents into the bags 12, and a takeaway system 18 that receives the filled and sealed bags 12 and transports them on for further processing or handling.

The insert-preparation unit 16 may comprise a plurality of printing stations 20 that are configured to print paper documents associated with the products 14. The printing stations 20 are preferably communicably coupled with a server or other computing device that provides and instructs printing of information associated with particular ones of the products 14 with which the documents are to be packaged within a given bag 12. For example, the products 14 may comprise pharmaceutical products and the documents may thus comprise order information documents, any required documentation associated with the pharmaceuticals and their use, and/or any other desired documentation. Although, the products 14 are shown and described herein as comprising pharmaceutical bottles, such is not intended to limit application of exemplary embodiments to such products or industries.

The insert-preparation unit 16 further includes a preparation and insertion station 22 at which the documents may be prepared for insertion by, for example, folding one or more times and positioning for insertion into a respective bag 12. The station 22 further includes apparatus and is positioned to insert the prepared documentation into the respective bag 12 prior to or after placement of the product or products 14 into the bag 12. One exemplary insert-preparation unit 16 known in the art may include that employed by the bottle packaging machine (BPM) for pharmacies from Tension Packaging and Automation of Kansas City, Missouri.

The takeaway system 18 comprises one or more conveyors 24 configured to receive filled and sealed bags 12 and to transport the bags 12 to other stations or locations for further processing including further packaging, mailing, shipping, or the like. In some embodiments, the takeaway system 18 may simply comprise a container (not shown) positioned to catch the bags 12 following filling and sealing thereof.

The machine 10 is described herein with respect to use and filling of polyethylene bubble-bags which are well known in the art, however such is not intended to limit the types of bags 12 that may be used/filled by the machine 10. For example, bags formed from single- or multi-ply sheet with or without bubble pockets therein may be employed. Further, the bags may be comprised of a polyethylene material and/or from a variety of similar materials including for example, polypropylene, vinyl, nylon, paper, foils, or other similar materials.

The filling machine 10 comprises a poly-bubble bag magazine 26, a bag-transfer carriage 28, a product-induction conveyor 30, a filling chute 32, a labeling device 34, and a seal head 36.

Figure 4:
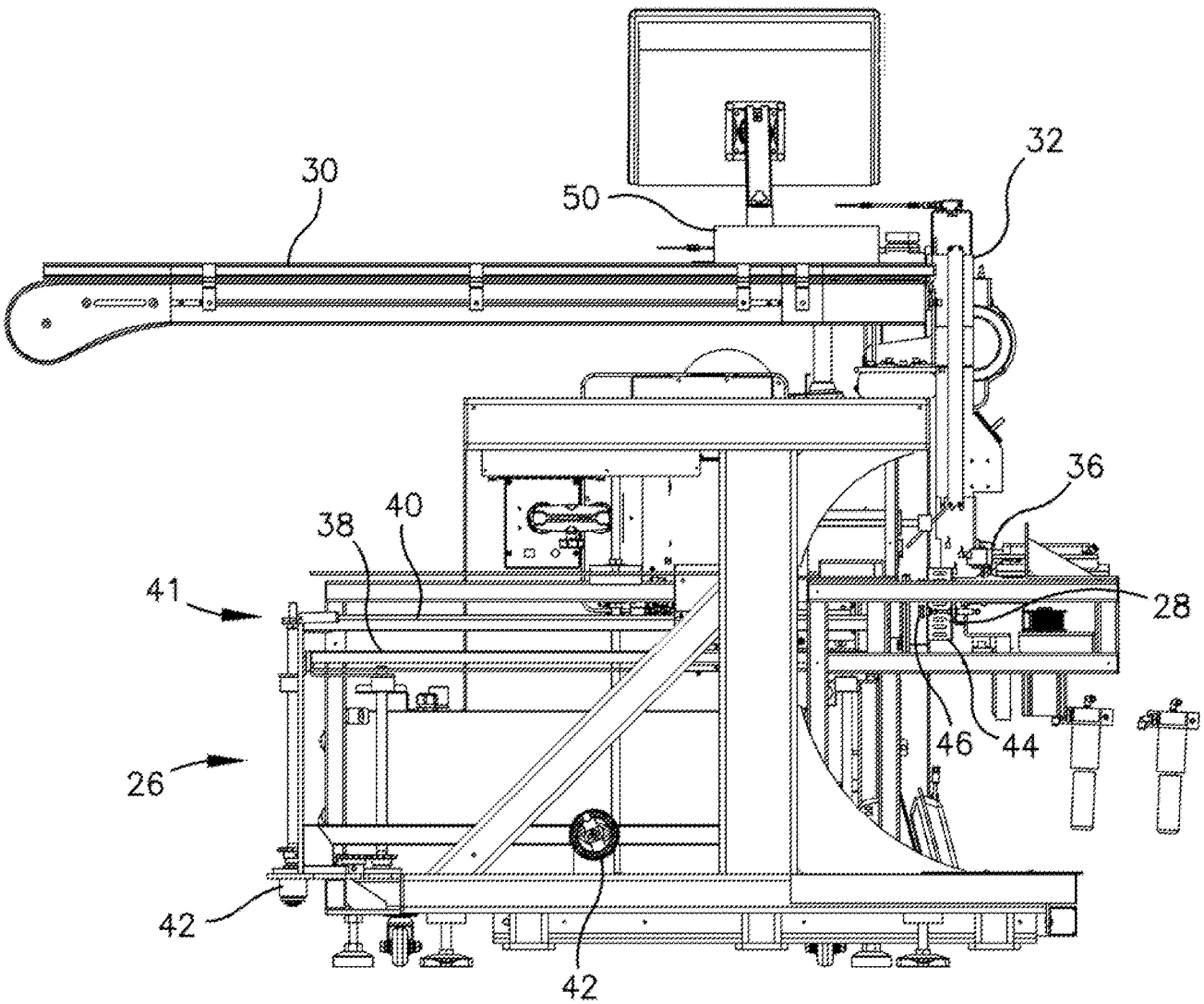
FIG. 4 is a first end elevational view of the poly bubble-bag filling machine of FIG. 3.
Figure 5:
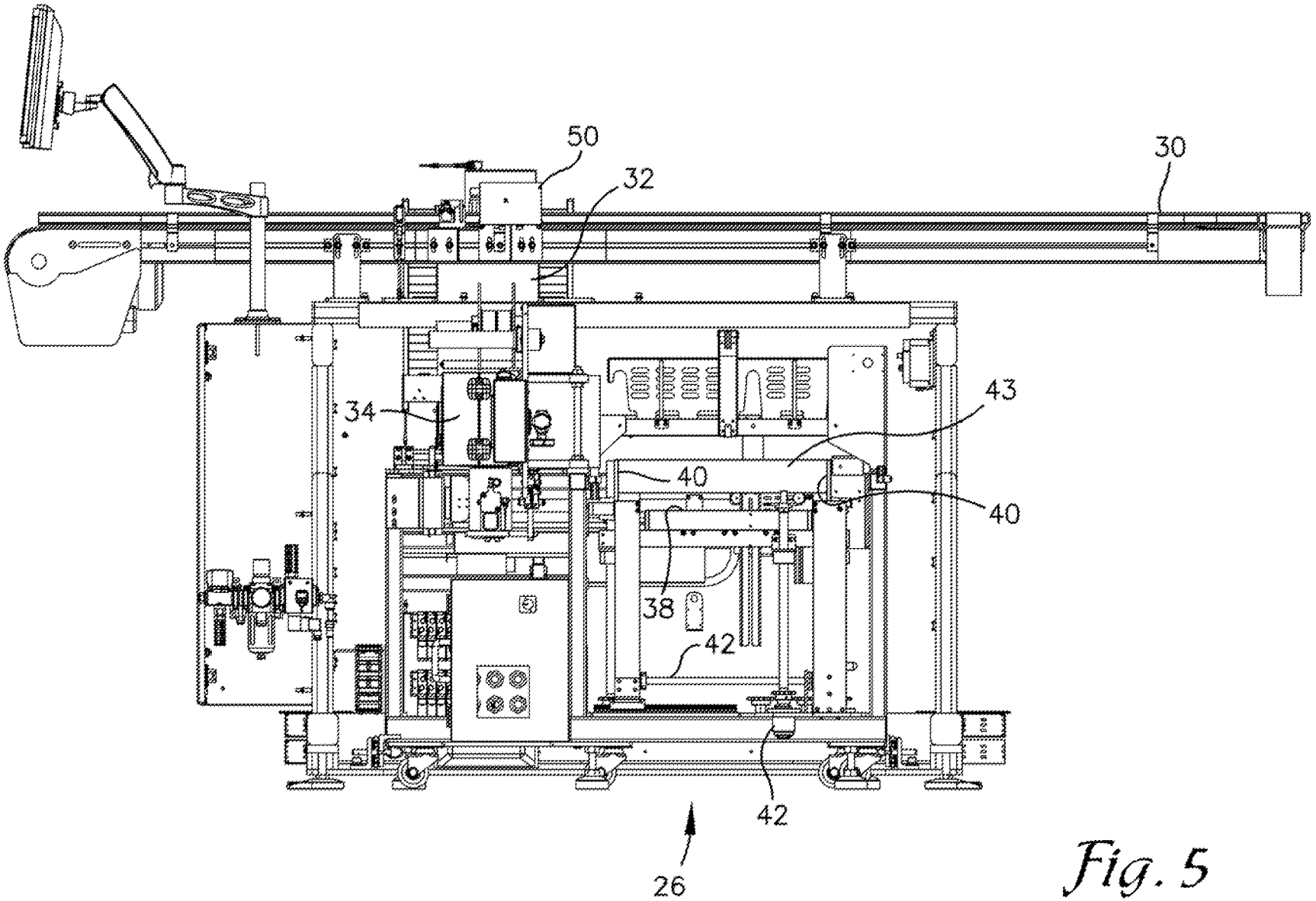
FIG. 5 is a front side elevational view of the poly bubble-bag filling machine of FIG. 3.
Figure 6:
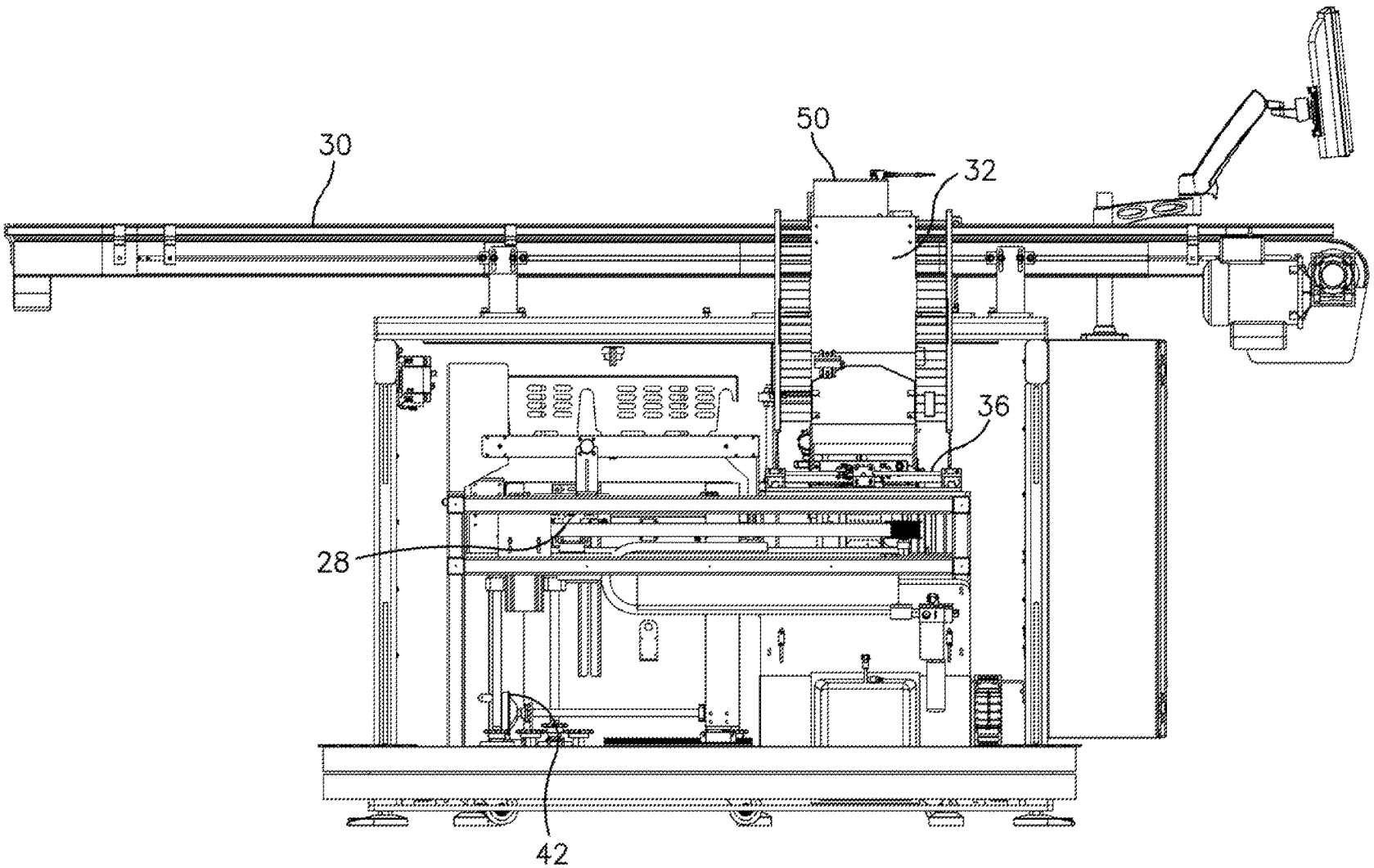
FIG. 6 is an opposite second end elevational view of the poly bubble-bag filling machine of FIG. 3.
Figure 7:
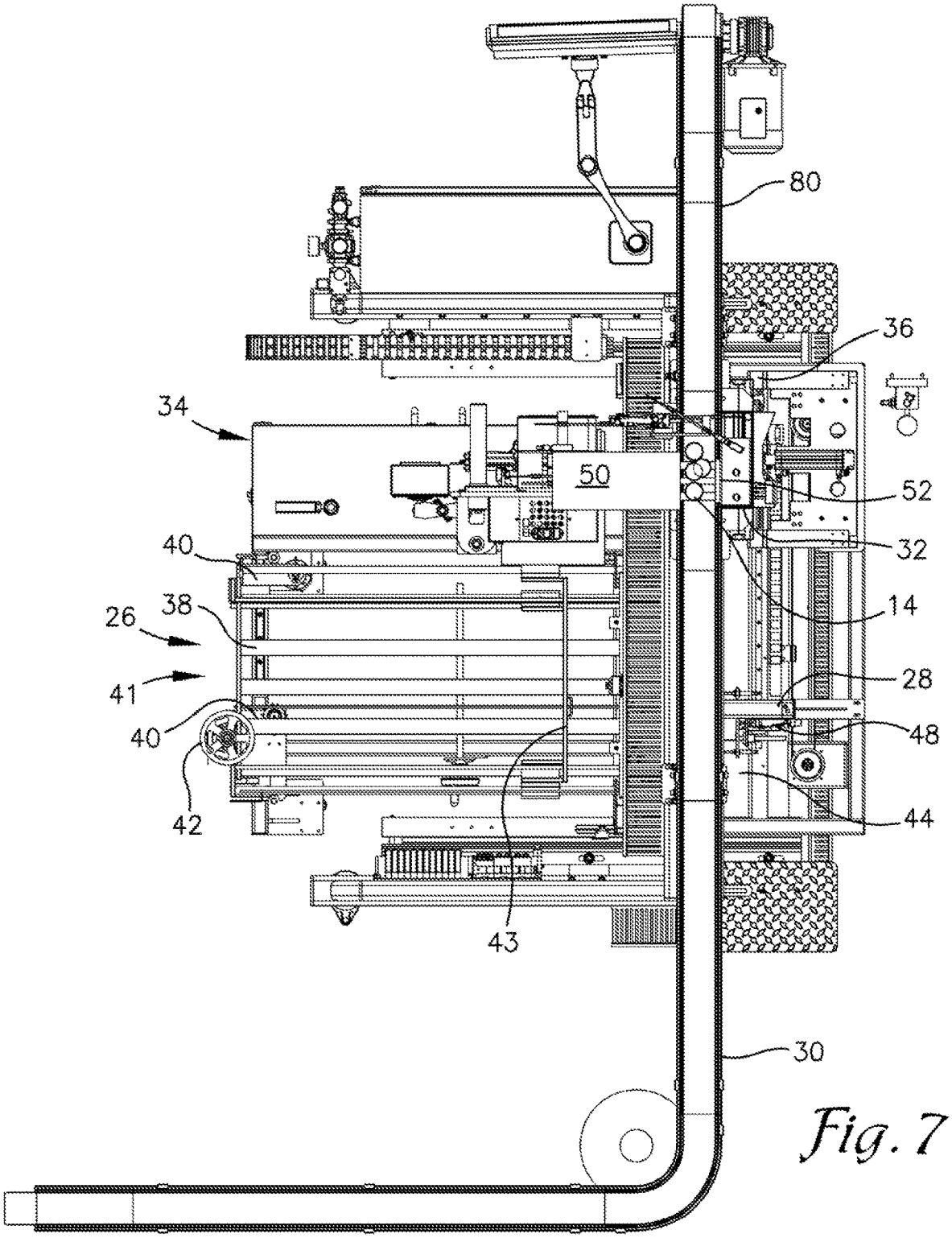
FIG. 7 is a top plan view of the poly bubble-bag filling machine of FIG. 3.

The magazine 26 is configured to receive a plurality of pre-formed poly bubble-bags 12 that are placed in a horizontally oriented stack in which each of the bags 12 is typically oriented vertically with the opening thereof directed upwardly. In one embodiment, the stack may comprise about 180 pre-formed poly bubble-bags 12. The magazine 26 includes a base 38 and one or more side guide bars 40 that form a channel 41 in which the stack of bags 12 is disposed. The base 38 and guide bars 40 may be adjustable to enable use of a bags 12 of various dimensions. As best depicted in FIGS. 4 and 7, a rack-and-pinion mechanism 42 is associated with the base 38 and one or both of the side guide bars 40 to enable positional adjustments thereof. It is understood that other mechanisms may be employed for such adjustments, including for example electronic motors, actuators, or the like without departing from the scope described herein.

The magazine 26 may include a pusher 43 or similar element configured to apply a force to a distal end of the stack of bags 12. The pusher 43 may be driven or biased toward the proximate end of the channel and the bag-transfer carriage 28 by one or more servo motors, actuators, springs, struts, or the like. The pusher 43 may maintain the stack of bags 12 within the channel and aid to move the bags 12 toward the bag-transfer carriage 28 as they are successively removed from the stack. The opposite proximate end of the magazine 26 may include one or more stops or fingers that aid to maintain a leading bag 12 within the magazine 26 until removed therefrom by the bag-transfer carriage 28.

The bag-transfer carriage 28 is disposed near the proximate end of the magazine 26 and is configured to withdraw one bag 12 at a time from the magazine 26 and move the bag 12 laterally away from the magazine 26 where the bag 12 may be handed off to the seal head 36. As depicted in FIGS. 3-8, the carriage 28 is driven side-to-side by a belt-driven means, however other configurations may be employed.

The carriage 28 includes an extendable tool 44 with a plurality of suction cups 46 coupled thereto and directed to extend toward a proximate-most bag 12 disposed in the magazine 26. An actuator 48 is coupled to the tool 44 to move the tool 44 and thus the suction cups 46 toward and into contact with the proximate-most bag 12. The suction cups 46 are coupled with a pneumatic system that supplies sufficient vacuum for pickup of the bag 12 by the suction cups 46. Upon achieving sufficient vacuum, the actuator 48 can be actuated to withdraw the tool 44 and thereby remove the bag 12 from the magazine 26.

The product-induction conveyor 30 comprises a conveyor belt system. The conveyor 30 is preferably sized or configured to provide the products 14 in a generally single file arrangement and in some embodiments may stage or space apart individual ones or groups of the products 14 to aid operation of the filling machine 10. In other embodiments, the conveyor 30 may comprise any product transport apparatus including linear synchronous motors or actuators that may employ a magnetic induction system, robotics, or the like that can transport the products to be bagged to the filling chute. In another embodiment, one or more human operators are employed to directly, manually induct products 14 into the machine 10. The conveyor 30 is configured to transport the products 14 to a verification and filling station 50 positioned near or alongside an entry end of the filling chute 32.

The verification and filling station 50 includes one or more sensors, detectors, or scanners (not shown) that read indicia on the products 14 and that are useable to identify the products 14. A plurality of sensors may be provided to enable reading the product indicia independent of the product's orientation on the conveyor 30. The indicia may be supplied to a controller that is communicably coupled with the machine 10 and may be cross-referenced with orders, manifests, or the like to ensure the correct products 14 are present and/or grouped together for placement into a particular bag 12.

Figure 8:
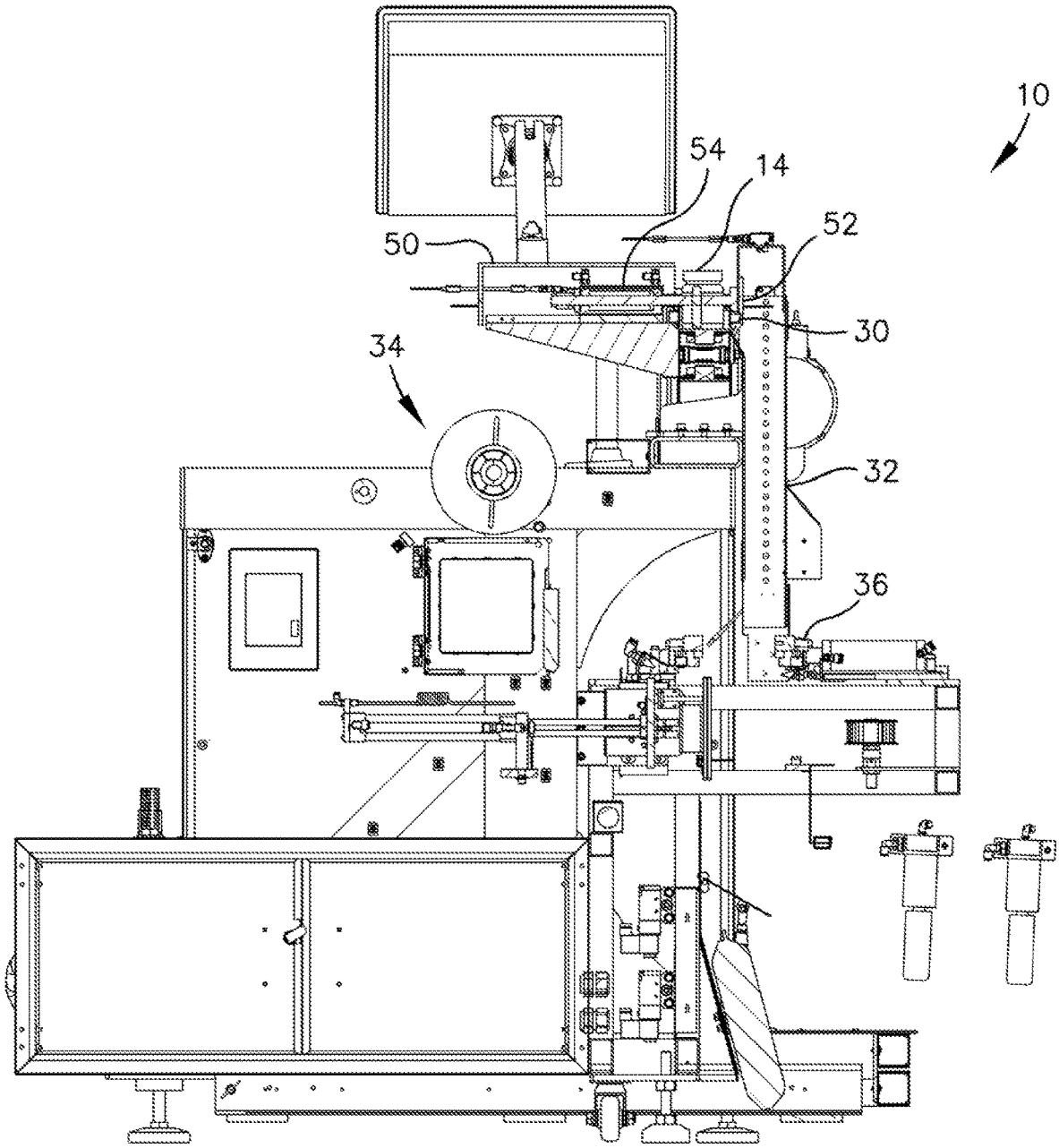
FIG. 8 is a cross-sectional view of the poly bubble-bag filling machine of FIG. 3 taken along the line 8-8.

The station 50 further includes a pusher 52 that is extendable from alongside a first side of the conveyor 30 toward and across the width of the conveyor 30 to move the products 14 into the filling chute 32. The pusher 52 comprises a plate mounted to an end of an actuator 54 but other configurations may be employed. (It is noted that the pusher 52 is depicted in FIGS. 7 and 8 in an extended position extending through products 14 positioned on the conveyor 30, however this representation is an artifact of the drawing software used and is not accurate—the pusher 52 does not, in reality, extend through the products 14.)

The filling chute 32 directs the products from the product-induction conveyor 30 into a bag 12 positioned therebelow via gravity. The mouth or opening of the chute 32 may be dimensioned similarly or just larger than the pusher 52 such that only products 14 pushed by the pusher 52 may enter the chute 32. The filling chute 32 may include a variety of sensors configured to detect the presence of the products 14 at the mouth of the chute 32 and/or within the chute, and/or presence of a bag 12 beneath the chute 32.

The labeling device 34 is configured to apply identifying information on each of the bags 12. In one embodiment, the labeling device 34 comprises one of a variety of printing devices provided by Panther Industries, Inc. of Highlands Ranch, Colorado The information may be printed directly onto the bags 12 or onto a label that is applied to the bag 12. Such information may include, for example, identifying indicia for the product or products disposed in the bag, customer information, or the like. As depicted in FIGS. 1-8, the labeling device 34 is configured to print the information onto a label which is then applied to a bag 12 while the bag 12 is held at the bottom end of the filling chute 32 and prior to opening or filling of the bag 12. It is understood that a variety of other configurations of the labeling device 34 may be employed including various positions of the labeling device 34 and timing of application of the label to the bag 12 within the sequence of the machine 10 without departing from the scope of embodiments described herein.

Figure 9:
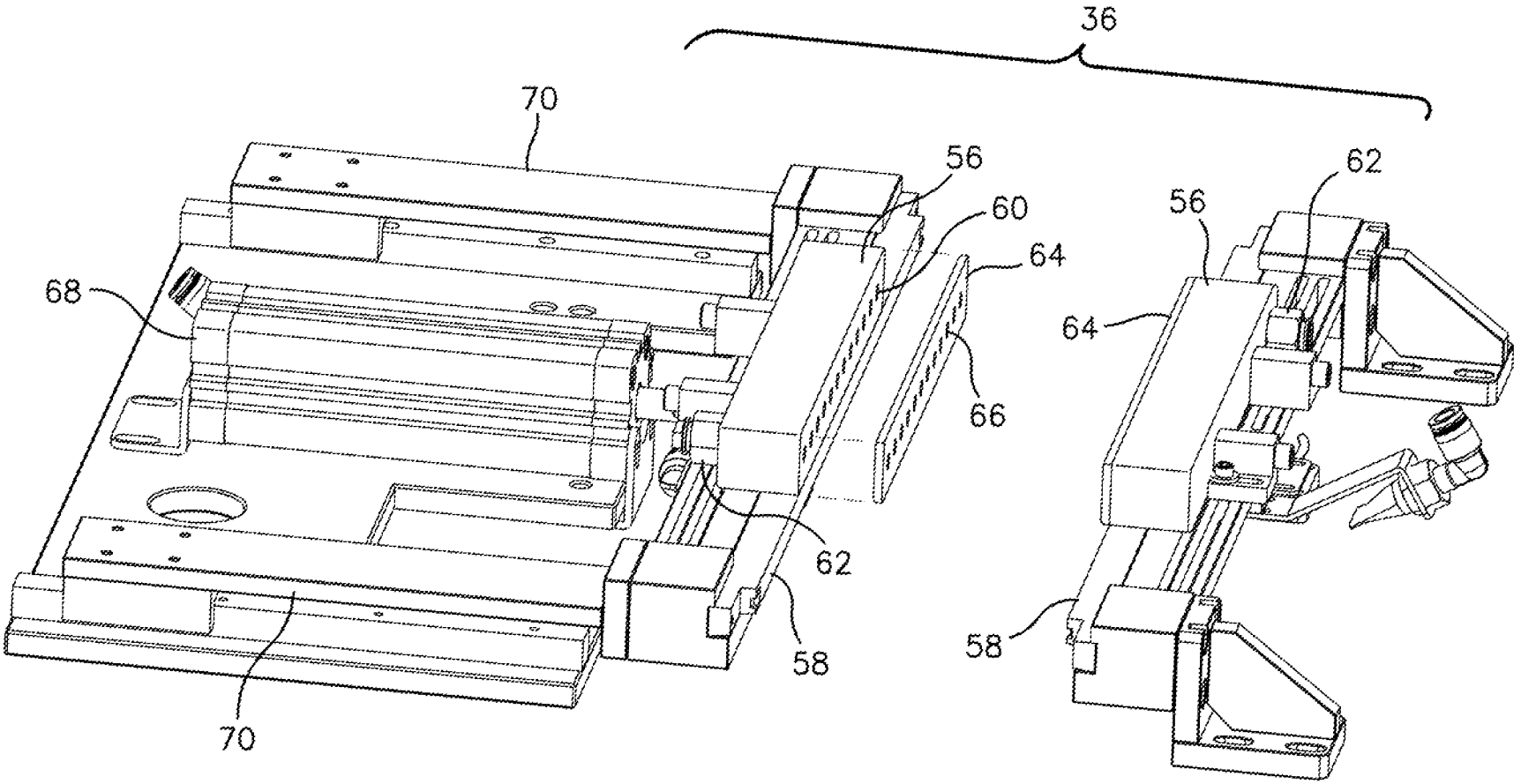
FIG. 9 is a perspective view of a seal head for a poly bubble-bag filling machine depicted in accordance with an exemplary embodiment.
Figure 10:
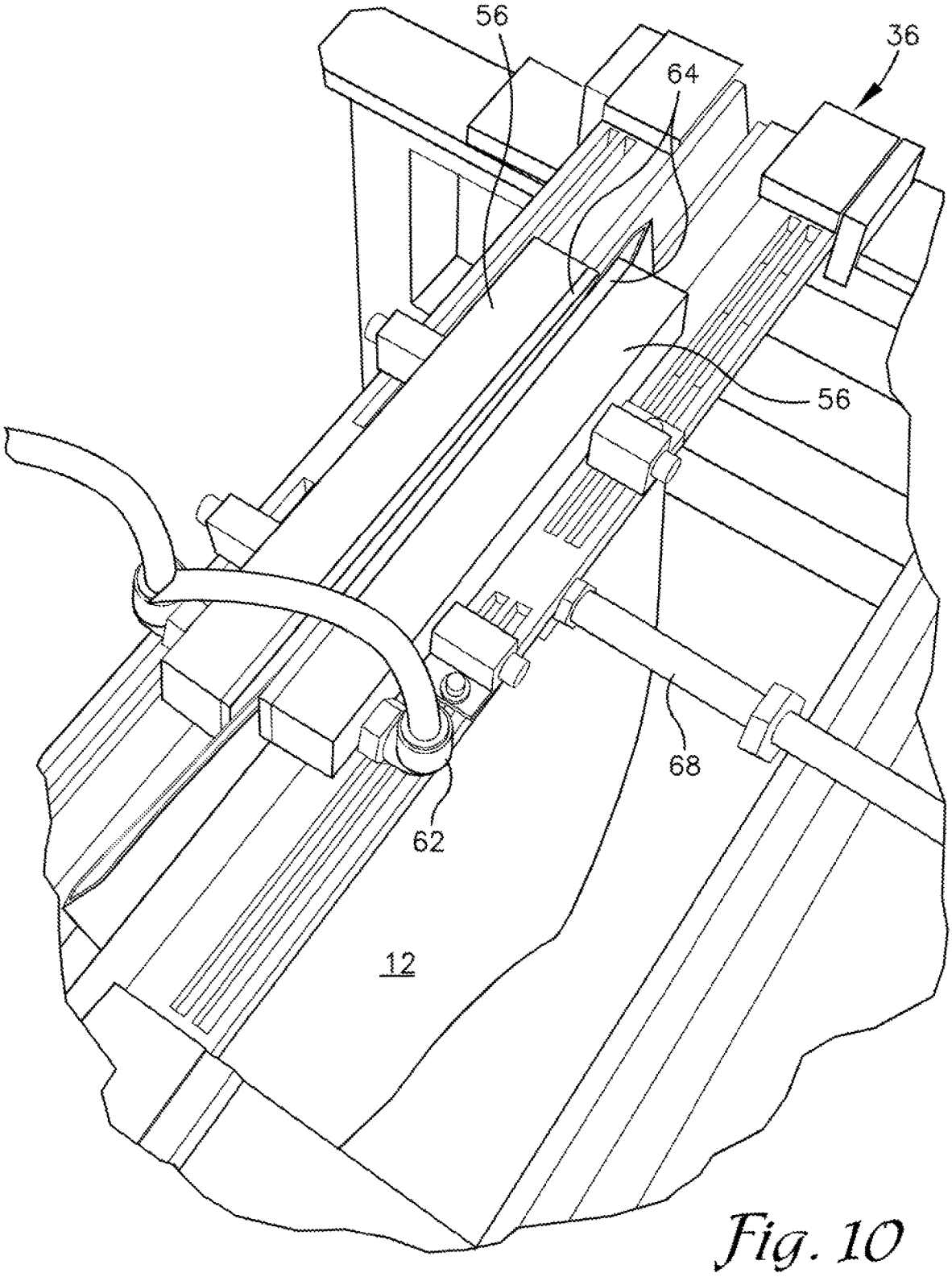
FIG. 10 is a pictorial view of the seal head of FIG. 9 depicted in a closed position and holding a poly bubble-bag in accordance with an exemplary embodiment.
Figure 11:
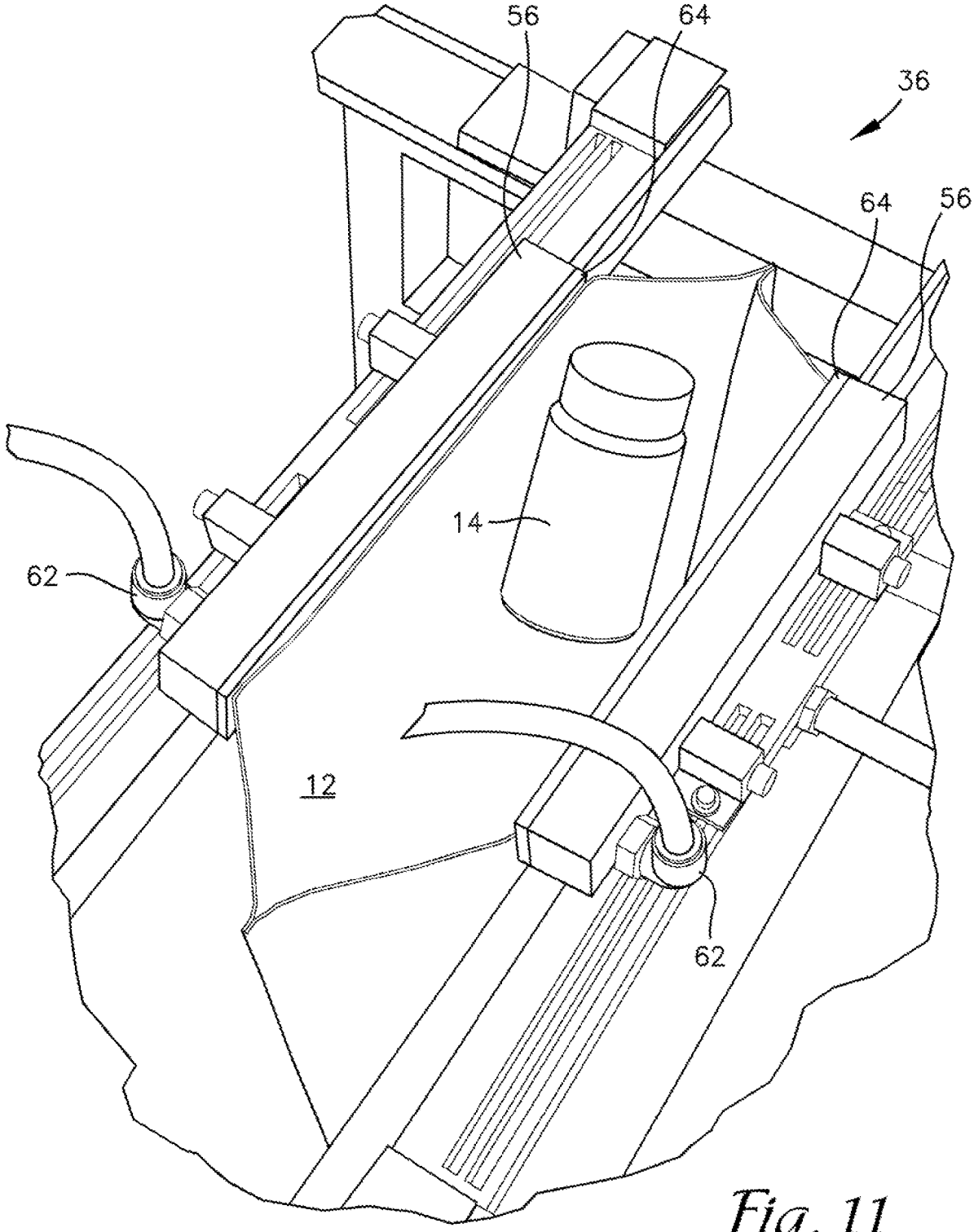
FIG. 11 is a pictorial view of the seal head of FIG. 9 depicted in an open position holding a poly bubble-bag and receiving a product therein in accordance with an exemplary embodiment.

With additional reference now to FIGS. 9-11, the bag seal head 36 is described in accordance with an exemplary embodiment. The bag seal head 36 is configured to receive a poly bubble-bag 12 from the bag-transfer carriage 28, open and hold the bag 12 for filling, and close and seal the bag 12 following filling. The seal head 36 includes a pair of opposingly oriented suction bars 56 and a pair of opposingly oriented seal bars 58 or heat bars.

Each of the suction bars 56 comprises an elongate member, such as an aluminum or steel block having a vacuum manifold formed therein. The suction bars 56 have a longitudinal dimension extending parallel to the width of a bag 12 to be held thereby. The longitudinal dimension is generally shorter than the width of the bag 12 and may be tailored to a particular bag size or more preferably configured to accommodate a variety of bag sizes.

In one embodiment, the vacuum manifold is formed from a longitudinal bore extending at least partially through the suction bar 56 along a long axis and a plurality of transverse bores 60 in a front face thereof that intersect the longitudinal bore within the body of the bar 56; the front faces of the two suction bar 56 are directed toward one another so as to contact opposing sides of a bag 12 to be held thereby. A port that communicably connects with the manifold is provided with a coupling 62 for coupling to a vacuum system.

The suction bars 56 preferably include a foam pad 64 removably or fixedly disposed on their front faces. The foam pad 64 has substantially the same dimensions as the front face and includes a plurality of apertures 66 positioned to align with the transverse bores 60 in the suction blocks 56 to allow application of a vacuum or suction force therethrough. The foam pad 64 is sufficiently pliable to seal against the exterior surface of the bag 12 and any contours or surface feature thereon to enable a sufficient suction force for holding the bag 12 during filling. The foam pad 64 also provides a sufficient friction or tackiness on a face thereof that contacts the bag 12 to resist sliding of the bag 12 along the face of the pad 64 while being held and when product is dropped into the bag 12. In one embodiment, the foam pad 64 may comprise EASYFOAM from Joulin Vacuum Handling of Hickory, North Carolina or similar materials. In another embodiment, one or more suction cups are coupled to the suction bars 56.

In some embodiments, each of the suction bars 56 may incorporate a valve check system that is configured to close off one or more of the apertures 66 or transverse bores 60 when vacuum is lost or not achieved. As such, loss or failure to achieve vacuum through one of the apertures 66 does not hinder obtaining vacuum at any of the remaining apertures 66. Such a system may be similar to the Valve Gripper, Port Gripper, and/or Foam Valve systems disclosed by Joulin Vacuum Handling.

One or both of the suction bars 56 is coupled to an actuator 68 to enable movement thereof toward one another to contact side faces of a bag 12 held therebetween by the bag-transfer carriage 28. As depicted in FIG. 9, only one of the suction bars 56 is moveable while the other suction bar 56 is statically mounted however other configurations may be employed. One or more guide rails 70 or similar components may be provided to guide or aid movement of the suction bars 56 by the actuator 68.

As depicted in FIG. 9, the seal bars 58 are positioned beneath the suction bars 56 with a front face thereof positioned generally even with or in generally the same plane as the front face of the respective suction bar 56. The seal bars 58 are jointly coupled with the suction bars 56 to the actuator 54 so as to be moveable with the suction bars 56 by the actuator 54. As such, when moved toward one another the front faces of the seal bars 58 operatively contact and sufficiently press together sides of the bag 12 to enable sealing thereof by the seal bars 58. The seal bars 58 are dimensioned to extend a distance substantially equal to or greater than the width of the bag 12. In one embodiment, the seal bars 58 are disposed above the suction bars 58. In another embodiment, only a single seal bar 58 is employed and/or only one of the seal bars 58 includes a heating element.

An impulse heating element, such as a highly resistive wire is provided on the front face of one or both of the seal bars 58 and coupled with a source of electrical current. As such, when energized, the impulse element quickly heats up and applies sufficient heat to the bag 12 to at least partially melt or fuse the opposing sides of the bag 12 together and thus seal the bag 12. When de-energized, the impulse element quickly cools so as not to prematurely heat or melt a next bag 12 that is held by the seal head 36. A TEFLON or similar coating, film, tape, or the like may be provided on the front face of the seal bar 58 to cover the wire or other heating element and to prevent sticking of the bag 12 to the impulse heating element. Inductive heating elements or hot plates among other heating technologies may also be employed.

In another embodiment, one or both of the seal bars 58 are coupled with a second actuator and are moveable by the second actuator independent of the suction bars 56. One or both of the seal bars 58 may thus be independently moved into contact with the bag 12 when sealing of the bag 12 is desired. This configuration may enable use of heating elements on the seal bar 58 that are retained in a heated state, such as a heated platen instead of or in addition to the on-demand heated impulse element. Such elements may otherwise cause melting or damage to the bag 12 during filling and handling prior to sealing if allowed to contact the bag 12. Such a configuration may also increase safety of the seal head 36 by enabling the seal bars 58, when in a retracted position, to be positioned further apart or recessed away from one another relative to the suction bars 56. In such a position, a likelihood of contact between an operator's hand, a product 14, or a bag 12 with high-temperature heating elements is reduced.

In another embodiment depicted in FIGS. 12-21, a seal head 136 includes a spring-biased carrier 72 provided between the actuator 68 and the suction bar 56. As depicted in FIGS. 12-21, both suction bars 56 are extendable toward one another via respective actuators 68, but in other embodiments, one of the suction bars might be statically mounted to a frame of the machine 10 like that of the seal head 36 depicted in FIG. 9. The spring biased carrier 72 includes a pair of support rods 74 coupled with the suction bar 56 and a fixture 76 through which the support rods 74 are slidably moveable such that the suction bar 56 can move toward and away from the fixture 76 in a direction parallel to the length of the support rods 74. A coil spring (not shown for clarity) is disposed to bias the suction bar 56 away from the fixture 76 while enlarged ends or stops disposed on ends of the support rods 74 prevent disengagement of the support rods 74 from the fixture 76. In one embodiment, the coil springs are disposed coaxially around one or both of the support rods 74 or they may be provided as a separate component.

The fixtures 76 and the suction bars 56 are moveable via the actuators 68 toward one another and independent of the seal bars 58. The seal bars 58 are each coupled to respective seal-bar actuators 82 which are extendable to move the seal bars 58 toward one another to selectively place the seal bars 58 into operable contact with the bag 12.

Figure 21:
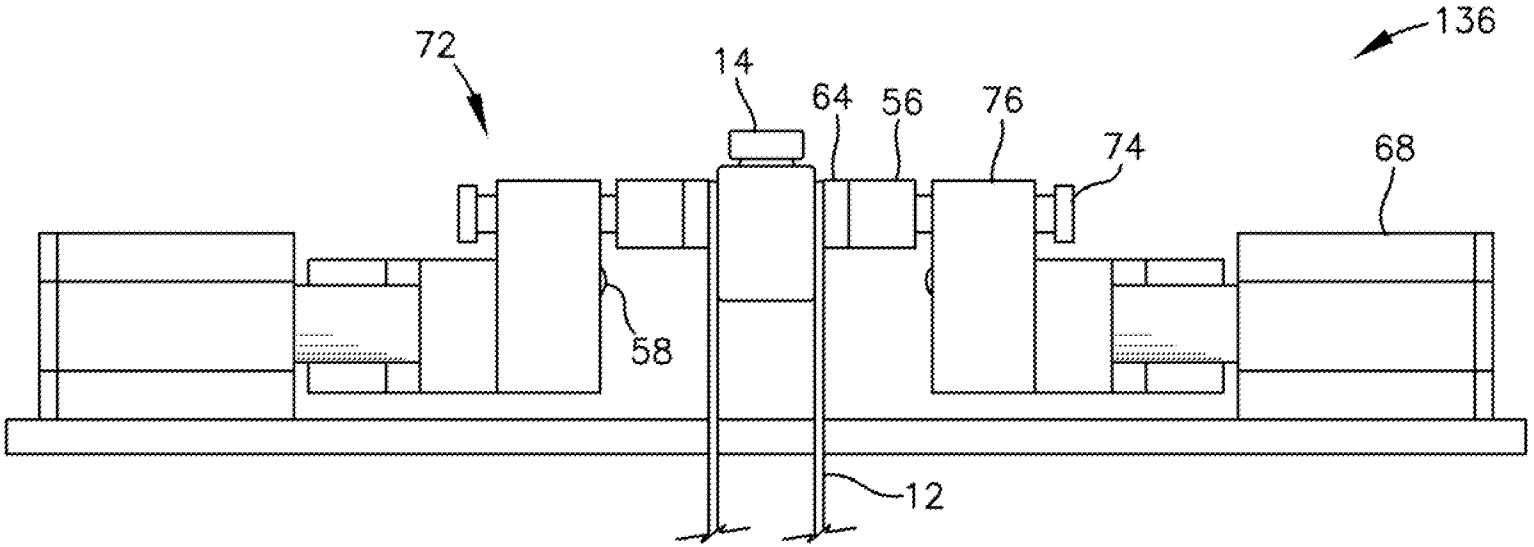
FIG. 21 is a side elevational view of the seal head of FIG. 12 with a product bottle caught between the suction bars which are at least partially extended depicted in accordance with an exemplary embodiment.

FIG. 21 depicts an instance in which a product 14 is trapped, caught, or captured between the suction bars 56 as they are brought together. The product 14 might also comprise any item or even a portion of an operator's body that is caught between the suction bars 56. Contact with such a product 14 or other item as the actuators 68 are extending at least partially compresses the coil springs of the spring-biased carrier 72 and decreases a distance between one or both of the suction bars 56 and the associated fixture 76.

One or more sensors (not shown) may be provided in association with the seal head 136 and/or 36 to detect the position of the suction bars 56 relative to the associated fixture 76 and to detect the decrease in distance therebetween. Such sensors may thus aid detection of the product 14 or other items positioned between the suction bars 56 before or during movement of the suction bars 56 toward one another. For example, an operator's hand or a product 14 that is positioned between the suction bars 56 may be detected before the suction bars 56 are brought fully together. Upon such an occurrence, the operation of the machine 10 may be halted or other preventative actions taken until the fault is safely cleared.

Use of the spring-biased carrier 72 may also enable use of continuously heated seal bars 58 without the need for a second actuator to provide for independent movement of the seal bars 58. The spring bias of the carrier 72 operates to extend the suction bars 56 toward one another and away from the planes of the seal bars 58. As such, a bag 12 may be contacted by the suction bars 56 in their extended, biased position without the seal bars 58 contacting the bag 12. Following filling of the bag 12, the actuator 68 may be further actuated to compress the spring-biased carrier 72 springs and bring the seal bars 58 generally into planar alignment with the suction bars 56 and into contact with the bag 12 to allow sealing thereof.

With continued reference to FIGS. 1-11, operation of the poly bubble-bag filling machine 10 is described in accordance with an exemplary embodiment. A stack comprising a plurality of poly bubble-bags 12 is installed in the magazine 26. The base 38 and the side guide bars 40 of the magazine 26 may be adjusted via the rack-and-pinion mechanism 42 as needed to accommodate the dimensions of the bags 12 to be used.

The bag-transfer carriage 28 is moved into position at the proximate end of the magazine 26. The carriage 28 is extended via the actuator 48 to bring the suction cups 46 into contact with the proximate-most bag 12 in the stack and a vacuum is applied to the suction cups 46 to grip the bag 12. The actuator 48 is retracted to withdraw the carriage 28 and remove the bag 12 from the magazine 26. The bag-transfer carriage 28 is moved laterally away from the magazine 26 and to a position beneath the filling chute 32.

Products 14 are picked from one or more storage locations and disposed onto the product-induction conveyor 30 by a variety of means which are beyond the scope of this description and not described further herein. The products 14 are preferably sorted and staged with respect to orders or packaging requirements so as to be properly ordered for bagging on the conveyor 30.

The products 14 are moved by the conveyor 30 to the verification and filling station 50. Sensors or readers at the station 50 scan and read identifying information, such as bar codes, QR codes, radio-frequency identification chips, or the like on the products 14 and determine that the appropriate products 14 are staged at the station 50. Alternatively, a reverse process in which an order requiring the products 14 staged at the station 50 may be identified. Upon verification of the products 14 or identification of an associated order, a label including any association information is printed by the labeling device 34. Where it is determined that the incorrect product 14 is staged at the station 50, the incorrect product(s) 14 may be directed to a runout 80 for subsequent handling by an operator.

The label may be applied to the bag 12 while the bag-transfer carriage 28 retains possession of the bag 12, while both the bag-transfer carriage 28 and the seal head 36 hold the bag 12, or after possession of the bag 12 is passed to the seal head 36. The label is preferably applied prior to filling of the bag 12 so as to provide an even surface against which to press the label but may be applied after filling. Alternatively, the label may be printed directly onto the surface the bag 12.

Identification of the products 14 and/or an associated order may also prompt preparation of documentation to be packaged with the products 14 by the insert-preparation unit 16. One or more documents may be printed and prepared by folding and moving to the preparation and insertion station 22 to await insertion into the associated bag 12.

Returning to the bag 12 which is held by the bag-transfer carriage 28 beneath the filling chute 32, in this position a top portion of the bag 12 is disposed between the suction bars 56 of the seal head 36. The actuator 68 is actuated to move the front faces of the suction bars 56, or the foam pads 64 thereon into contact with side faces of the bag 12. A vacuum is applied across the suction bars 56 to engage the bag 12 via suction. Upon achieving a proper engagement between the suction bars 56 and the bag 12, the suction cups 46 of the bag-transfer carriage 28 release the bag 12 and the carriage 28 returns to the original position at the proximate end of the magazine 26 for pickup of a next bag 12.

The suction bars 56 are withdrawn via retraction of the actuator 68 to open the bag 12 for filling. Opening and supporting the bag 12 are thus competed without need for additional mechanical gripping or opening means such as fingers or other appendages that might be inserted into the opening of the bag and without need for a supporting surface beneath the bag 12. The open bag 12 is held beneath the filling chute 32 by the suction bars 56 to await receipt of the products 14.

At the verification and filling station 50, the pusher 52 is actuated to push the product or products 14 from the conveyor 30 and into the filling chute 32 which directs the products 14 into the awaiting open bag 12 positioned therebelow. One or more sensors may be employed to detect the presence of objects within the filling chute 32 prior to and/or following movement of the products 14 into the chute 32. This may aid to prevent or identify clogs or hang-ups in the filling chute 32. The suction bars 56 provide sufficient suction force and grip on the bag 12 to accept impacts from the products 14 falling through the filling chute 32 and into the bag 12 by gravity. Any desired documentation prepared by the insert-preparation unit 16 may be inserted into the open bag 12 prior to, coincident with, or following filling of the bag 12 with the products 14.

In the embodiment depicted in FIG. 9, following filling of the bag 12, the actuator 68 is extended to bring the opposing suction bars 56 and the opposing seal bars 58 toward one another and to bring opposing sides of the bag 12 together. The foam pads 64 may be at least partially compressed to enable the seal bars 58 to move into sufficiently close proximity. The heating element on the face of one or both of the seal bars 58 is energized to apply a sufficient quantity of heat to the bag 12 to fuse, melt, or otherwise seal across the open end of the bag 12. Upon achieving a sufficient seal on the bag 12, the heating element is de-energized. The actuator 68 can then be withdrawn and the vacuum on the suction bars 56 relieved to allow the filled, sealed, and labeled bag 12 to fall to the conveyor 24 of the takeaway system 18 for further handling.

Figure 12:
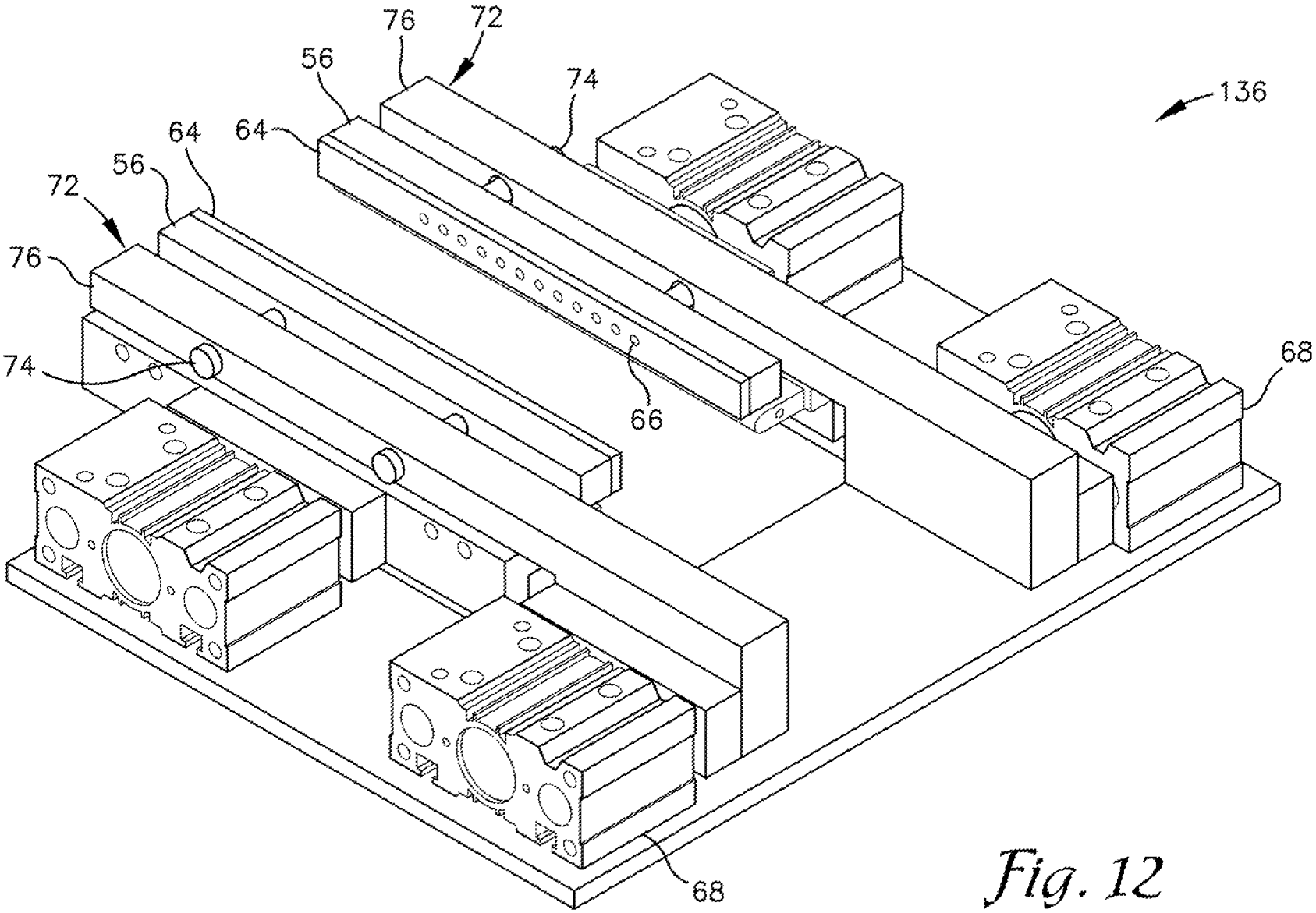
FIG. 12 is a perspective view of another seal head for a poly bubble-bag filling machine depicted in accordance with another exemplary embodiment.
Figure 13:
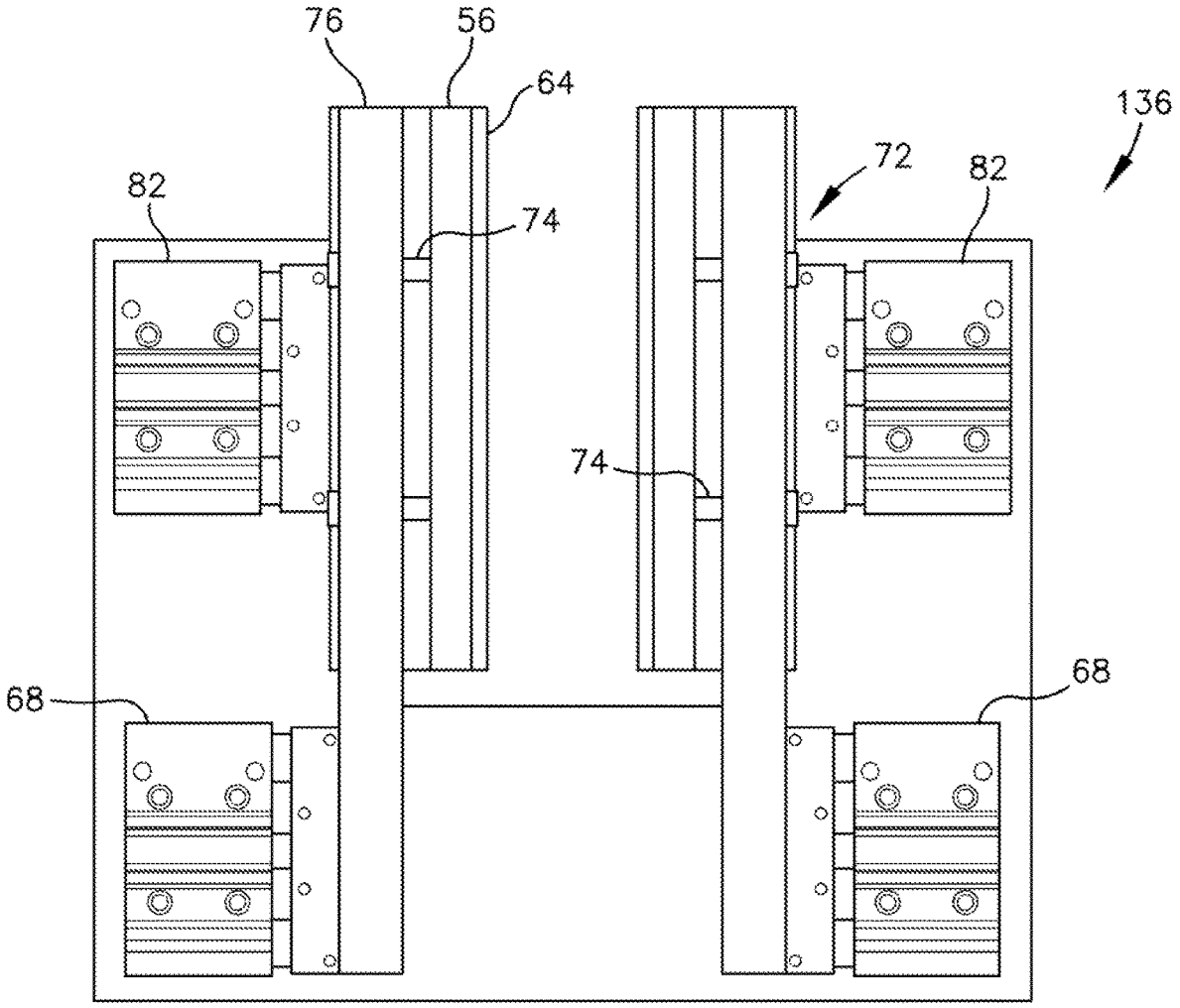
FIG. 13 is a top plan view of the seal head of FIG. 12.
Figure 14:
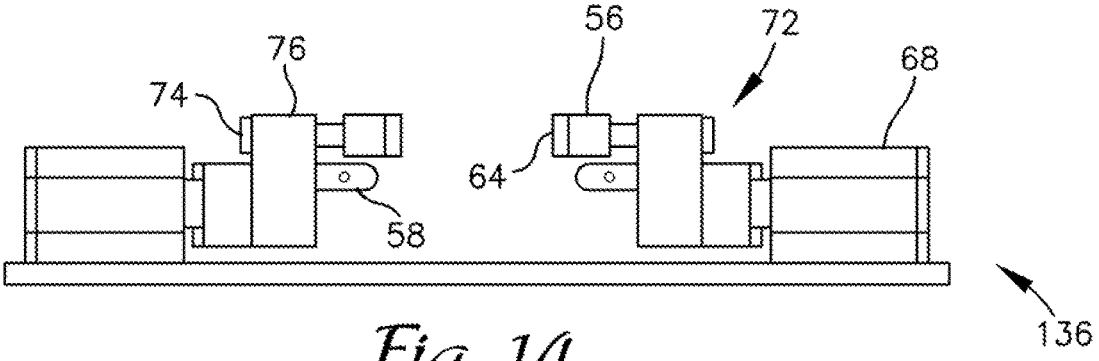
FIG. 14. is a side elevational view of the seal head of FIG. 12 depicted in a ready state.
Figure 15:
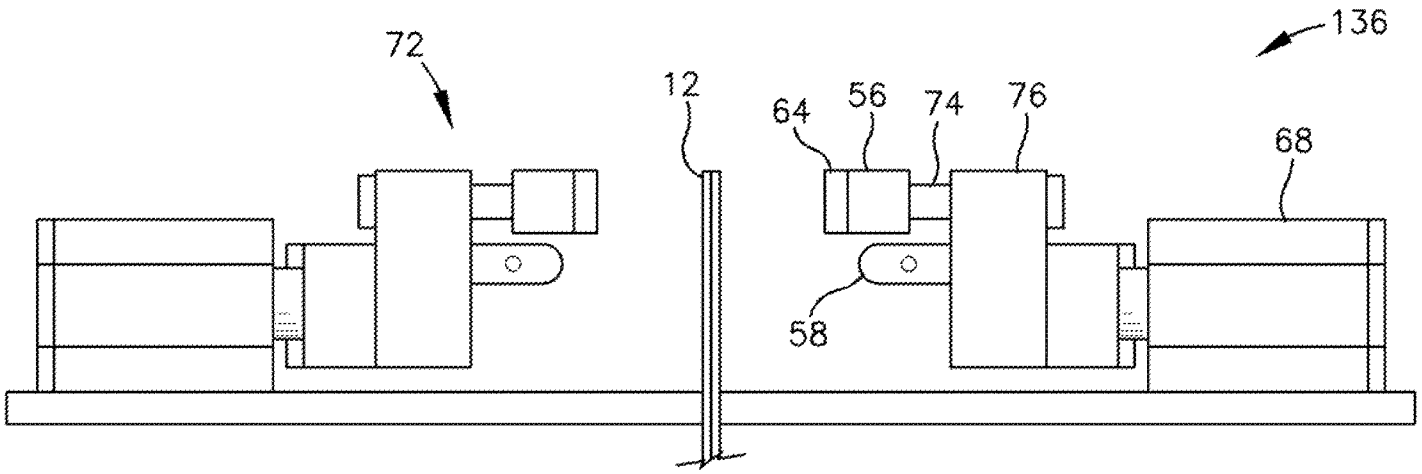
FIG. 15 is a side elevational view of the seal head of FIG. 12 depicted in a ready state with an unfilled, poly bubble-bag disposed between suction bars of the seal head.

In the embodiment depicted in FIGS. 12 and 13, the seal head 36 takes possession of the bag 12 from the bag-transfer carriage 28 by extending the actuator 68 a distance to contact the side faces of the bag 12 with the suction bars 56 but without compressing or just partially compressing the springs of the spring-biased carrier 72. The actuator 68 is then retracted to open the bag 12 for filling. Following filling, the actuator 68 is again extended but to a further extent to compress the springs and to bring the seal bars 58 into operable contact with the sides of the bag 12. The seal bars 58 apply an appropriate quantity of heat to the bag 12 to seal the bag 12 and the actuator 68 is retracted and the vacuum released to drop the sealed, filled, bag 12 onto the takeaway system 18. The seal bars 58 may use impulse or inductive heating or constant heated heat plates.

Figure 16:
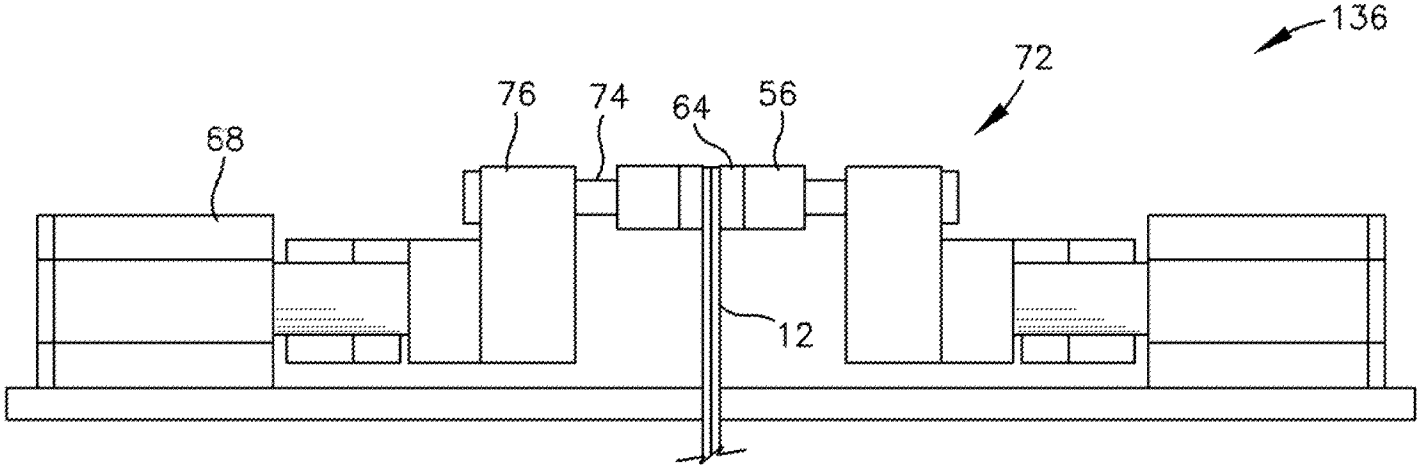
FIG. 16 is a side elevational view of the seal head of FIG. 12 depicted with the suction bars extended into contact with sides of the unfilled, poly bubble-bag.
Figure 17:
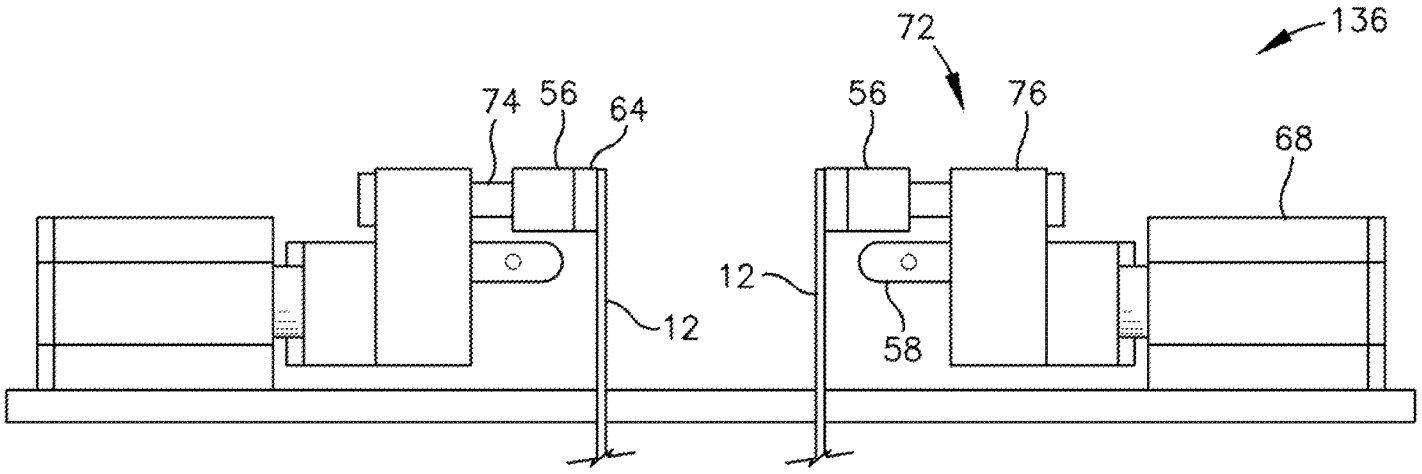
FIG. 17 is a side elevational view of the seal head of FIG. 12 depicted with the suction bars retracted and holding the poly bubble-bag in an open position.
Figure 18:
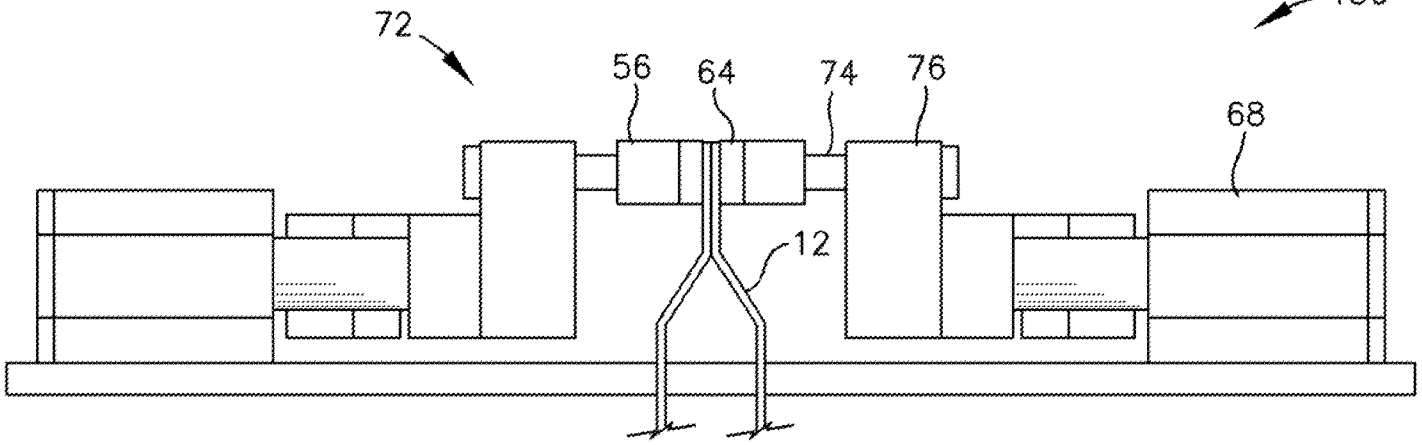
FIG. 18 is a side elevational view of the seal head of FIG. 12 depicted with the suction bars extended to close the filled poly bubble-bag.
Figure 19:
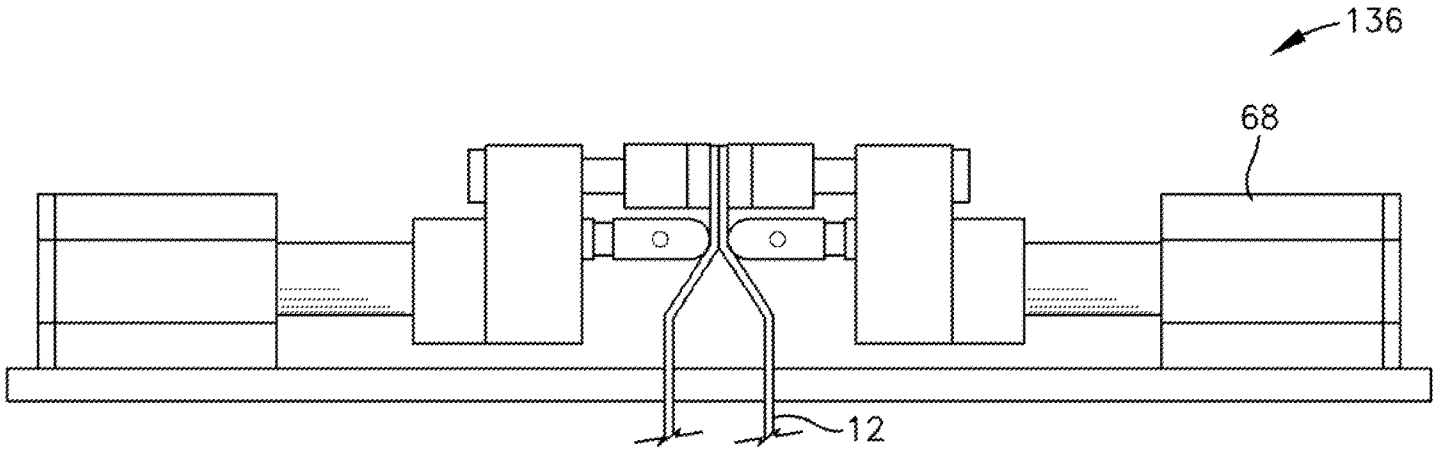
FIG. 19 is a side elevational view of the seal head of FIG. 12 depicted with the suction bars extended and holding the filled poly bubble-bag closed and with seal bars extended against sides of the bag to seal the bag.
Figure 20:
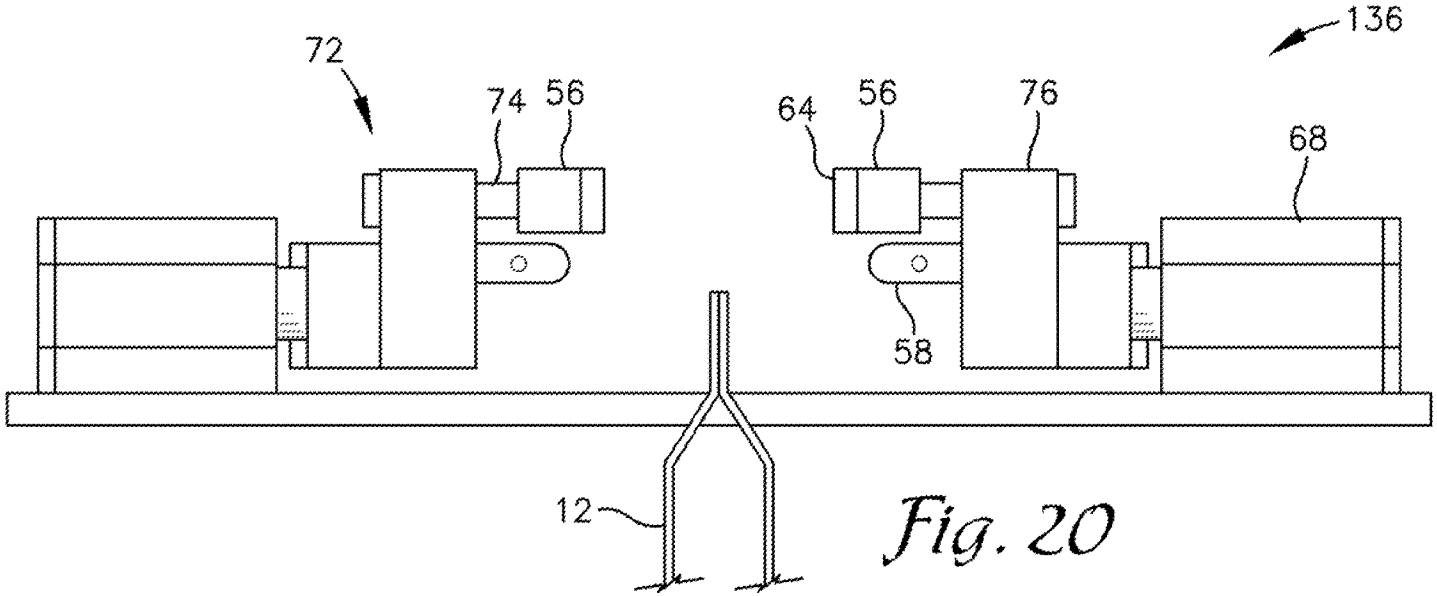
FIG. 20 is a side elevational view of the seal head of FIG. 12 depicted with the suction bars and seal bars retracted to release the filled and sealed poly bubble-bag.

In the embodiment depicted in FIGS. 12-21, the actuators 68 and the seal-bar actuators 82 are operable to place the seal head 136 in a ready state in which the suction bars 56 and the seal bars 58 are retracted (FIGS. 12-15). The actuators 68 may be extended to place the suction bars 56 in a bag-pick-up position in which the suction bars 56 contact the closed bag 12 without or with only partially compressing the coil springs (FIG. 16). A bag-open position (FIG. 17) is then achieved by withdrawing the actuators 68 and thus the suction bars 56 while each of the suction bars 56 retains a suction grip on a respective side of the bag 12 and pulls the sides of the bag 12 away from one another. Following filling of the bag 12, the actuators 68 are again extended to hold the bag 12 in a closed position with the product(s) contained therein (FIG. 18). Following or simultaneously with movement of the suction bars 56 to the closed position, the seal-bar actuators 82 may also be extended to place the seal bars 58 into operable contact with the filled bag 12 to seal the bag 12, as depicted in FIG. 19. Both the actuators 68 and the seal-bar actuators 82 may be withdrawn and the suction grip on the now sealed and filled bag 12 released as depicted in FIG. 20.

With reference now to FIGS. 22, 23, 24, 25A, 25B, 25C, 25D, 25E, and 25F, a magazine 126 is described in accordance with an exemplary embodiment. The magazine 126 is configured similarly to the magazine 26 described previously and includes a base 138 and side guide bars 140 that form a channel 141 within which pre-formed poly bubble bags 12 may be disposed in a stacked arrangement. The bags 12 are preferably oriented in a horizontally aligned stack with open ends of the bags 12 directed upwardly, however other arrangements may be employed in exemplary embodiments. The magazine 126 may be configured for bags 12 of particular dimensions or may be adjustable to accommodate various dimensions. In one embodiment, the magazine 126 may be interchangeable on the machine 10 with magazines 126 of differing dimensions to enable reconfiguration of the machine 10 for filling of bags 12 of differing dimensions.

Figure 22:
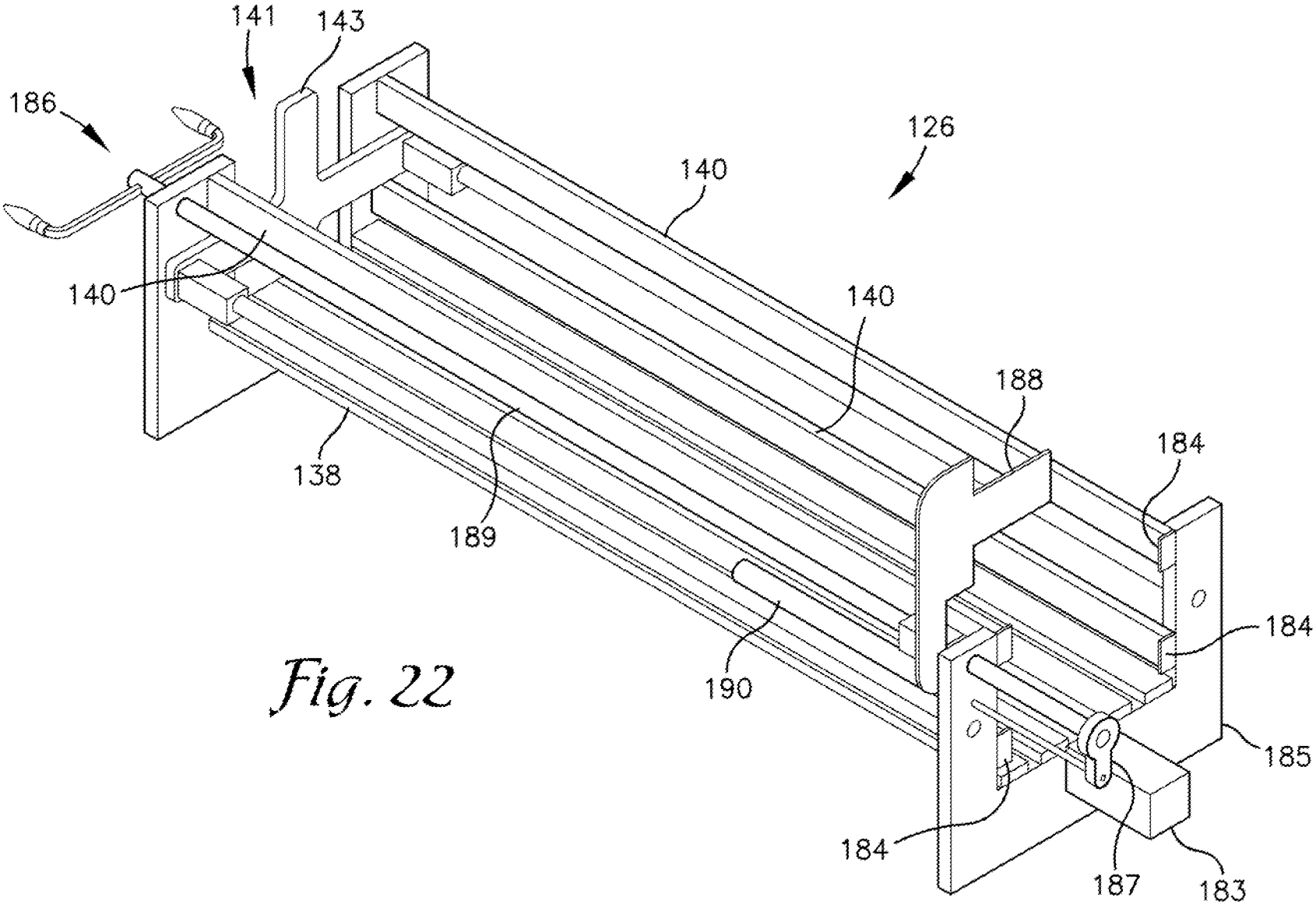
FIG. 22 is a perspective view of a magazine of a poly bubble-bag filling machine with a biased slice plate depicted in accordance with an exemplary embodiment.

The magazine 126 includes a pusher 143 comprising a flange, plate, or similar feature that extends at least partially across the length and width of the channel 141. The pusher 143 is moveable and/or biased to move along the length of the channel 141 via one or more servo motors, actuators, springs, struts, or the like. As depicted in FIG. 22, the pusher 143 is threadably coupled on a threaded rod extending along the base 138 of the channel 141. The rod is rotationally driven by a servo motor 183 to move the pusher 143 along the length of the channel 141. The pusher 143 is thus operable to move the bags 12 along the length of the channel 141 toward the proximate end thereof and toward the bag-transfer carriage 28.

Retaining clips 184 or similar features are provided at the proximate end of the channel 141 to retain the proximate-most bag 12' within the channel 141 until withdrawn by the bag-transfer carriage 28. The retaining clips 184 may comprise one or more flanges that extend at least partially across the proximate end of the channel 141. The retaining clips 184 may be rigid or may be flexible to allow the proximate-most bag 12' to pass thereby when withdrawn by the bag-transfer carriage 28. In one embodiment, a proximate endplate 185 of the magazine 126 may be dimensioned to partially overlap the proximate end of the channel 141 and thus to operate as or instead of the retaining clips 184 to retain the proximate-most bag 12' within the channel 141.

The magazine 126 includes a bag-replenishment mechanism 186 that enables replenishment of the bags 12 in the channel 141 while the machine 10 remains operational and/or when not in operation. The mechanism 186 includes a slice-plate 188 comprising a flange that can be moved into the channel 141 to about a distal face of a bag 12 disposed within the channel 141. The slice-plate 188 is fixedly mounted along the length of a handle rod 189 that is disposed to extend through the proximate endplate 185 and a distal endplate of the magazine 126. The handle rod 189 is rotatable about its long axis via, for example, a handle coupled to a distal end thereof to rotate the slice-plate 188 into the channel 141 and is slidable through the proximate (185) and distal endplates to move the slice-plate 188 along the length of the channel 141.

A biasing means 190, such as a gas-filled strut, a spring mechanism, an actuator, or the like, is coupled to the handle rod 189 and/or the slice-plate 188 to bias the slice-plate 188 toward the proximate endplate 185. As depicted in FIG. 22, the biasing means 190 may comprise a gas strut mounted to the magazine 126 with an actuator rod that extends through the proximate endplate 185 and couples to a proximate end of the handle rod 189 via a coupling link 187. The coupling link 187 is rotatably coupled with the handle rod 189 to allow the handle rod 189 to rotate within the coupling link 187 while maintaining a fixed longitudinal position of the coupling link 187 relative to the handle rod 189.

Figure 23:
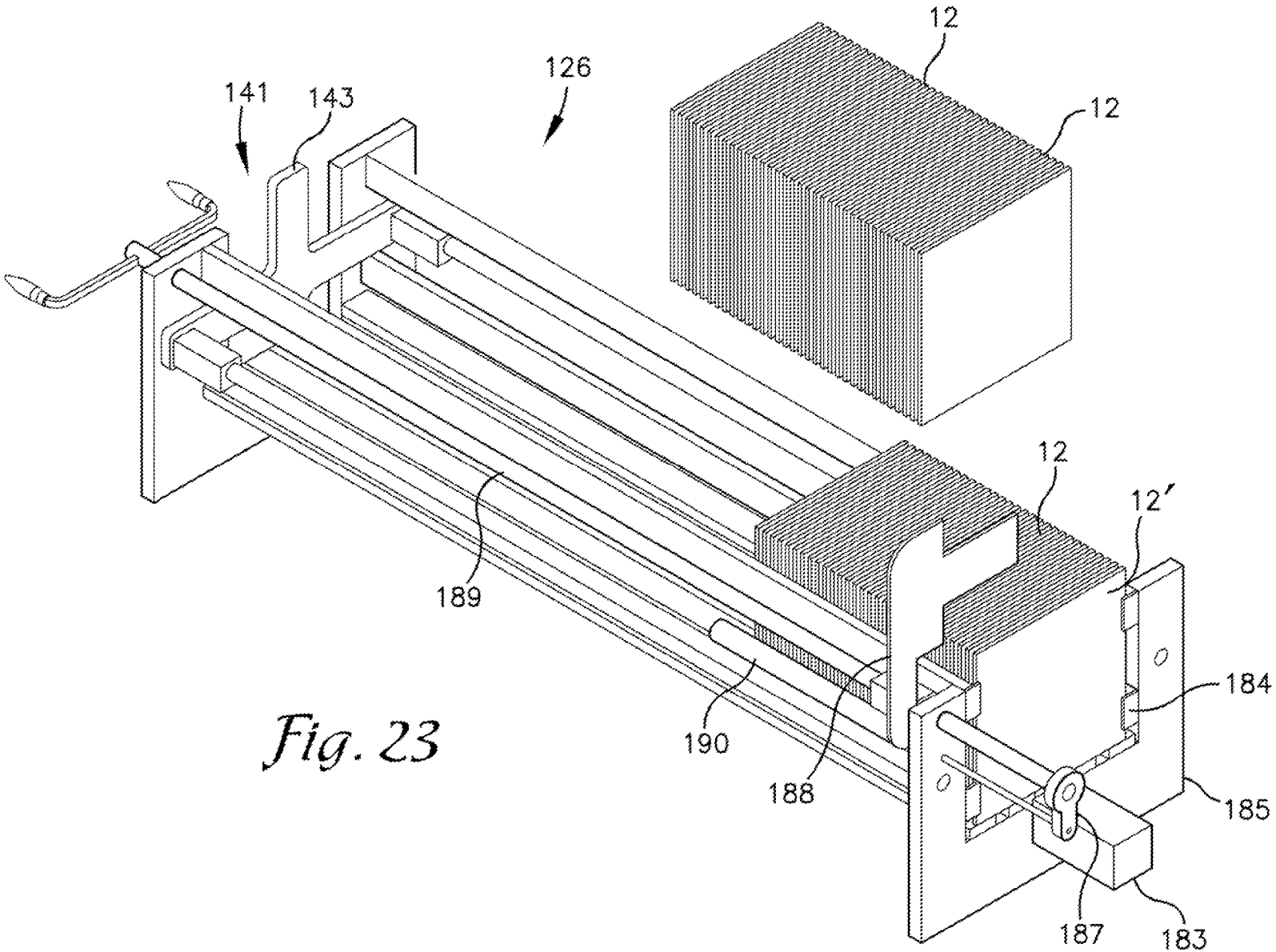
FIG. 23 is a perspective view of the magazine of FIG. 22 being filled with poly bubble-bags on startup of a poly bubble-bag filling machine.
Figure 24:
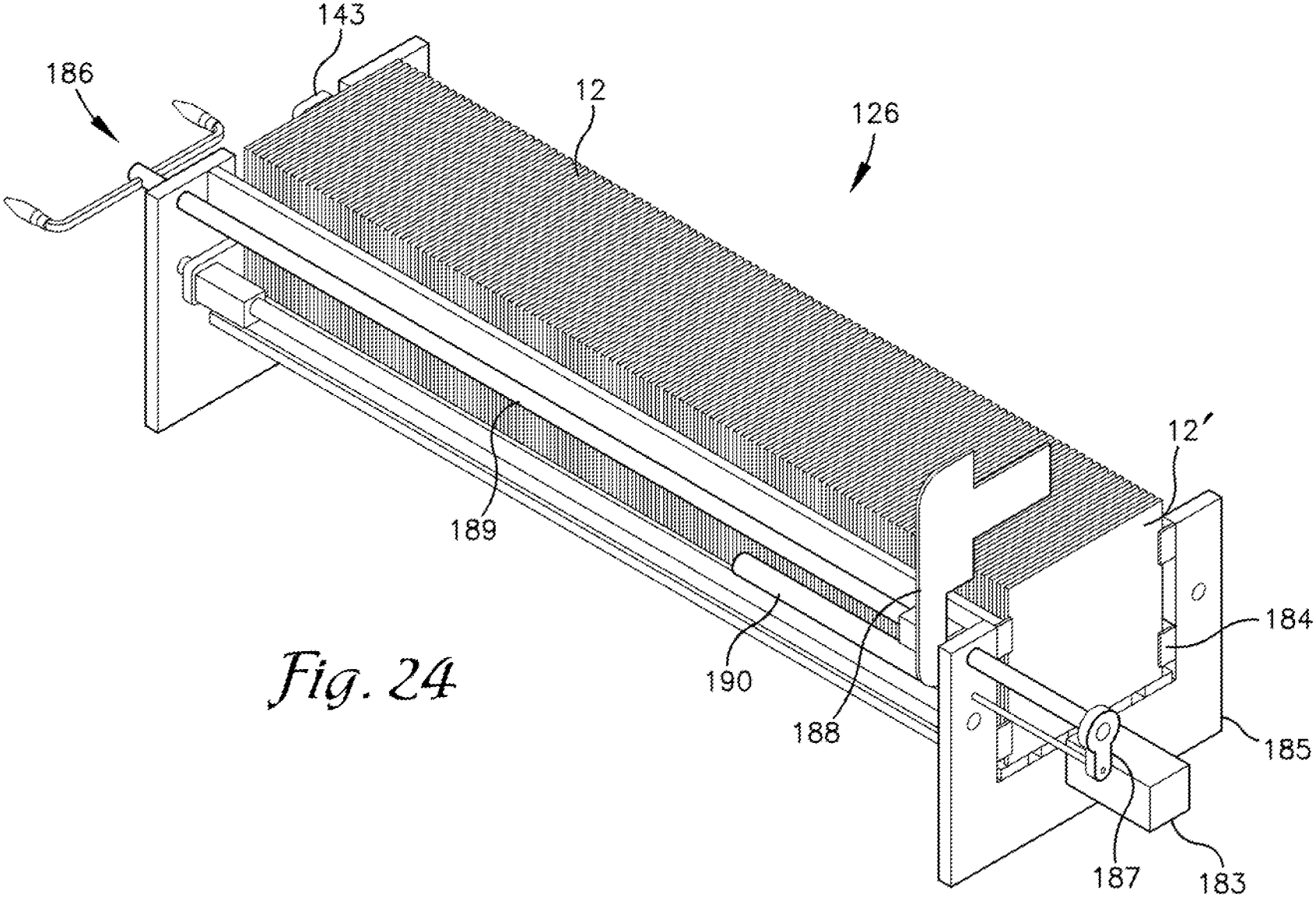
FIG. 24 is a perspective view of the magazine of FIG. 22 fully filled with poly bubble-bags.

With continued reference to FIGS. 22, 23, 24, 25A, 25B, 25C, 25D, 25E, and 25F, operation of the magazine 126 is described in accordance with an exemplary embodiment. From an empty state with the pusher 143 positioned near the distal end of the channel 141, the magazine 126 may be filled by an operator placing one or more poly-bubble bags 12 into the channel 141, typically oriented with an open end of the bags 12 directed upwards or away from the channel 141 and in a horizontally oriented stack. The bags 12 are preferably placed in the channel 141 beginning near the proximate endplate 185 and/or into abutment therewith and/or with the retaining clips 184, as depicted in FIG. 23. A number of the bags 12 may be disposed in the channel 141 to partially (FIG. 23) or fully (FIG. 24) fill the channel 141 as desired. The bag-replenishment mechanism 186 is preferably initially positioned with the slice-plate 188 rotated out of the channel 141.

Operation of the machine 10 commences or continues with the bag-transfer carriage 28 withdrawing the bags 12, one at a time, from the proximate end of the magazine 126. As described previously, the bag-transfer carriage 28 grips the proximate-most bag 12' via the suction cups 46 and pulls the bag 12' from the channel 141. The bag 12' may flex or bend and/or the retaining clips 184 may flex to allow the bag 12' to exit the channel 141. The pusher 143 is incrementally moved toward the proximate end of the channel 141 by the servo motor 183 as each bag 12 is removed from the channel 141 by the bag-transfer carriage 128. In one embodiment, the servo motor 183 operates to apply and maintain a predetermined force on the bags 12 directed toward the proximate end of the channel 141. The predetermined force is sufficient to move the bags 12 toward the proximate end of the channel 141 as they are removed while also retaining the proximate-most bag 12' within the channel 141 and in abutment with the retaining clips 184 until such removal.

Figures 25A, 25B, 25C, 25D:
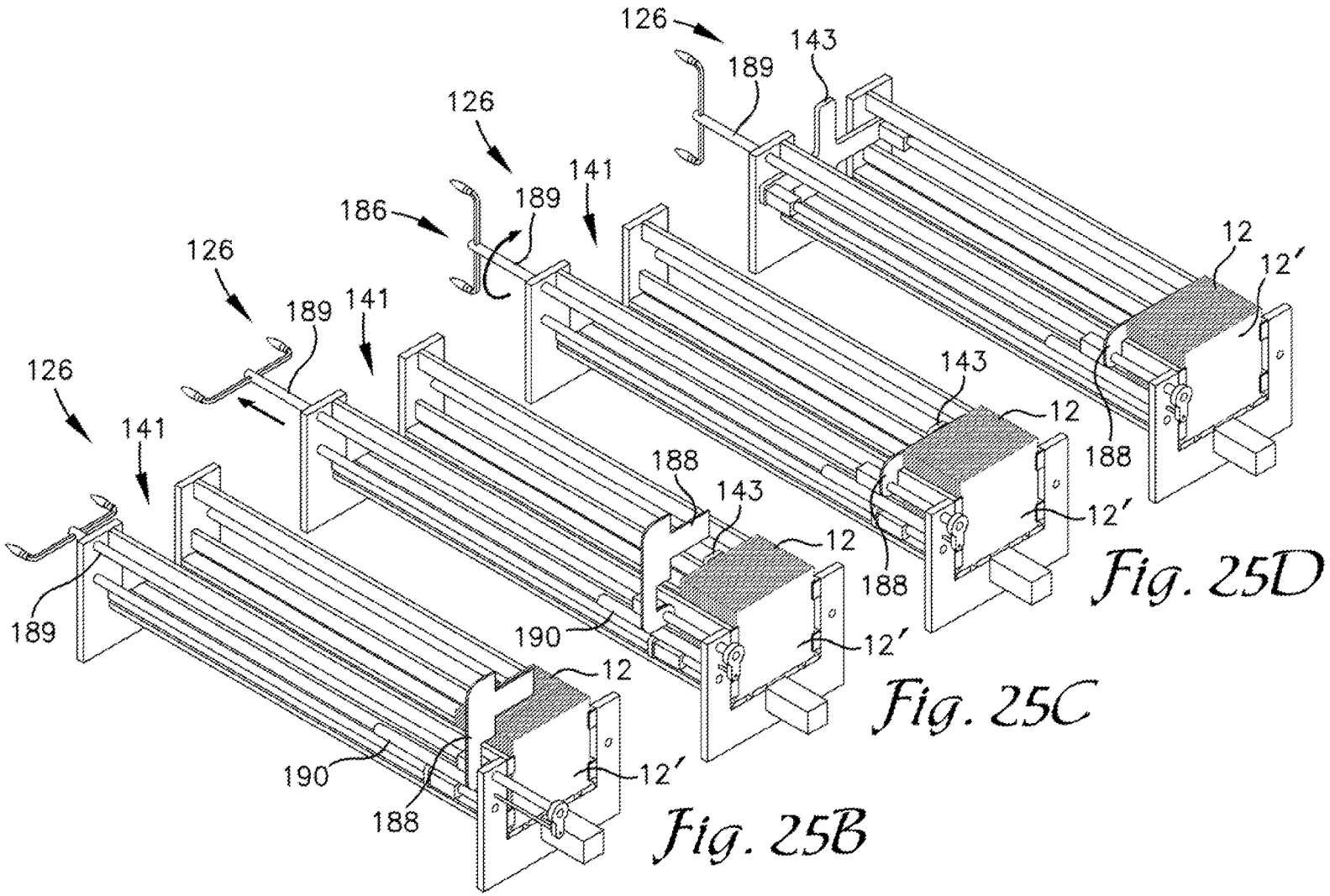
FIGS. 25A, 25B, 25C, 25D, 25E, and 25F are perspective views of the magazine of FIG. 22 depicting a progression of replenishing poly bubble-bags in the magazine during operation of the poly bubble-bag filling machine in accordance with an exemplary embodiment.
Figure 25F:
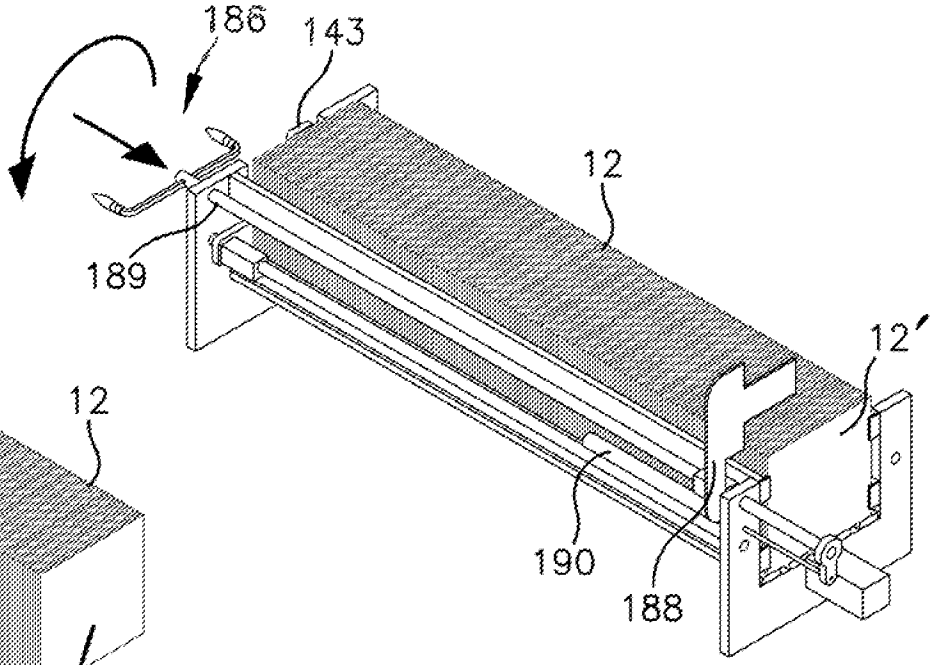

A sensor may be provided on the magazine 126 to detect when the number of bags 12 in the magazine 126 reaches a low level and requires replenishment or the operator may identify when such a state exists (FIG. 25A). To replenish the bags 12, the handle rod 189 is retracted or pulled toward the distal end of the channel 141 to move the slice-plate 188 distally and to compress the biasing means 190, such as via the handle coupled to the distal end thereof (FIG. 25B). The handle rod 189 is then rotated to move the slice-plate 188 into the channel 141 (FIG. 25C). Movement of the slice-plate 188 preferably positions the slice-plate 188 distally of a most-distally located bag 12 in the channel 141 and distally of the pusher 143. In one embodiment, the slice-plate may be inserted between adjacent bags 12 in the channel 141 and proximate to the pusher 143.

Figure 25E:
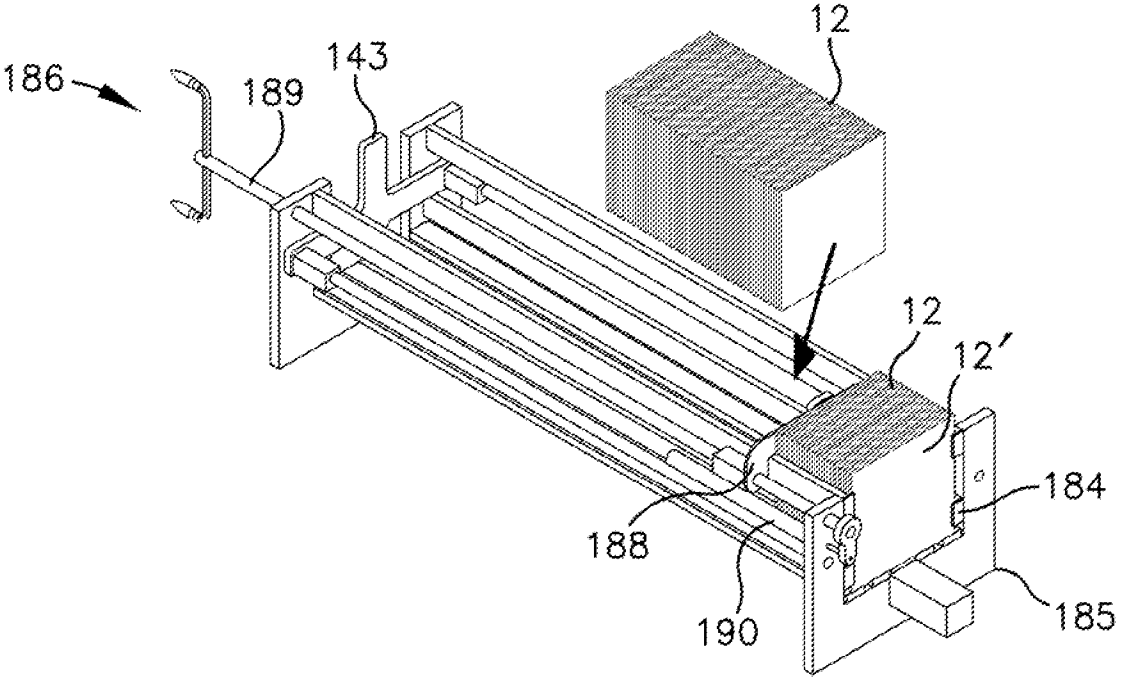

The handle rod 189 is then released and the biasing means 190 operates to bias the slice-plate 188 against the bags 12 positioned between the slice-plate 188 and the proximate endplate 185. The biasing means 190 and the slice-plate 188 thus operate to maintain a force on the bags 12 directed toward the proximate end of the channel 141 sufficient to move the bags 12 toward the proximate end and to retain the proximate-most bag 12' in abutment with the retaining clips 184 while the pusher 143 is retracted to the distal end of the channel 141 (FIG. 25D). The slice-plate 188 and the pusher 143 are configured such that they do not interfere with longitudinal movements of one another within the channel 141. As depicted in FIG. 25E, the bags 12 are replenished by disposing the bags 12 in the channel 141 between the retracted pusher 143 and the slice-plate 188. Replenishment is preferably completed before the quantity of bags 12 between the slice-plate 188 and the proximate endplate 185 are depleted so as not to require halting operations of the machine 10. Upon completion of replenishment of the bags 12, the pusher 143 and/or the servo motor 183 are again activated and the slice-plate 188 is rotated out of the channel 141 via the handle rod 189.

Referring now to FIGS. 26, 27, 28, 29A, 29B, 29C, 29D, and 29E, another magazine 226 is described in accordance with an exemplary embodiment. The magazine 226 is configured similarly to the magazine 126 described above except that a bag-replenishment mechanism 286 of the magazine 226 is configured for replenishment while the machine 10 is placed in a soft-stop state in which withdrawal of the bags 12 by the bag-transfer carriage 28 may be halted momentarily. The bag-replenishment mechanism 286 of the magazine 226 does not include a biasing means (like the biasing means 190) and a handle rod 290 is not configured to provide longitudinal sliding movement of a slice-plate 288 as is provided in the magazine 126. The magazine 226 is otherwise configured similar to the magazine 126. Features of the magazine 226 are thus provided with reference numerals in the "200" series that correspond with those of the magazine 126 in the "100" series, i.e., reference numerals having corresponding tens and ones digits. Further description of these features is not provided herein.

Figure 26:
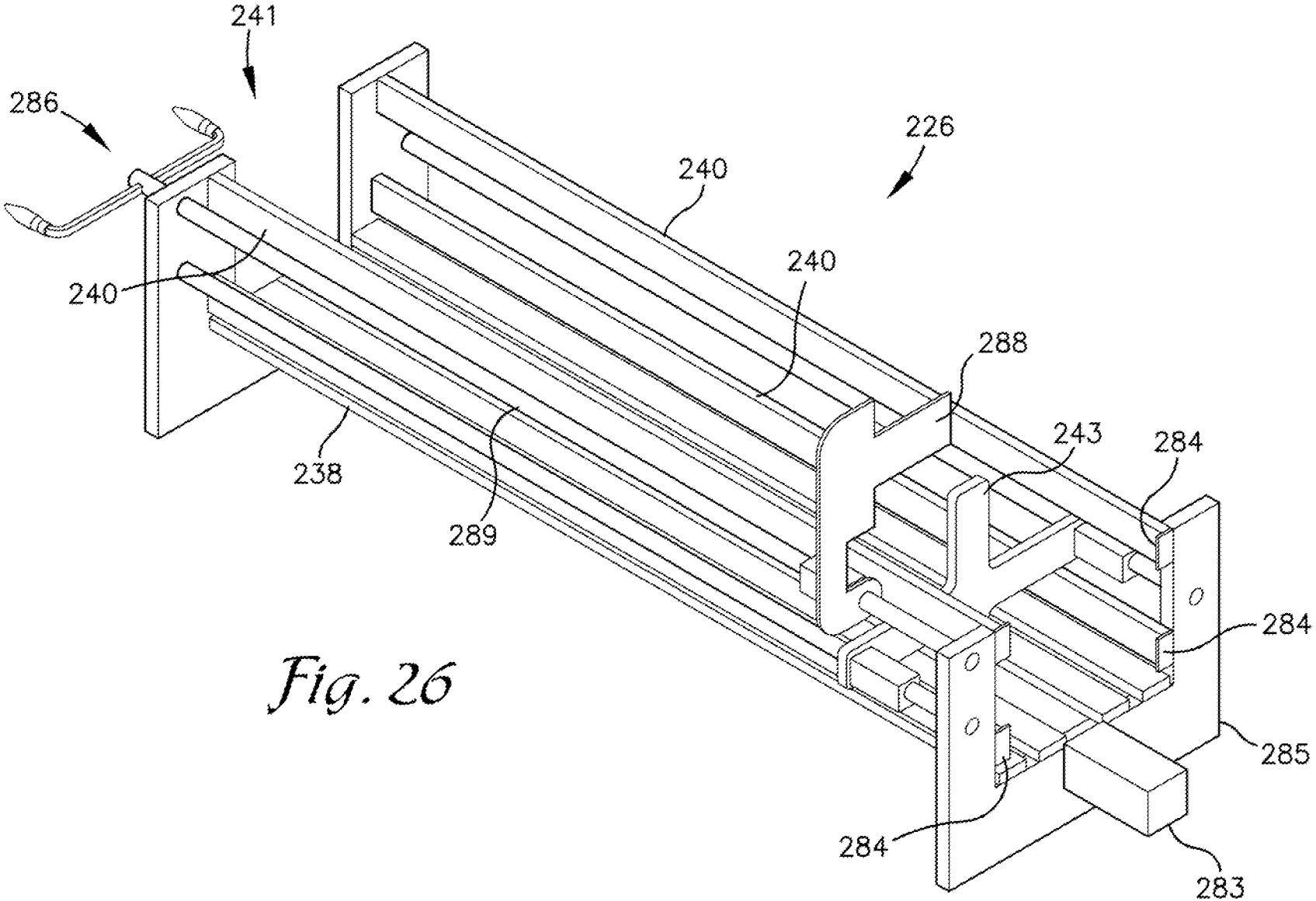
FIG. 26 is a perspective view of another magazine of a poly bubble-bag filling machine with a fixed slice plate depicted in accordance with another exemplary embodiment.
Figure 27:
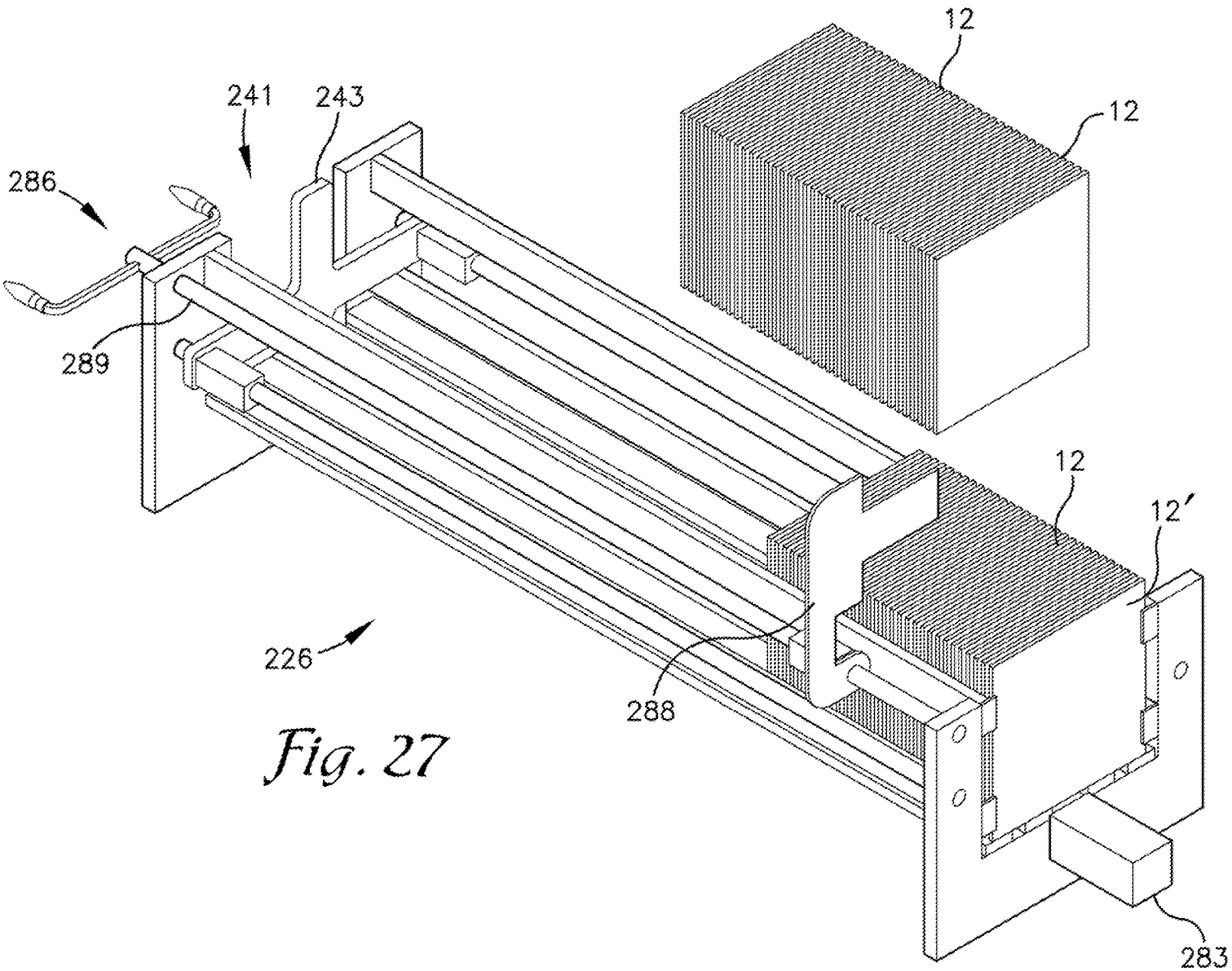
FIG. 27 is a perspective view of the magazine of FIG. 26 being filled with poly bubble-bags on startup of a poly bubble-bag filling machine.
Figure 28:
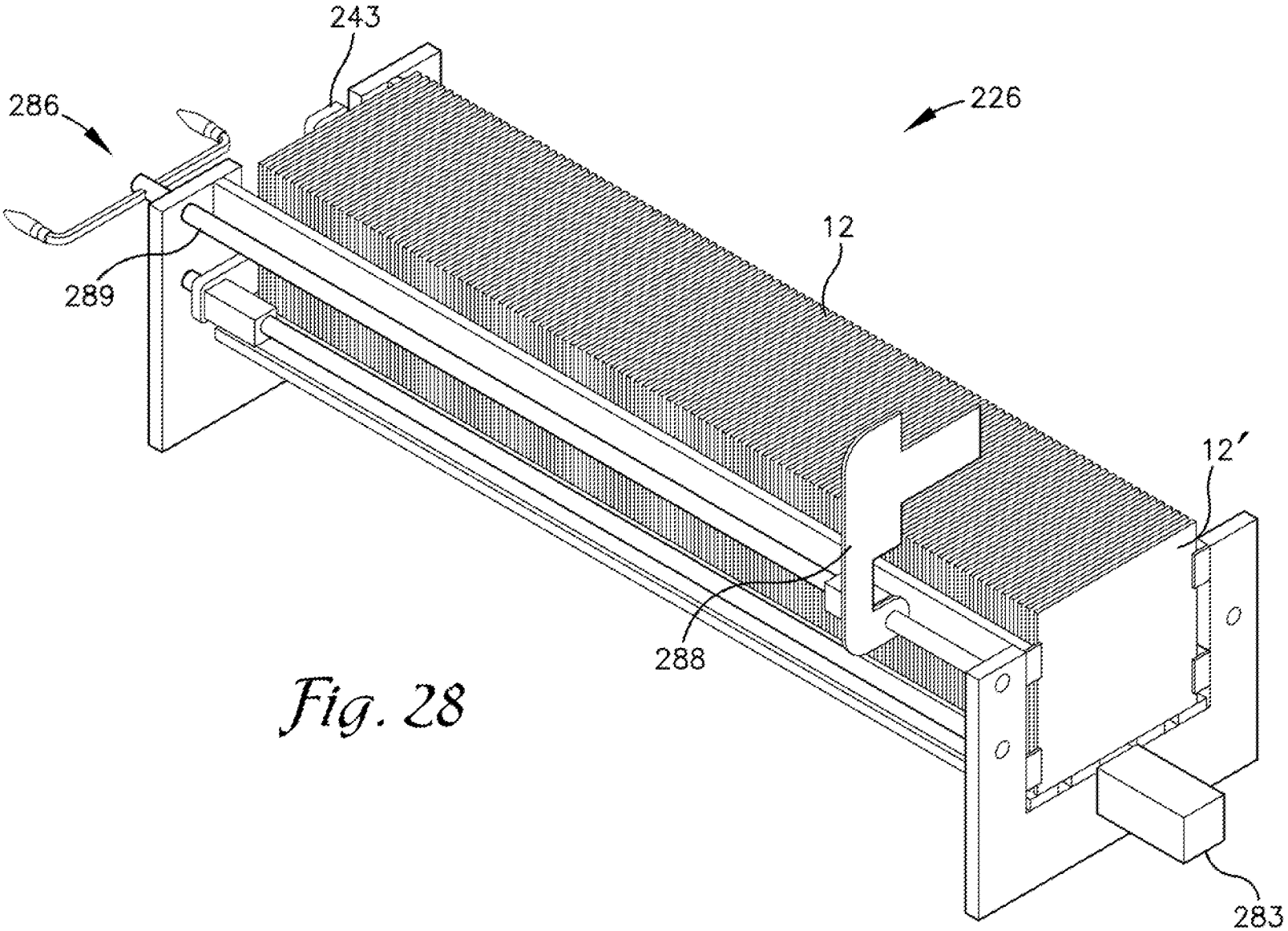
FIG. 28 is a perspective view of the magazine of FIG. 26 fully filled with poly bubble-bags.
Figures 29A, 29B, 29C, 29D, 29E:
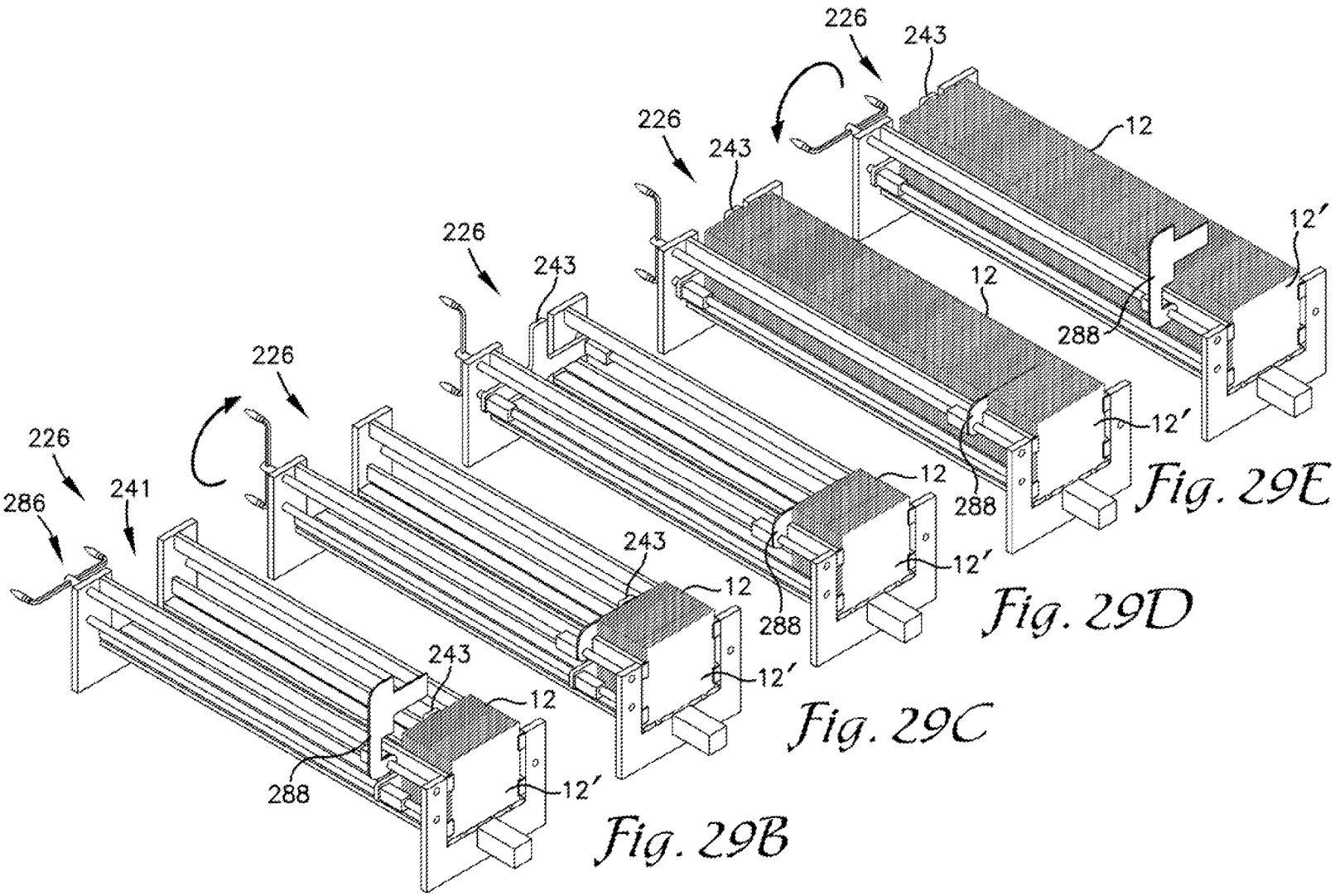
FIGS. 29A, 29B, 29C, 29D, and 29E are perspective views of the magazine of FIG. 26 depicting a progression of replenishing poly bubble-bags in the magazine during operation of the poly bubble-bag filling machine in accordance with an exemplary embodiment.

In operation, the magazine 226 is filled from empty in a manner similar to that of the magazine 126. The slice-plate 288 is rotated out of the channel 241 via rotation of a handle rod 289, and a pusher 243 is retracted to a full distal position as depicted in FIG. 26. Bags 12 are placed into the channel 241 as depicted in FIGS. 27 and 28 and operation of the machine 10 commenced. The pusher 243 operates via a servo motor 283 to move the bags 12 toward the proximate end of the channel 241 as the bag-transfer carriage 28 withdraws the bags 12 therefrom. A sensor may be provided that detects when the quantity of bags 12 in the channel 241 reaches a low level, or an operator may recognize such a state, as depicted in FIG. 29A.

To replenish the bags 12 in the channel 241, the machine 10 may be placed in the soft-stop state. The slice-plate 288 is rotated into the channel 241 via rotation of the handle rod 289 to place the slice-plate 288 distally of all bags 12 remaining in the channel 241 (FIG. 29B). The pusher 243 is withdrawn to the distal end of the channel 241 (FIG. 29C). The bags 12 are replenished in the channel 241 between the slice-plate 288 and the pusher 243 (FIG. 29D). The slice-plate 288 is rotated out of the channel 241 and the machine 10 is returned to full operational state (FIG. 29E).

With reference now to FIGS. 30, 31A, 31B, 31C, 31D, 31E, and 31F, a magazine 326 is described in accordance with another exemplary embodiment. The magazine 326 includes features similar to those described above for the magazines 126 and 226, such as a base 338 and side guide bars 340 that form a channel 341, and retaining clips 384. Such features are thus not described here again in detail. Cleated drive belts 391 are provided along one or more sides and/or the bottom of the channel 341. The drive belts 391 comprise continuous bands that extend substantially the length of a respective side of the channel 341 and wrap around each end and along an exterior face of the side of the channel 341 to form a continuous loop in a fashion similar to a common conveyor belt. The drive belts 391 are driven by one or more servo motors or the like to move along sides and the base of the channel 341 toward the proximate end thereof.

The drive belts 391 may be sized to fit between or within a spacing between pairs of the side guide bars 340 or similar structures of the base 338. As depicted in FIGS. 30, 31A, 31B, 31C, 31D, 31E, and 31F a single drive belt 391 is provide in each side of the channel 341, however other configurations including zero or more drive belts 391 in one or more of the sides of the channel 341 may be employed without departing from the scope of exemplary embodiments described herein.

The drive belts 391 include cleats 392, tabs, flanges, or other raised features spaced apart along their length and extending outwardly from an exterior surface thereof. As the drive belts 391 are moved along the sides and/or base of the channel 341, the cleats 392 extend at least partially into the channel 341 and move along the length thereof. Where more than one drive belt 391 is employed as depicted in FIGS. 30, 31A, 31B, 31C, 31D, 31E, and 31F the drive belts 391 are preferably synchronized to align respective ones of their cleats 392 in substantially a single plane extending transversely through the channel 341 and to generally retain such alignment as the cleats 392 are moved along the channel 341, however other configurations may be employed. The cleats 392 may thus form zones within the channel 341 within which stacks of the bags 12 may be disposed.

The cleats 392 are configured to engage or abut a face of a bag 12 disposed within the channel 341 and to apply a force to the bag 12 sufficient to move the bag 12 along the channel 341 toward the proximate end thereof. Alignment of the cleats 392 to form zones, as described above, may reduce the force required to move the bags 12 by reducing the number of bags 12 being moved by any particular cleat 392. For example, if each zone was configured to hold ten bags 12 and the channel 341 included five zones, then the cleats 392 in each zone would only need to apply a force sufficient to move ten bags 12 rather than a force sufficient to move fifty bags where the channel 341 were not so divided.

Such a configuration may also enable replenishment of the bags 12 in the channel 341 at any time during operation of the machine 10 and without stopping or placing the machine 10 in a soft stop condition. At any time during operation an operator may place additional bags 12 into the channel 341. The bags 12 may be pre-divided into stacks configured to fit between adjacent ones of the cleats 392 or any number of bags 12 may be disposed into the channel 341 as desired. Sensors may be provided and associated with the motors driving the drive belts 391 to ensure that a proximate-most bag 12' is maintained in a desired position at the proximate end of the channel 341 and against the retaining clips 384 to be picked up by the bag-transfer carriage 28. Sensors may also be provided to detect when the bags 12 have reached a low level and require replenishment. An alert may be provided to an operator indicating such a condition.

Figure 30:
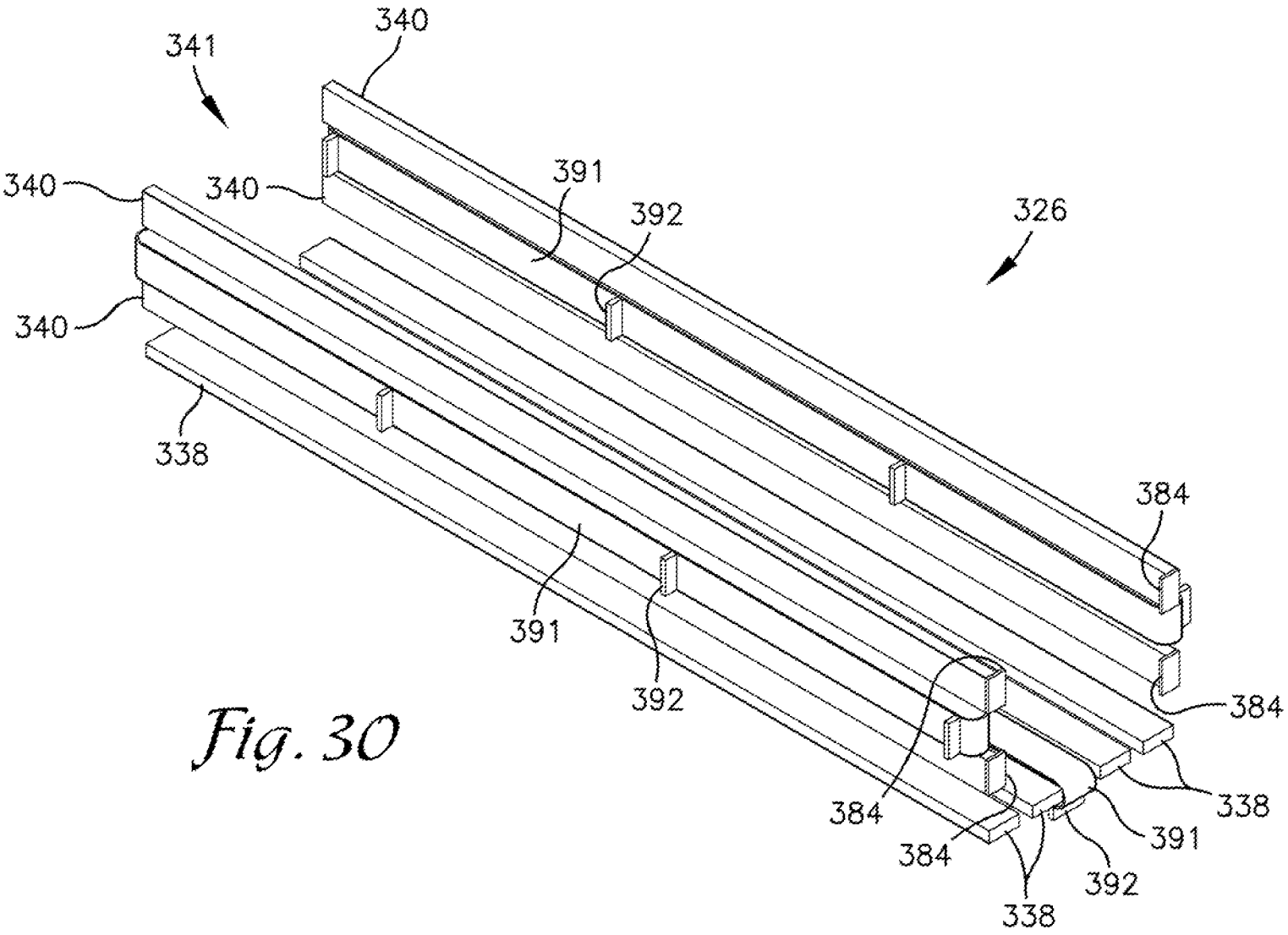
FIG. 30 is a perspective view of another magazine for a poly bubble-bag filling machine with cleated mover belts depicted in accordance with another embodiment.
Figure 31A:
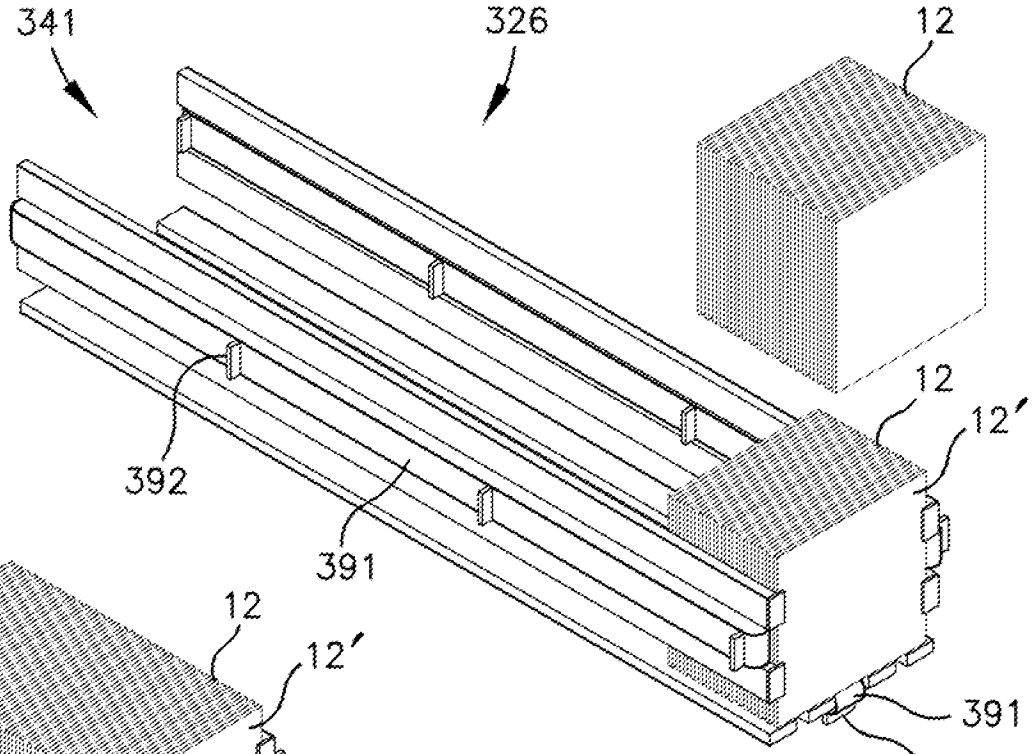
FIGS. 31A, 31B, 31C, 31D, 31E, and 31F are perspective views of the magazine of FIG. 30 depicting a progression of filling the magazine before and during operation of the poly bubble-bag filling machine depicted in accordance with an exemplary embodiment.
Figure 31B:
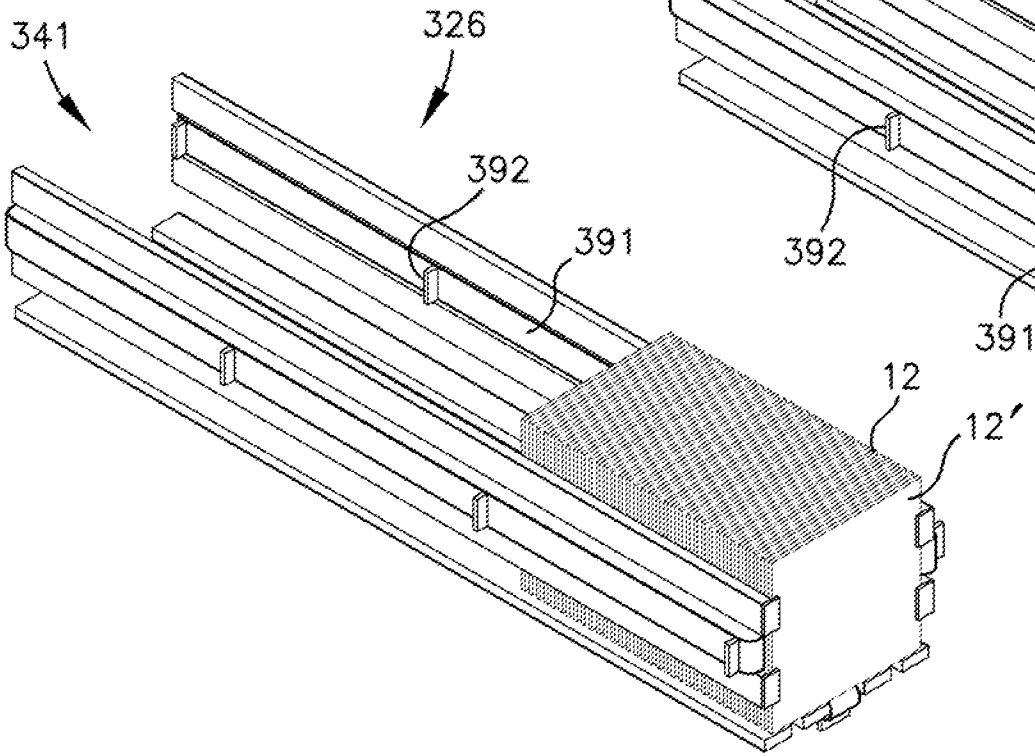
Figure 31C:
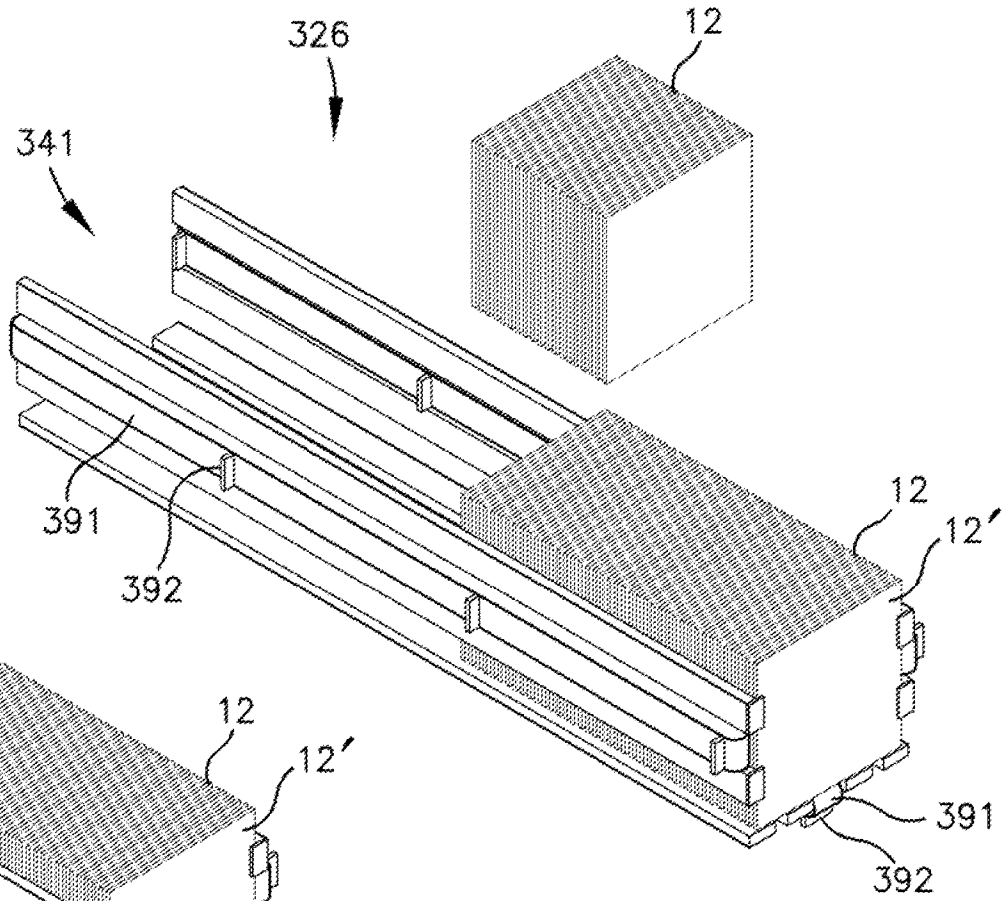
Figure 31D:
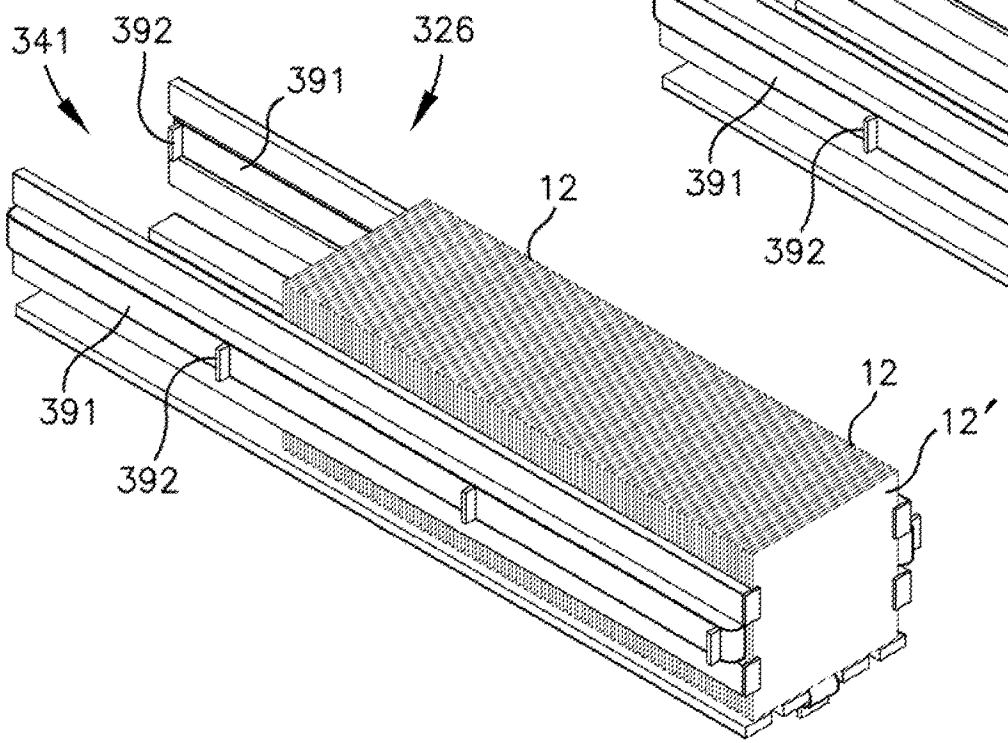
Figure 31E:
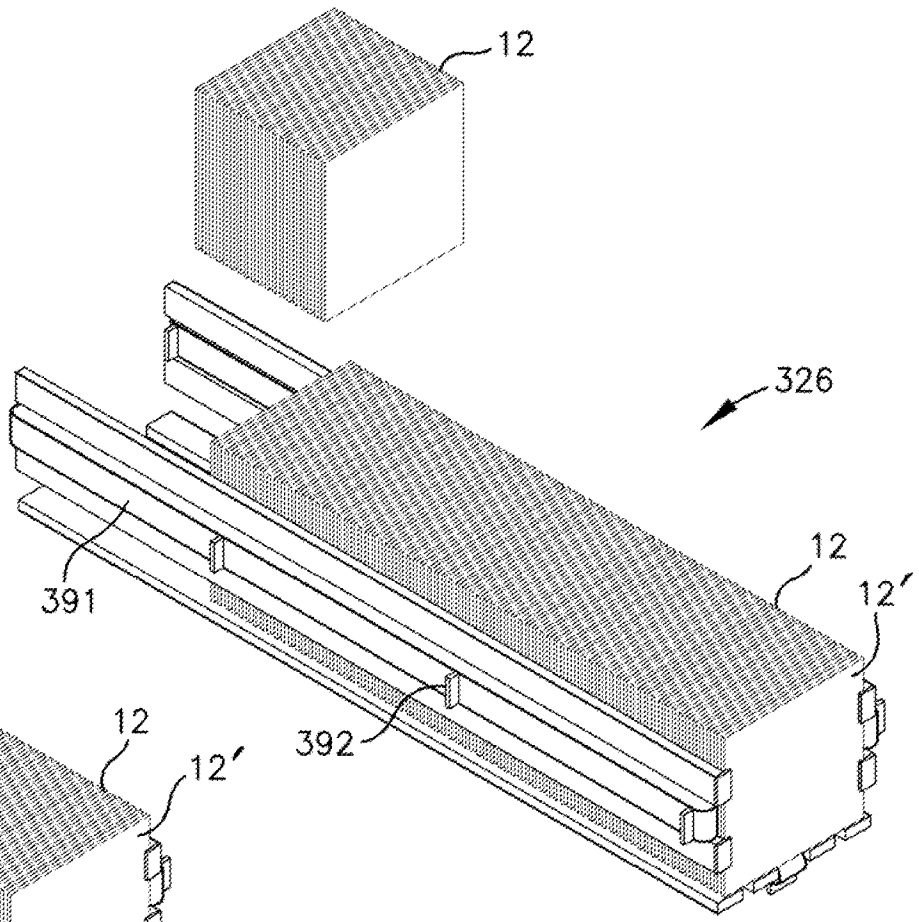
Figure 31F:
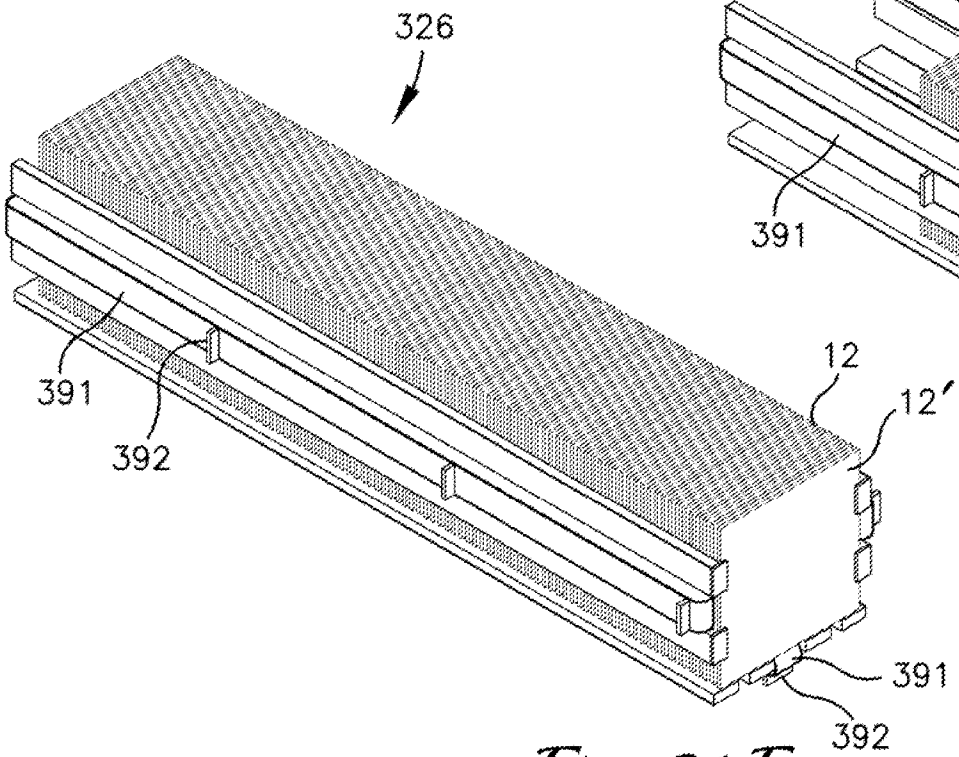
Figure 32:
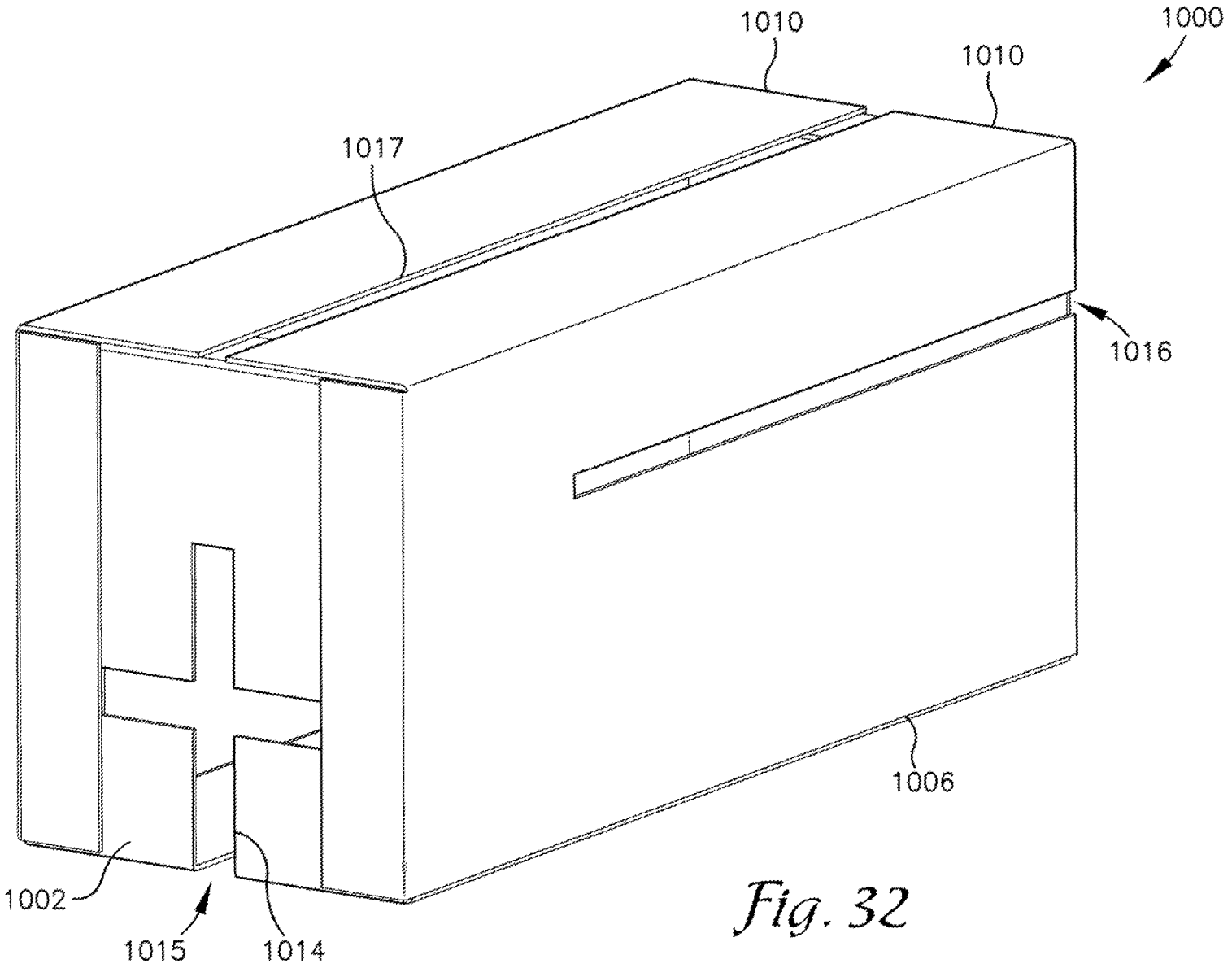
FIG. 32 is a perspective view from a pusher-end of a carton configured to carry a plurality of poly-bubble bags for replenishment of a magazine of a poly bubble-bag filling machine depicted in accordance with an exemplary embodiment.
Figure 33:
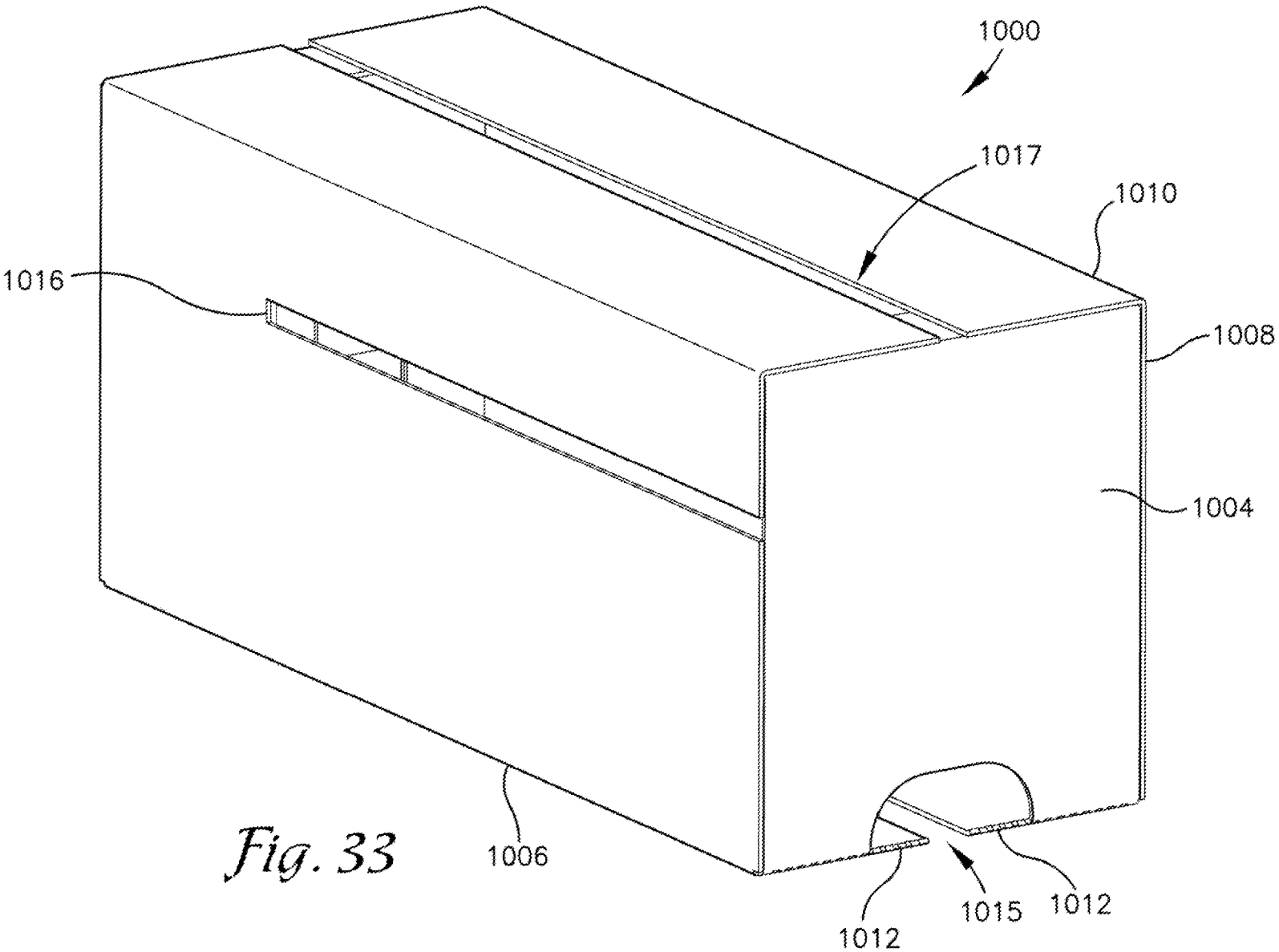
FIG. 33 is a perspective view of the carton of FIG. 32 from an opposite, bag-exit end depicted in accordance with an exemplary embodiment.
Figure 34:
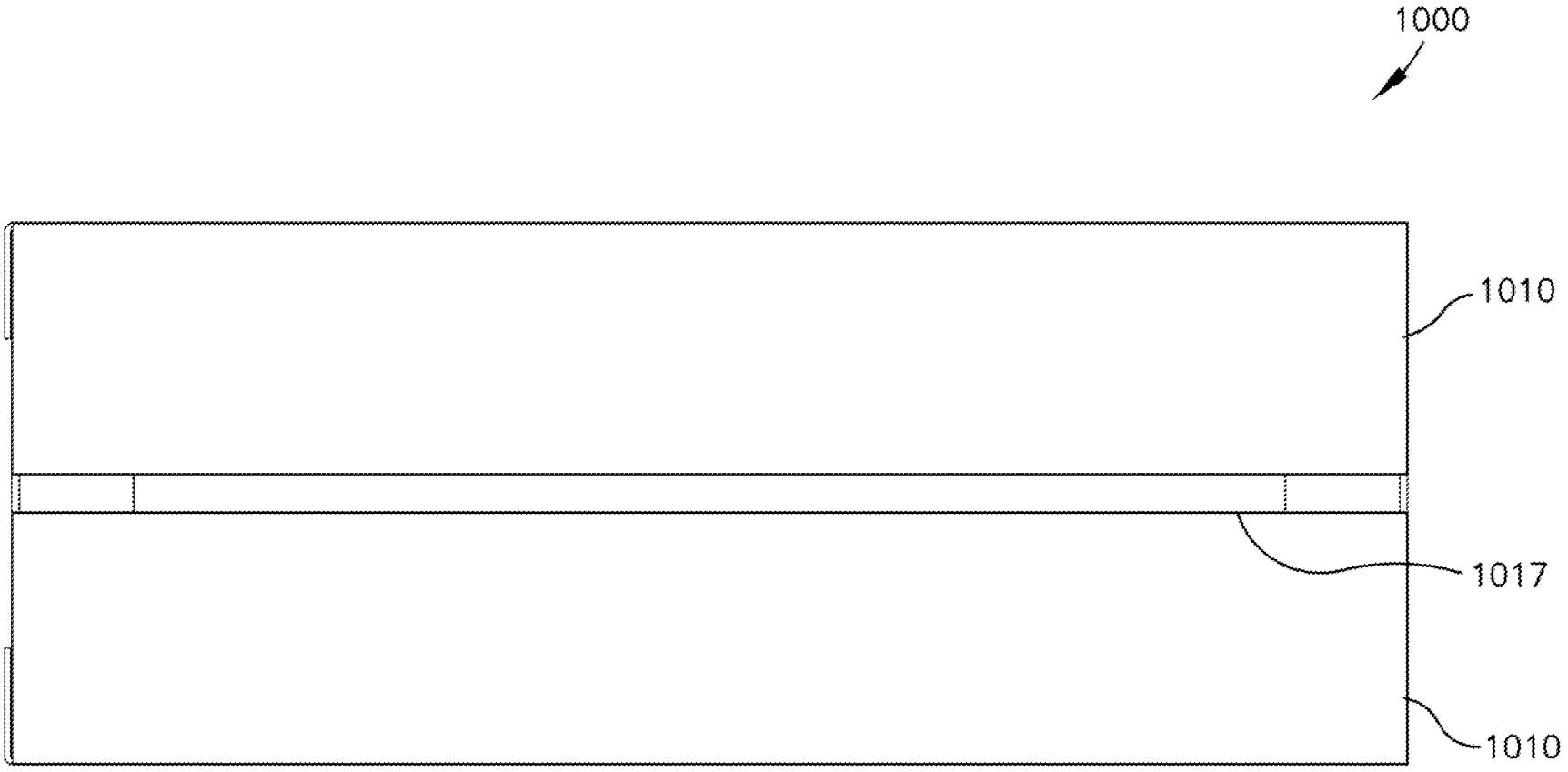
FIG. 34 is top plan view of the carton of FIG. 32.

As depicted in FIG. 30, the magazine 326 may be operated from an empty state by disposing a quantity of preformed poly bubble-bags 12 into the channel 341 at the proximate end thereof and between the retaining clips 384 and a proximate-most set of cleats 392 (FIG. 31A). In one embodiment, the bags 12 may be placed into the channel 341 at any position therealong and sensors may be employed to move the bags 12, via the drive belts 391, into a desired initial position. Disposal of additional bags 12 into the channel 341 may continue as depicted FIGS. 31A, 31B, 31C, 31D, 31E, and 31F until the channel 341 is full. Operation of the machine 10 may be commenced at any time during filling of the channel 341 and replenishment of the bags 12 in the channel 341 may take place any time there is space available at the distal end of the channel 341.

With reference now to FIGS. 32, 33, 34, 35, 36, 37, 38, 39, 40, 41, 42, 43, and 44, a carton 1000 configured to aid replenishment of bags 12 in a magazine 426 of a bag-filling machine, such as the bag-filling machine 10 is described in accordance with an exemplary embodiment. The carton 1000 is described herein with respect to a magazine 426, but it is to be understood that the carton 1000 may be configured for use with any of the magazines 26, 126, 226, 326 described herein as well as combinations, and/or derivations thereof. The magazine 426 is generally similarly configured to the magazine 126 and is thus not described in full detail again herein. The magazine 426 thus includes a base 438 and side guide bars 440 that form a channel 441 as well as a pusher 443 and retaining clips 484. Although not shown, the magazine 426 may also include a slice-plate like the slice-plate 188 that is insertable transversely into the channel 441 between bags 12 disposed therein or distal to a most distal bag 12 in the channel 441 as described previously above with respect to other exemplary embodiments.

Figure 35:
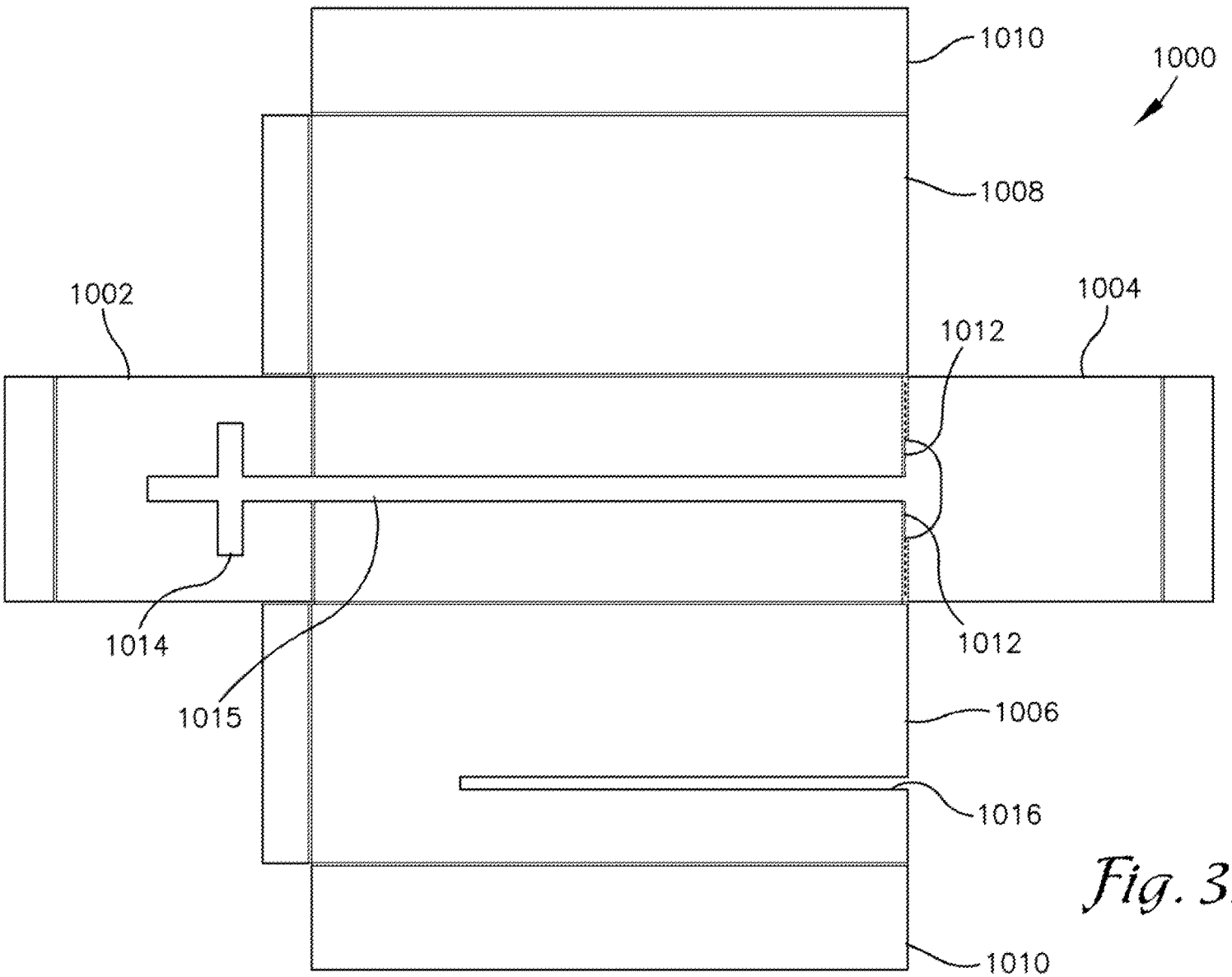
FIG. 35 is a plan view of the carton of FIG. 32 in an unfolded condition depicted in accordance with an exemplary embodiment.
Figure 36:
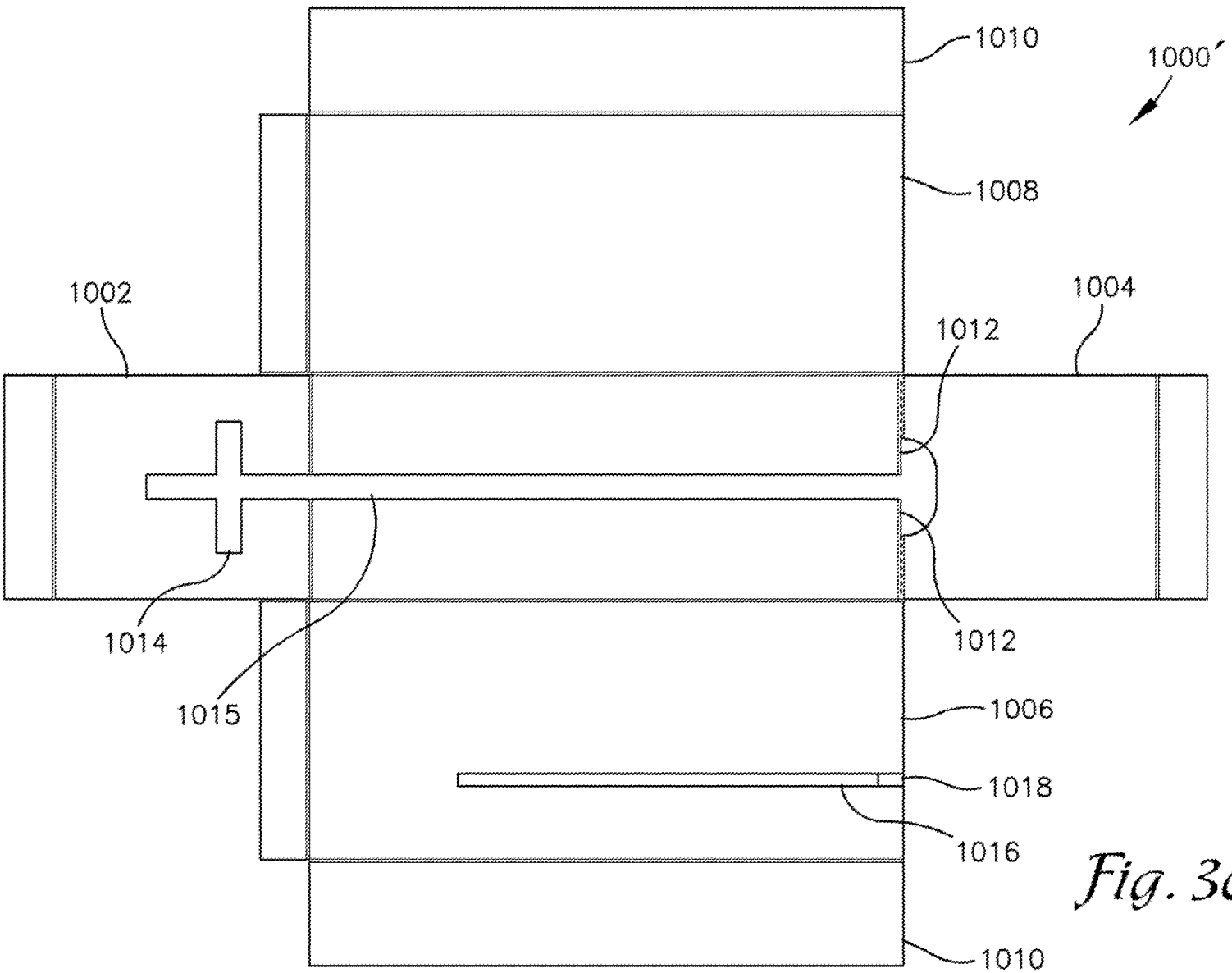
FIG. 36 is a plan view of another carton with a removeable support tab in a retainer-arm slot in a sidewall thereof depicted in accordance with another exemplary embodiment.
Figure 37:
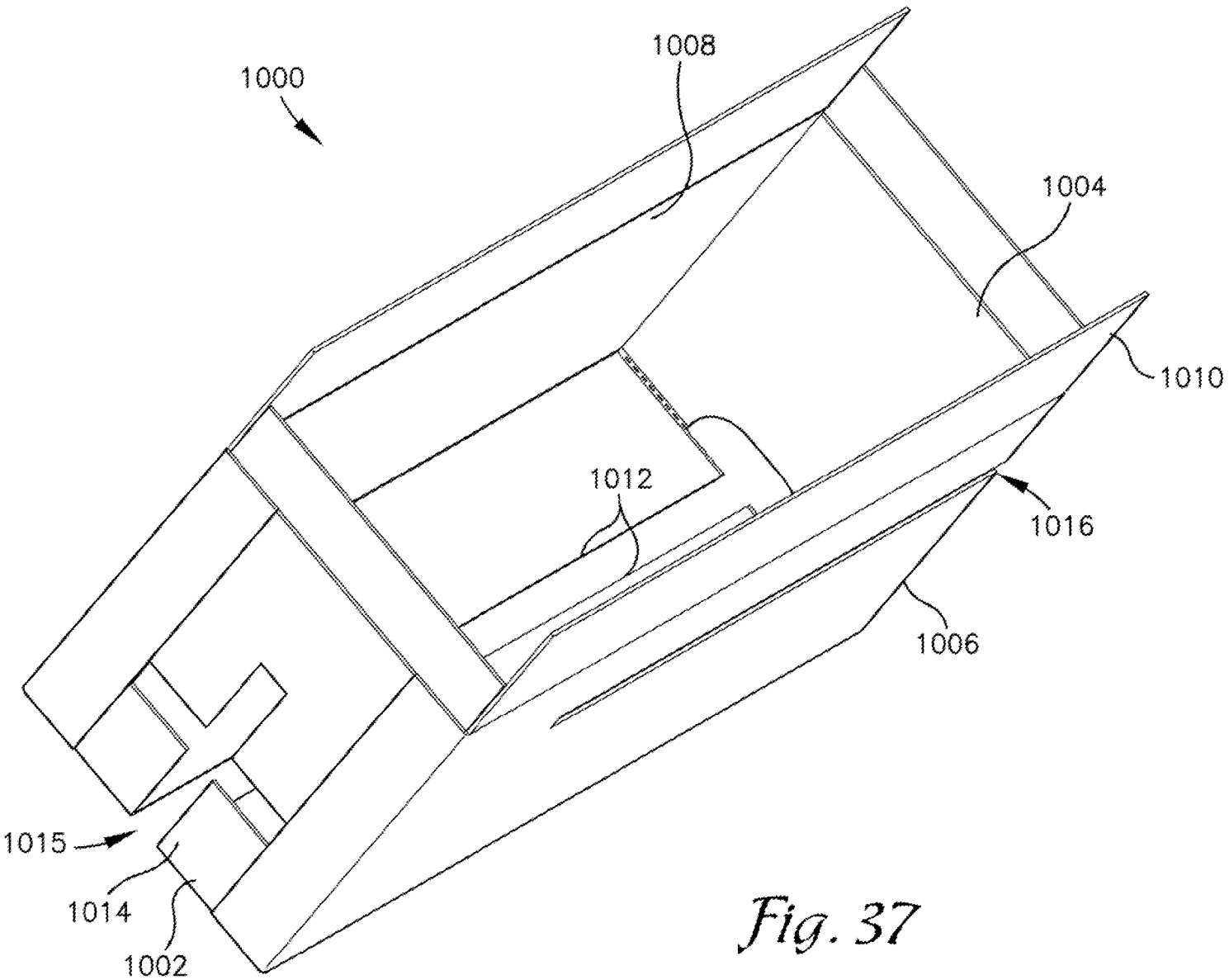
FIGS. 37 and 38 are perspective views of the carton of FIG. 32 with top flaps thereof in an open position.
Figure 38:
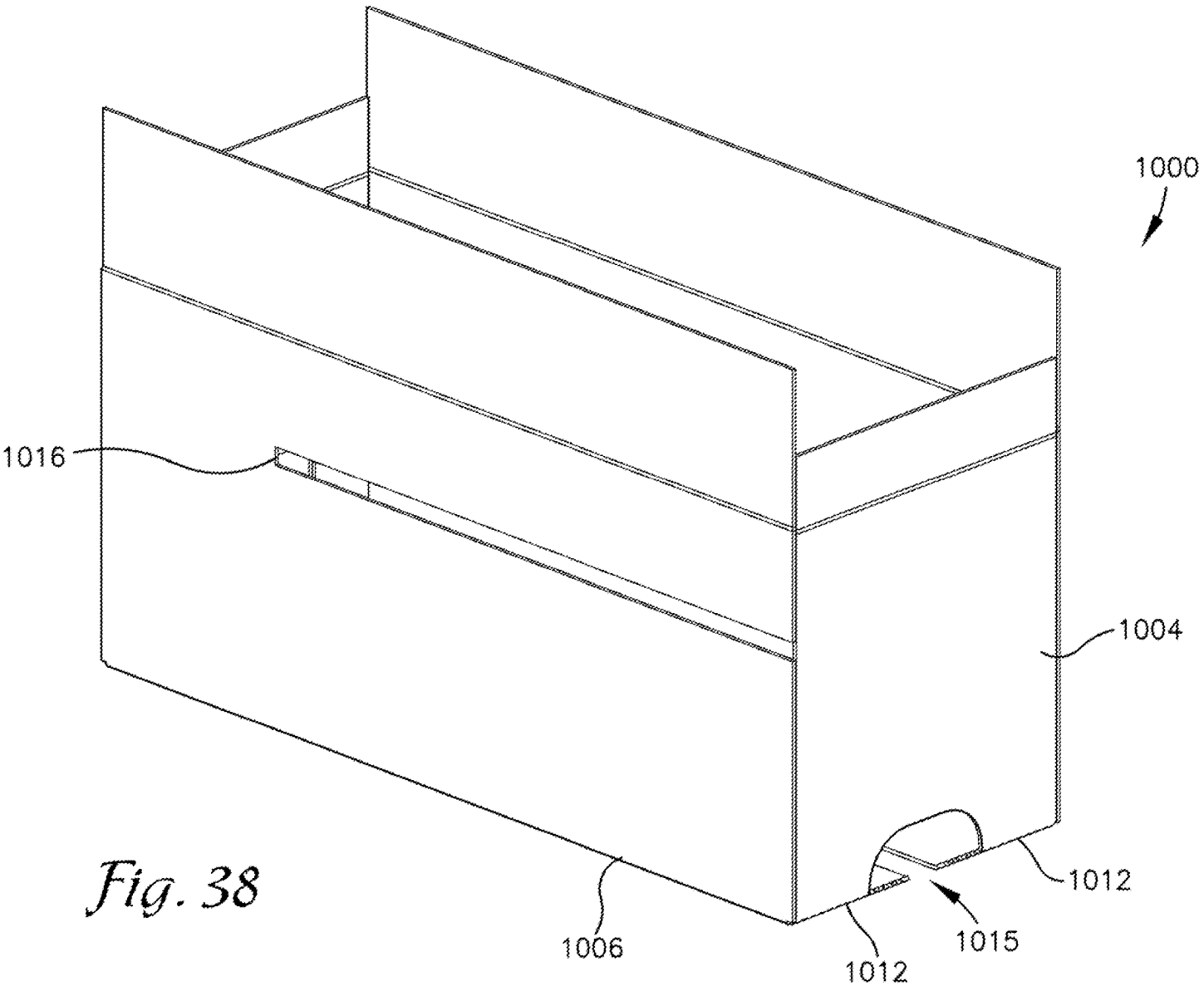
Figure 39:
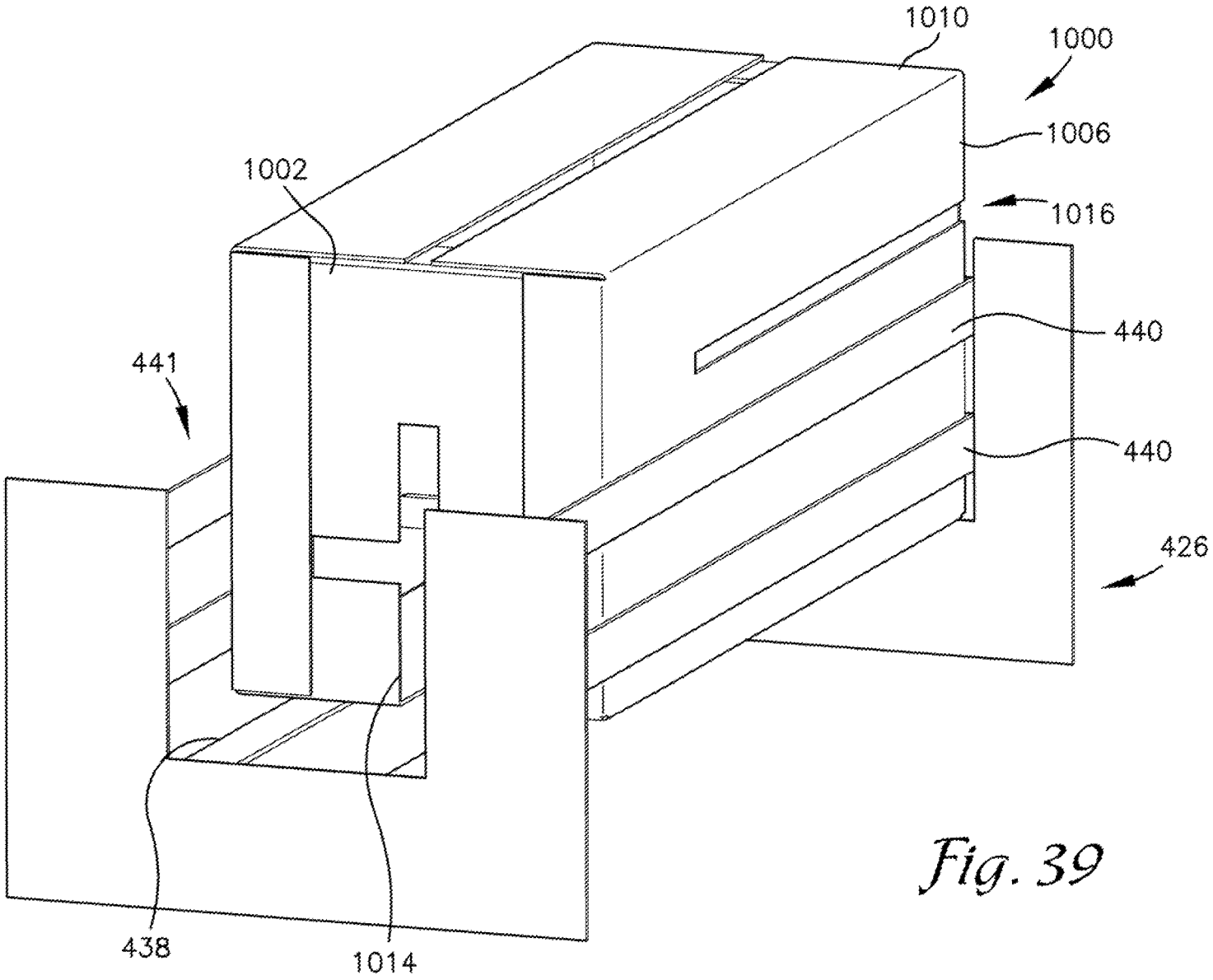
FIG. 39 is a perspective view from the pusher end of the carton of FIG. 32 installed in a magazine of a poly bubble-bag filling machine depicted in accordance with an exemplary embodiment.
Figure 40:
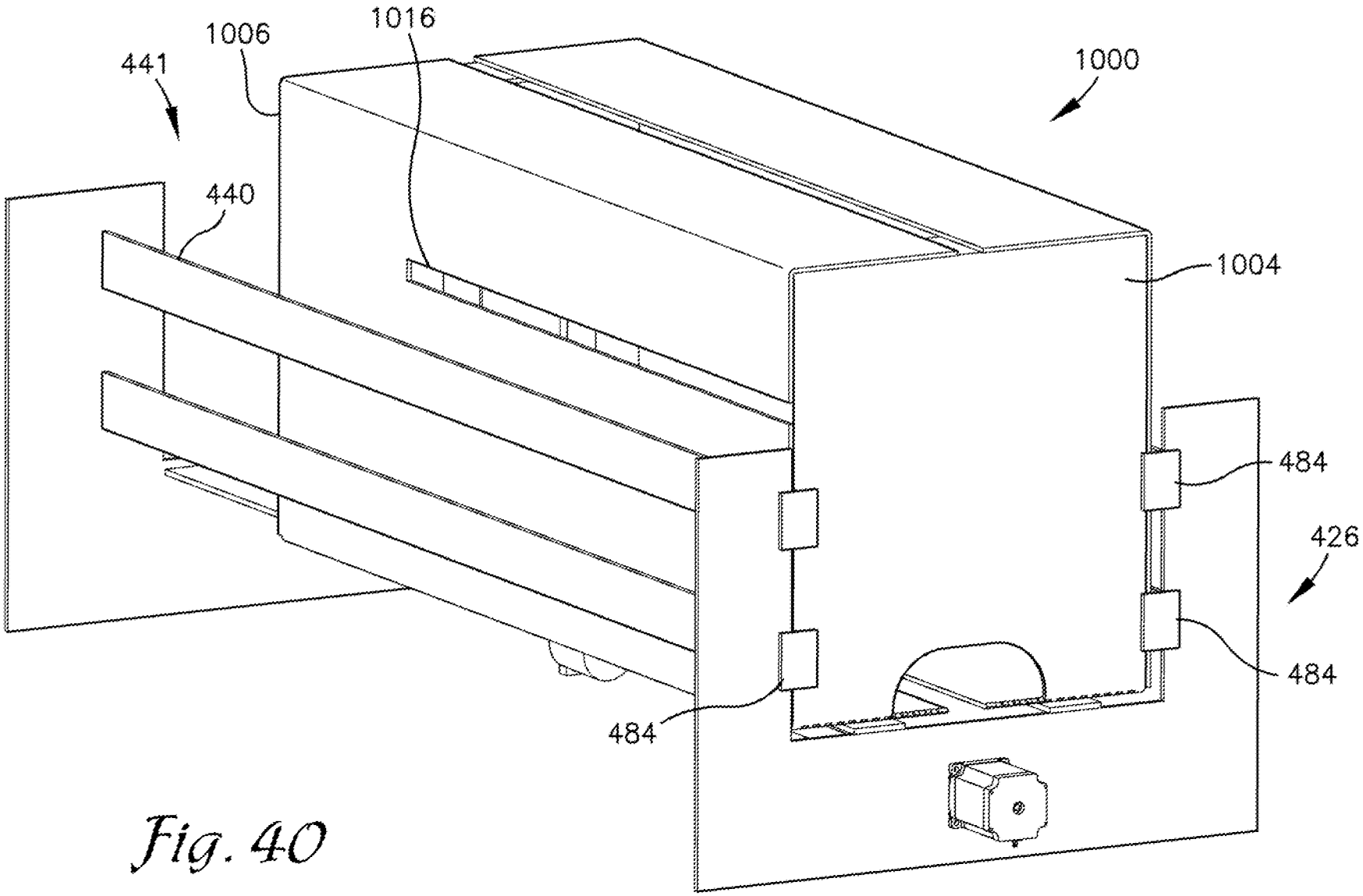
FIG. 40 is a perspective view from bag-exit end of the carton of FIG. 32 installed in a magazine of a poly bubble-bag filling machine depicted in accordance with an exemplary embodiment.
Figure 41:
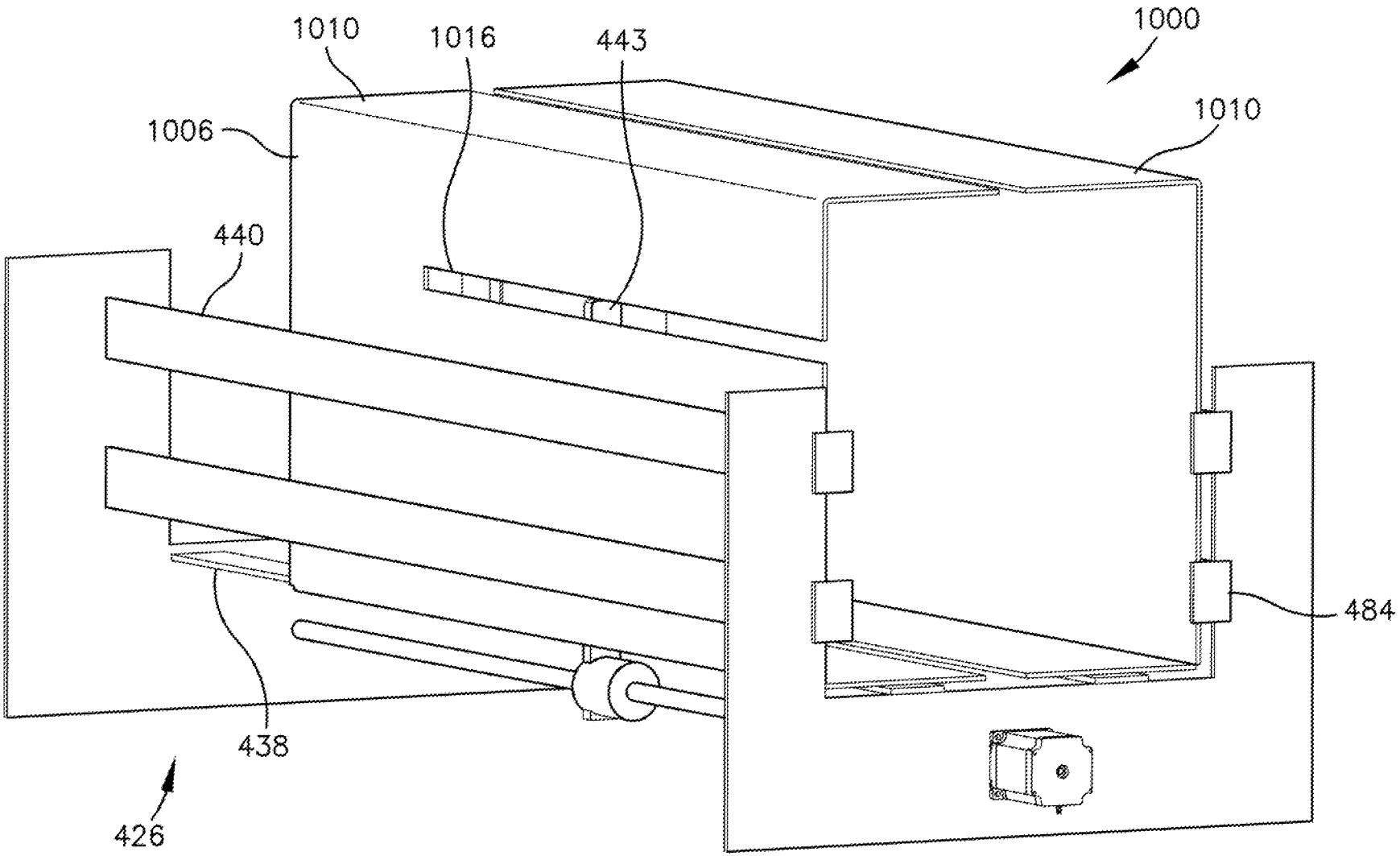
FIG. 41 is a perspective view from the pusher end of the carton of FIG. 32 installed in a magazine of a poly bubble-bag filling machine and with an endwall thereof removed to allow poly bubble-bags to be removed therefrom by a bag-filling machine depicted in accordance with an exemplary embodiment.
Figure 42:
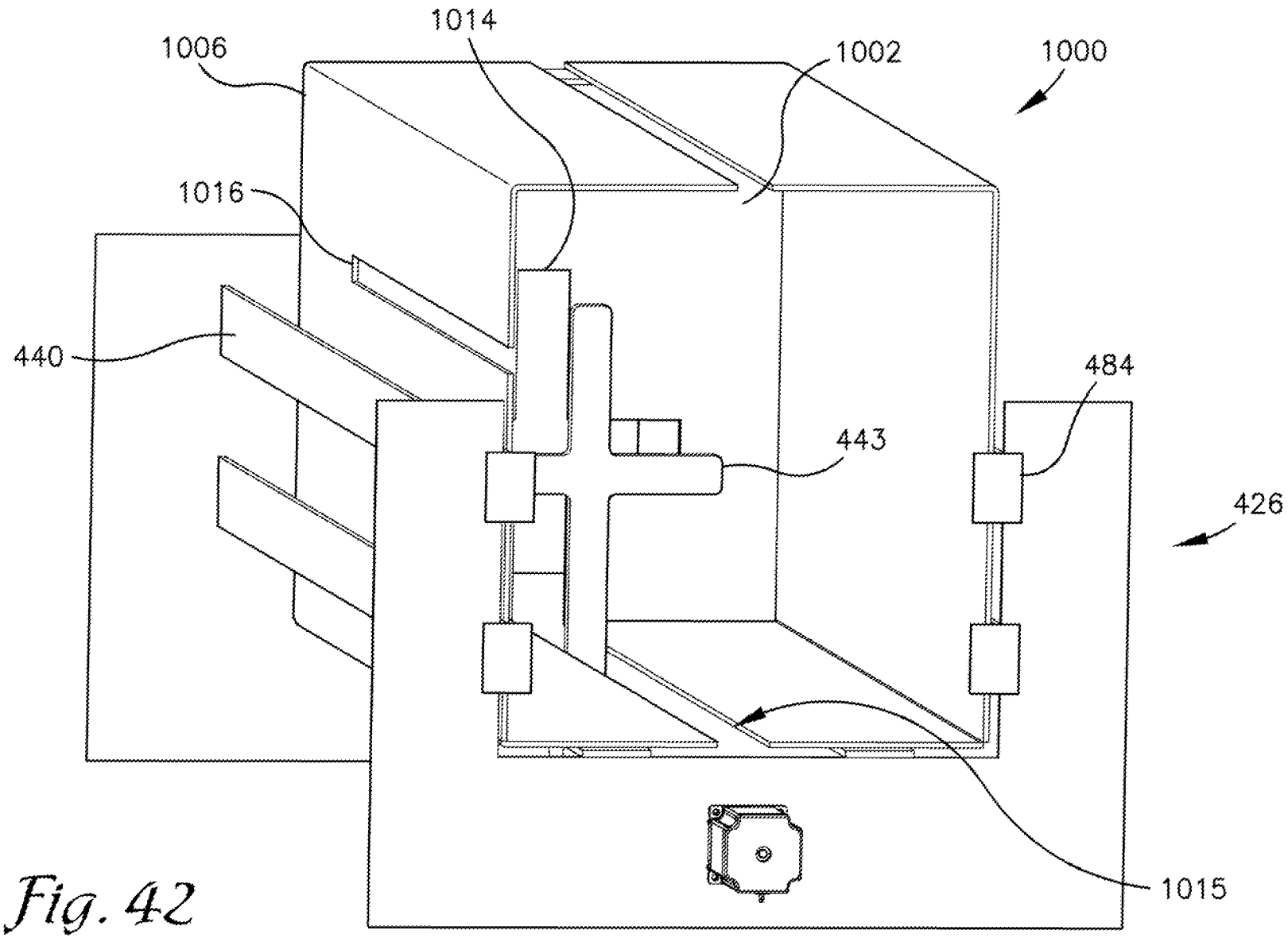
FIG. 42 perspective view of the carton of FIG. 41 depicting a pusher traversing into the carton depicted in accordance with an exemplary embodiment.
Figure 43:
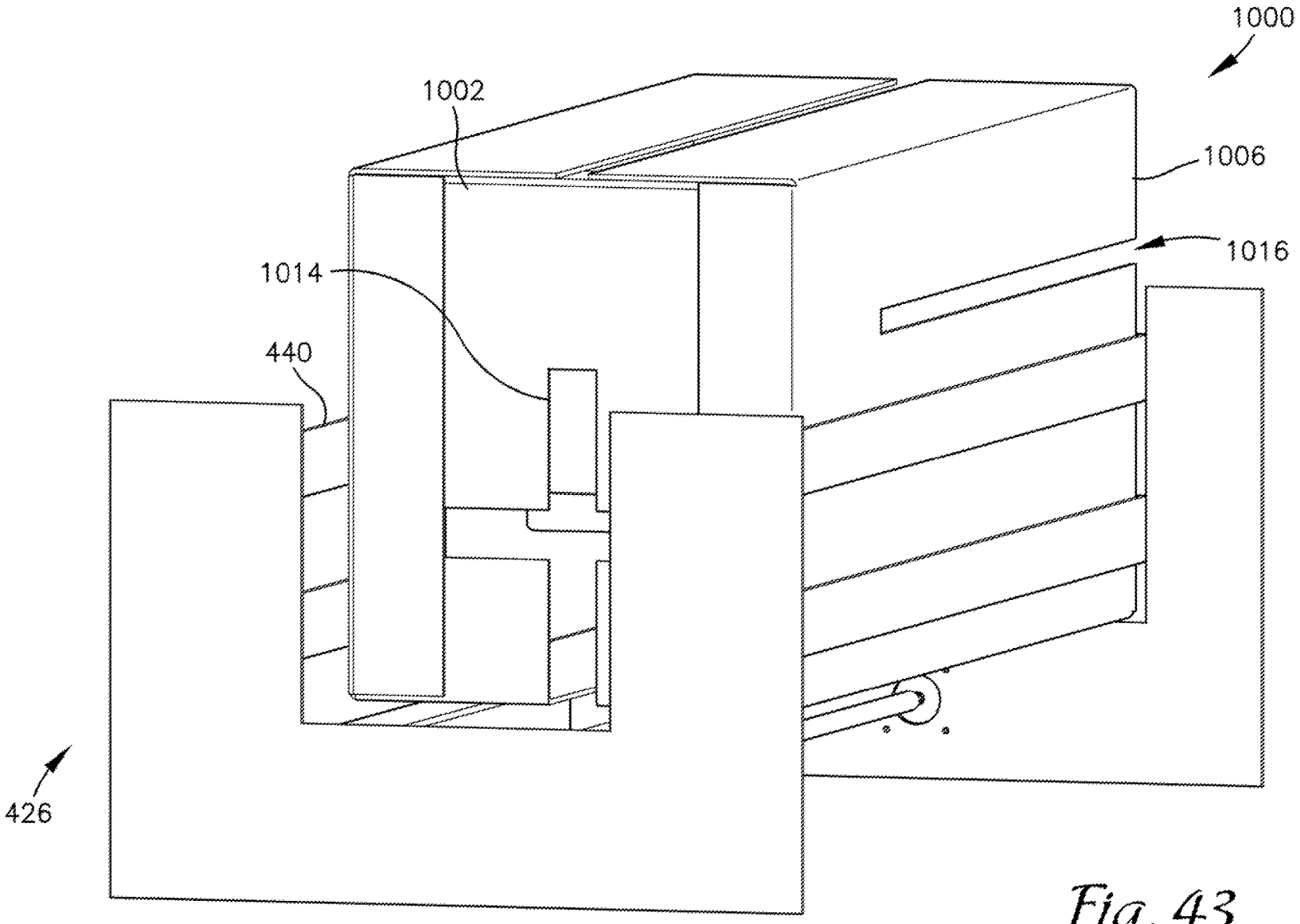
FIG. 43 is a perspective view of the carton of FIG. 42 from the pusher end of the carton depicted in accordance with an exemplary embodiment.
Figure 44:
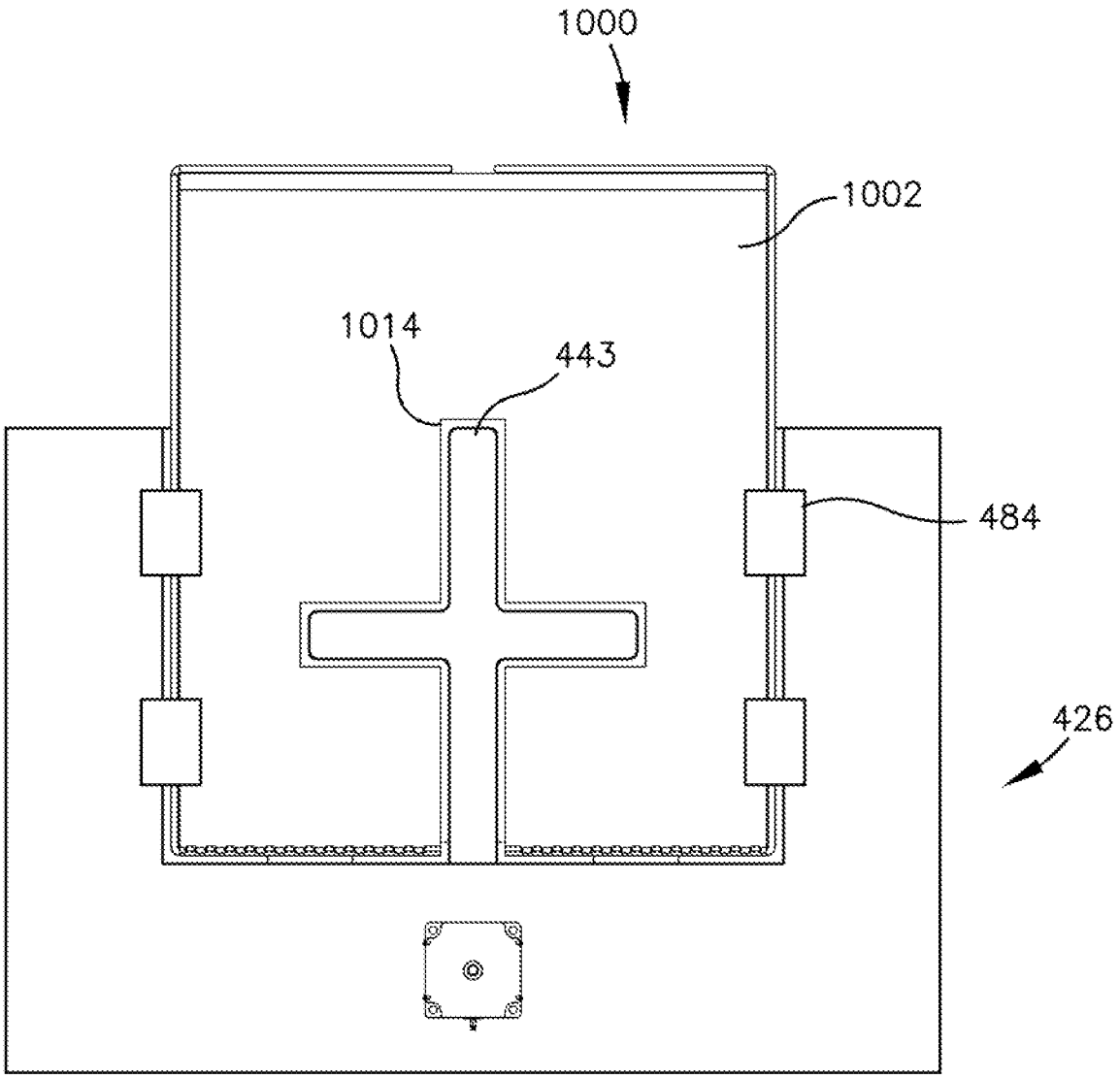
FIG. 44 is an end elevational view from the exit-end of the carton of FIG. 43.

The carton 1000 comprises a rectangular cuboidal form having a pusher-end wall 1002, a bag-exit end wall 1004, a slice-plate side panel 1006, a sidewall 1008, a pair of top wall flanges 1010, and a pair of bottom wall flanges 1012. As depicted in FIG. 35, the carton 1000 may be formed from a planar sheet of material that is cut and folded to form the above noted walls and flanges. The planar sheet material may comprise a cardstock, cardboard, corrugated paper or plastic panel, metal, or plastic sheet or the like and may be perforated and/or creased to aid forming.

The pusher-end wall 1002 includes a pusher-aperture 1014 that is sized and formed to allow passage of the pusher 443 therethrough. The pusher-aperture 1014 is preferably formed to mimic the form or outline of the pusher 443 but such is not required. Adjacent edges of the bottom wall flanges 1012 are spaced apart from one another to form a slot 1015 through which the pusher 443 can pass longitudinally along the length of the carton 1000 and the magazine 426. Similarly, adjacent edges of the top wall flanges 1010 may be spaced apart to provide a gap 1017 through which the quantity of bags 12 in the carton 1000 may be viewed and monitored.

The bag-exit end wall 1004 is preferably perforated along its connection with the carton 1000, e.g., along a fold line between the bag-exit end wall 1004 and the bottom wall flanges 1012. The bag-exit end wall 1004 may thus be easily removed from the carton 1000 by tearing or separating along the perforations. In another embodiment, the bag-exit end wall 1004 is pivotable relative to the carton 1000 to enable selective opening/closing of the bag-exit end of the carton 1000. In another embodiment, the bag-exit end wall 1004 is detachable and replaceable on the bag-exit end of the carton 1000, such as via hook-and-loop fasteners, interlocking tabs, magnets, or the like.

The slice-plate side panel 1006 includes a slice-plate slot 1016 extending along at least a portion of the longitudinal length of the slice-plate side panel 1006. The slice-plate slot 1016 is sized to enable insertion of a slice-plate through the slice-plate side panel 1006 and between bags 12 or distally to a distal-most bag 12 in the carton 1000. The slice-plate may thus apply a force on one or more bags 12 in the carton 1000 toward the bag-exit end thereof while the pusher 443 is retracted. The slice-plate slot 1016 is open to the bag-exit end of the carton 1000 to enable the slice-plate to exit the carton through the bag-exit end. In one embodiment depicted in FIG. 36, a removeable tab 1018 is provided adjacent the bag-exit end of the slice-plate slot 1016 to provide additional structural support to a carton 1000' during handling thereof. The removeable tab 1018 may be removed prior to or following installation of the carton 1000' in the magazine 426.

The formed carton 1000 can be filled with a plurality of bags 12 in a manner similar to filling of the magazines described previously, e.g., in a horizontally stacked orientation with open ends thereof directed vertically upward. With the pusher 443 fully retracted, the filled carton 1000 can then be placed into the magazine 426. The carton 1000 may be sized to generally match the longitudinal length of the channel 441 of the magazine 426 such that bag-exit end wall 1004 is disposed in abutment or adjacent to the retaining clips 484 at the proximate end of the channel 441. The bag-exit end wall 1004 may be removed by tearing along perforations, folded away, or otherwise moved to open the bag-exit end of the carton 1000 and to expose a proximate bag 12 to the bag-transfer carriage 28. The pusher 443 is actuated to move longitudinally along the channel 441 and to pass through the pusher-aperture 1014 in the pusher-end wall 1002 and into contact with a distal-most bag 12 contained in the carton 1000. Operation of the bag-filling machine 10 continues to withdraw bags 12 from the carton 1000 and the magazine 426 as described previously above.

As the bags 12 in the carton 1000 are depleted, the slice-plate may be inserted through the slice-plate slot 1016 to apply a force on bags 12 remaining in the carton 1000. The pusher 443 may be retracted and withdrawn through the pusher-aperture 1014 in the carton 1000. Upon depletion of all bags 12 in the carton 1000, the slice-plate may be withdrawn from the slice-plate slot 1016 or may pass beyond the bag-exit end of the carton 1000. The empty carton 1000 may be removed from the magazine 426 and another filled carton 1000 replaced in the magazine 426 to continue operation of the bag-filling machine 10. The empty carton 1000 may then be refilled and reused or may be recycled or disposed of.

The configuration of the carton 1000 enables replacement of the empty carton 1000 with a full carton 1000 between cycles of the bag-transfer carriage 28 without need to halt operation of the machine 10. In another embodiment, operation of the machine 10 is halted momentarily to allow replacement of the empty carton 1000. In another embodiment, the carton 1000 is sized to leave a short longitudinal space between the bag-exit end of the carton 1000 and the retaining clips 484 within which a small number of bags 12 may be positioned and held by the slice-plate beyond the bag-exit end of the carton 1000. As such, upon passing of the slice-plate beyond the bag-exit end of the carton 1000, the empty carton 1000 may be removed and a full carton 1000 replaced before the bags 12 held by the slice-plate are fully depleted and thus without halting operation of the machine 10.

Many different arrangements of the various components depicted, as well as components not shown, are possible without departing from the scope of the description provided herein. Exemplary embodiments have been described with the intent to be illustrative rather than restrictive. Alternative embodiments will become apparent to readers of this disclosure after and because of reading it. Alternative means of implementing the aforementioned can be completed without departing from the scope of exemplary embodiments described herein. Identification of structures as being configured to perform a particular function in this disclosure is intended to be inclusive of structures and arrangements or designs thereof that are within the scope of this disclosure and readily identifiable by one of skill in the art and that can perform the particular function in a similar way. Certain features and sub-combinations are of utility and may be employed without reference to other features and sub-combinations and are contemplated within the scope of exemplary embodiments described herein.

What is claimed is:

1. A bag filling machine for poly bubble bags, comprising:

a bag magazine configured to retain a plurality of preformed poly bubble bags;

a bag-transfer carriage operable to pick a bag from an end of the bag magazine and transfer the picked bag to a filling position in proximity to a filling station;

a product induction conveyor operable to transport product to the filling station;

a filling chute configured to direct product from the filling station into the picked bag;

a seal head configured to seal the bag to contain the product therein; and a carton configured to contain a stacked plurality of poly bubble bags, wherein the carton is configured for placement into the magazine such that an end bag of the stacked plurality of poly bubble bags is presented for selection by the bag-transfer carriage, and wherein the carton comprises a rectangular cuboidal having a pusher end wall, a bag exit end wall, a slice plate side panel, a side wall, a pair of top wall flanges, and a pair of bottom wall flanges.

2. The bag filling machine for poly bubble bags of claim 1, wherein the bag magazine retains the plurality of poly bubble bags in a horizontally disposed stack with at least one of the plurality of pre-formed poly bubble bags presented for selection by the bag-transfer carriage.

3. The bag filling machine for poly bubble bags of claim 1, wherein the product induction conveyor comprises conveyor belts, linear synchronous motors, actuators, or combinations thereof.

4. The bag filling machine for poly bubble bags of claim 3, wherein the product induction conveyor comprises a conveyor belt system configured to move product from the product induction conveyor to the filling station.

5. The bag filling machine for poly bubble bags of claim 1, further comprising a labeling device for printing identifying information onto the picked bag or onto a label for application onto the picked bag.

6. The bag filling machine for poly bubble bags of claim 1, further comprising a printing station operable to print documents associated with one or more products for insertion into the picked bag in conjunction with the product.

7. The bag filling machine for poly bubble bags of claim 1, wherein the carton comprises a cardstock, cardboard, corrugated paper, plastic panel, metal, or plastic sheet material.

8. The bag filling machine of claim 7, wherein the carton comprises perforations.

9. The bag filling machine for poly bubble bags of claim 1, wherein the seal head comprises a pair of opposed suction bars and a pair of opposed seal bars.

10. The bag filling machine for poly bubble bags of claim 9, wherein each of the suction bars comprise a foam pad attached to a working face of the respective suction bar.

11. The bag filling machine for poly bubble bags of claim 10, wherein the foam pad comprises a plurality of apertures configured to align with manifold openings in the suction bar to allow application of a vacuum force therethrough.

12. The bag filling machine for poly bubble bags of claim 11 wherein the suction bars are movable toward one another to contact side faces of the picked bag held therebetween such that with a vacuum applied the suction bars are withdrawn to open the poly bubble bag for filling.

13. The bag filling machine for poly bubble bags of claim 11 wherein each of the suction bars comprises a spring biased element configured to detect an object positioned between the suction bars.

14. The bag filling machine for poly bubble bags of claim 9 wherein the seal bars are movable toward one another to contact side faces of the picked bag therebetween such that heat is applied to the bag sufficient to bond opposing sides of the bag together to seal the bag.

15. A bag filling machine for poly bubble bags, comprising:

a bag magazine comprising a base and side guide bars forming a channel configured to retain a plurality of pre-formed poly bubble bags;

a bag-transfer carriage operable to pick a bag from an end of the bag magazine and transfer the picked bag to a filling position in proximity to a filling station;

a product induction conveyor operable to transport product to the filling station;

a filling chute configured to direct product from the filling station into the picked bag;

a seal head comprising a pair of moveable opposed suction bars and a pair of moveable opposed seal bars; and a carton configured to contain a stacked plurality of poly bubble bags, wherein the carton is configured for placement into the magazine such that an end bag of the stacked plurality of poly bubble bags is presented for selection by the bag-transfer carriage, and wherein the carton comprises a rectangular cuboidal having a pusher end wall, a bag exit end wall, a slice plate side panel, a side wall, a pair of top wall flanges, and a pair of bottom wall flanges.

16. The bag filling machine for poly bubble bags of claim 15, wherein each of the pair of moveable opposed suction bars comprises a plurality of manifold openings therein to allow application of a vacuum force therethrough.

17. The bag filling machine for poly bubble bags of claim 16, wherein each of the pair of moveable opposed sealing bars is configured to apply heat to seal the picked bag.

18. The bag filling machine for poly bubble bags of claim 17 wherein each of the pair of moveable opposed suction bars comprises a spring biased element configured to detect an object positioned between the pair of suction bars.

* * * * *